US006762737B2

(12) United States Patent
Kajihara et al.

(10) Patent No.: US 6,762,737 B2
(45) Date of Patent: Jul. 13, 2004

(54) TONE DISPLAY VOLTAGE GENERATING DEVICE AND TONE DISPLAY DEVICE INCLUDING THE SAME

(75) Inventors: Noriyuki Kajihara, Nara (JP); Toshio Watanabe, Kitakatsuragi (JP); Masafumi Katsutani, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 397 days.

(21) Appl. No.: 09/974,910

(22) Filed: Oct. 12, 2001

(65) Prior Publication Data

US 2002/0050970 A1 May 2, 2002

(30) Foreign Application Priority Data

Oct. 27, 2000 (JP) ..... 2000-329600
Feb. 22, 2001 (JP) ..... 2001-047374

(51) Int. Cl.[7] ..... G09G 3/36
(52) U.S. Cl. ..... 345/89; 345/211
(58) Field of Search ..... 345/87–100, 204, 345/211, 212, 690, 55, 77

(56) References Cited

U.S. PATENT DOCUMENTS 5,376,926 A * 12/1994 Sano ..... 345/89
5,489,910 A * 2/1996 Kuwata et al. ..... 345/212
6,373,419 B1 4/2002 Nakao ..... 345/98

FOREIGN PATENT DOCUMENTS

JP 08-082783 * 3/1996 ..... G02F/1/133
TW 441194 6/2001

* cited by examiner

*Primary Examiner*—Alexander Eisen
(74) *Attorney, Agent, or Firm*—Birch, Stewart, Kolasch & Birch, LLP

(57) ABSTRACT

A source driver 92 of the present invention has a reference voltage generator 38 for generating tone display voltages, and a DA converter 36 for selecting and outputting a tone display voltage to a liquid crystal panel. In the source driver 92, a buffer circuit section 41 is provided between the reference voltage generator 38 and the DA converter 36. The buffer circuit section 41 includes a buffer, and analog switch circuits which switch modes of connection between the reference voltage generator 38, the buffer, and the DA converter 36, so as to select whether to output the tone display voltage to the DA converter 36 via the buffer or without utilizing the buffer. Operations of the analog switch circuits are controlled by the analog switch circuit section 40.

16 Claims, 29 Drawing Sheets

FIG. 26 (a) CONVENTIONAL ART
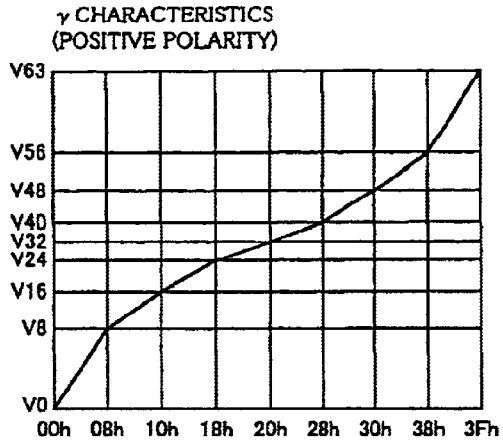
FIG. 26 (b) CONVENTIONAL ART
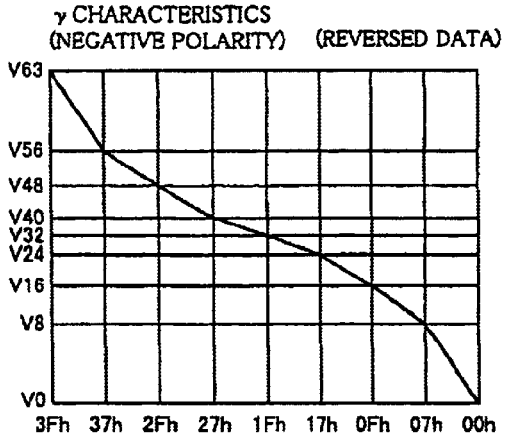
FIG. 26 (c) CONVENTIONAL ART
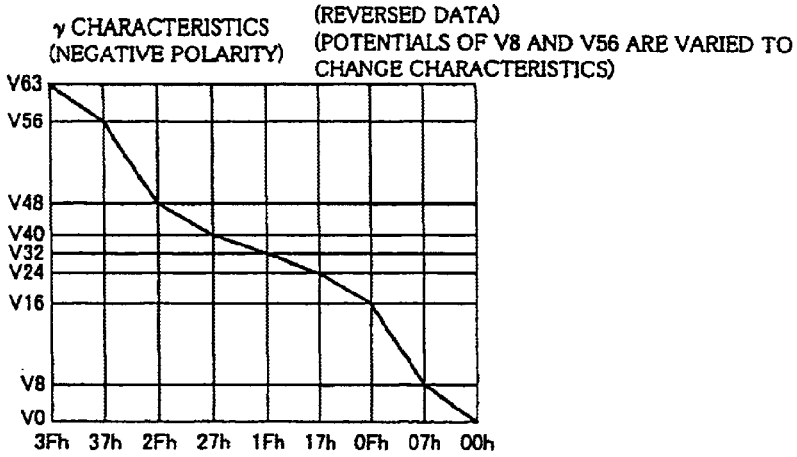

TONE DISPLAY VOLTAGE GENERATING DEVICE AND TONE DISPLAY DEVICE INCLUDING THE SAME

FIELD OF THE INVENTION

The present invention relates to a tone display voltage generating device for supplying a tone display voltage to a tone display element such as a liquid crystal panel and a plasma display panel, and also relates to a tone display device including such a tone display voltage generating device. Particularly, the invention relates to a tone display voltage generating device which switches modes of charging load capacitors of the tone display element via a selecting circuit such as a DA converter, between a rapid charging mode which utilizes a low output impedance circuit such as a buffer and a power-efficient charging mode which does not utilize the buffer, and also relates to a tone display device including such a tone display voltage generating device.

BACKGROUND OF THE INVENTION

FIG. 13 is a block diagram showing an arrangement of a liquid crystal display device of the TFT (Thin Film Transistor) system, which is a representative of the active-matrix variety.

The liquid crystal display device includes a liquid crystal display section and a liquid crystal driving unit (liquid crystal driving circuit) for driving the liquid crystal display section. The liquid crystal display section has a liquid crystal panel 901 of the TFT system. The liquid crystal panel 901 includes a plurality of display unit elements (pixels) which are disposed in a matrix pattern, and a counter electrode (common electrode) 906.

The liquid crystal driving unit, on the other hand, includes a source driver 902 and a gate driver 903, each having IC (Integrated Circuit) chips, and a controller 904 and a liquid crystal driving power supply 905.

The source driver 902 and the gate driver 903 are mounted by a common mounting method in which a TCP (Tape Carrier Package) having the IC chips on a film with a predetermined wiring pattern is mounted on ITO (Indium Tin Oxide) terminals which extend from inside toward the periphery of the liquid crystal panel 901. In other cases, the IC chips are directly mounted by heat-bonding on the ITO terminals of the liquid crystal panel 901 via an ACF (Anisotropic Conductive Film).

Further, for miniaturization of the liquid crystal display device, the controller 904, the liquid crystal driving power supply 905, the source driver 902, and the gate driver 903 may be packaged into a single chip, or two to three chips. These members are shown in separate form in FIG. 13 according to their functions.

The controller 904 outputs digital display data (e.g., video signals of R (Red), G (Green), and B (Blue)) indicated by D in FIG. 13 and various control signals indicated by S1 in FIG. 13 to the source driver 902, and outputs various control signals indicated by S2 in FIG. 13 to the gate driver 903. The control signals supplied to the source driver 902 chiefly include a horizontal synchronize signal (latch signal Ls), a start pulse signal, and a clock signal for the source driver. The control signals supplied to the gate driver 903 chiefly include a vertical synchronize signal, and a clock signal for the gate driver. Note that, power supplies for driving the IC chips (gate driver ICs, source driver ICs) are omitted in FIG. 13.

Further, the liquid crystal driving power supply 905 is for supplying a liquid crystal panel display voltage to the source driver 902 and the gate driver 903. As the term is used herein, the liquid crystal panel display voltage refers to a reference voltage for generating a tone display voltage.

Externally inputted display data are inputted to the source driver 902 via the controller 904 in the form of display data D of a digital signal. The source driver 902 samples the inputted display data D in a time sequential manner and stores the sampled data before converting it into a tone display voltage by DA (Digital-Analog) conversion in synchronism with a horizontal synchronize signal (latch signal Ls) which is sent from the controller 904.

The source driver 902 then outputs the resulting tone display analog voltage (tone display voltage) after the DA conversion through the liquid crystal driving voltage output terminals to source signal lines 1004 (see FIG. 14) which are provided in the liquid crystal panel 901.

The following describes a configuration of the liquid crystal panel 901 with reference to FIG. 14. The liquid crystal panel 901 includes pixel electrodes 1001, pixel capacitors 1002, TFTs 1003 as the switching element for switching ON/OFF a voltage applied to the pixels, the source signal lines 1004, gate signal lines 1005, and a counter electrode 1006 (corresponds to the counter electrode 906 of FIG. 13) of the liquid crystal panel. Note that, in FIG. 14, the area indicated by A corresponds to the display unit element of a single pixel.

To the source signal lines 1004 from the source driver 902 of FIG. 13 is applied a tone display voltage of an intensity according to the display brightness of a target pixel. Meanwhile, to the gate signal lines 1005 from the gate driver 903 of FIG. 13 is applied a scanning signal, so that the plurality of TFTs 1003 which are disposed in a vertical direction (i.e., direction of extension of the source signal lines 1004) are switched ON one after another.

While the TFTs 1003 are ON, the tone display voltage is applied from the source signal lines 1004 to the pixel electrodes 1001 which are connected to the drain of the TFTs 1003. This sets off storing charge in the pixel capacitors 1002 between the pixel electrodes 1001 and the counter electrode 1006. The TFTs 1003 are then switched OFF (non-select state) at the end of the selection by the gate signal lines 1005, thus maintaining the applied voltage to the pixel capacitors 1002. The transmission of light at each display unit element (pixel) is thus varied by this ON/OFF operation according to the level of the applied tone display voltage, thus realizing intended tone display.

FIG. 15 and FIG. 16 show exemplary waveforms of liquid crystal driving voltages respectively applied to the source signal lines 1004, the gate signal lines 1005, and the pixel electrodes 1001 of the liquid crystal panel 901 of FIG. 14. In FIG. 15 and FIG. 16, indicated by 1101 and 1201 are waveforms of the tone display voltage which is outputted from the source driver 902 to the source signal lines 1004. Further, indicated by 1102 and 1202 are voltage waveforms of the scanning signal outputted from the gate driver 903 to the gate signal lines 1005 for controlling ON/OFF of the TFTs 1003. Note that, the TFTs 1003 become ON when 1102 or 1202 is at High level, and become OFF when 1102 or 1202 is at Low level.

Further, 1103 and 1203 indicate a potential of the counter electrode 1006 (see FIG. 14), and 1104 and 1204 are waveforms of a voltage applied to the pixel electrodes 1001. The following explains how the voltage waveform 1104 (see FIG. 15 and elsewhere) applied to the pixel electrodes 1001 is varied with respect to a given pixel.

First, the TFT 1003 is switched ON when the scanning signal 1102 is at High level, and the pixel capacitor 1002 starts charging (i.e., application of the tone display voltage 1101). Then, the TFT 1003 is switched OFF as the scanning signal becomes Low level when the voltage of the pixel capacitor 1002 reaches a predetermined voltage level. This voltage level, corresponding to the stored charge in the pixel capacitor 1002, is maintained until the scanning signal returns to High level. Note that, the voltage waveform indicated by 1204 in FIG. 16 is also varied in this manner.

Note that, the voltage applied to a liquid crystal material (not shown) is the potential difference (voltage) between the pixel electrode 1001 and the counter electrode 1006, which is indicated by the areas of oblique lines in FIG. 15 and FIG. 16.

Further, FIG. 15 and FIG. 16 are different in the voltage values of the tone display voltages (1101, 1201) applied to the source signal lines 1004, so that displayed tones are also different. That is, desired tone display is realized by varying the potential difference (indicated by oblique lines in FIG. 15 and FIG. 16) between the pixel electrode 1001 and the counter electrode 1006 in each pixel by way of varying the voltage value of the tone display voltage. Note that, the number of tones which can be displayed is decided by the number of available voltage levels applied to the liquid crystal material. In other words, the number of tones that can be displayed is decided by the number of available voltage levels of the tone display voltage which is outputted as an analog signal.

Incidentally, the present invention relates to a reference voltage generator and an output circuit in a tone display circuit which makes up a significant portion of the total circuit size and the total power consumption. Therefore, the following explanation will be based on the liquid crystal display unit, particularly with reference to the source driver 902.

FIG. 17 is a block diagram showing an arrangement of the source driver 902. The following describes only the fundamental portions of the source driver 902 with reference to FIG. 17 along with other drawings. The digital display data DR, DG, DB (e.g., each with 6 bits) sent from the controller 904 (see FIG. 13) are temporarily latched in an input latch circuit 1301. Note that, the digital display data DR, DG, and DB correspond to data of red, green, and blue, respectively, and are collectively referred to as display data D in FIG. 13.

Further, from the controller 904, the source driver 902 receives the start pulse signal SP, and the clock signal CK for the source driver. The start pulse signal SP is successively transferred through stages of a shift register 1302 in synchronism with the clock signal CK. The start pulse signal SP has two functions: (1) One is to supply output signals from the respective stages of the shift register 1302 to a sampling memory circuit 1303; and (2) the other is to output a start pulse signal SP (cascade output signal S) for the source driver from the last stage of the shift register 1302 to the source driver on the next stage.

Further, the digital display data DR, DG, DB which were latched in the input latch circuit 1301 are temporarily stored in the sampling memory circuit 1303 in a time sequential manner in synchronism with the output signals which were supplied from the respective stages of the shift register 1302 to the sampling memory circuit 1303. The digital display data DR, DG, DB are then outputted to a hold memory circuit 1304 on the next stage.

More specifically, after the digital display data DR, DG, DB of one horizontal synchronize period (see FIG. 18) are stored, the hold memory circuit 1304 receives the output signals from the respective stages of the sampling memory circuit 1303 in accordance with the horizontal synchronize signal (latch signal Ls) supplied from the controller 904 (see FIG. 13), and outputs the output signals to a level shifter 1305 on the next stage. Further, the hold memory circuit 1304, in addition to this output operation, maintains the digital display data DR, DG, DB until the next horizontal synchronize signal is inputted.

The level shifter 1305 is the circuit which converts the levels of the input signals, for example, by raising their voltage levels, so that they can be suitably inputted into a DA converter 1306 on the next stage which operates to process the levels of applied voltages to the liquid crystal panel 901 (see FIG. 13). Further, a reference voltage generator 1309 generates various analog voltages for tone display in accordance with a reference voltage VR from the liquid crystal driving power supply 905 (see FIG. 13), and outputs the voltages so generated to the DA converter 1306.

The DA converter 1306 selects one of the analog voltages supplied from the reference voltage generator 1309, according to the digital display data which were converted into different levels by the level shifter 1305. The analog voltage which is indicative of a tone is outputted from a liquid crystal driving voltage output terminal (simply "output terminal" hereinafter) 1308, via an output circuit 1307, to the source signal lines 1004 of the liquid crystal panel 901. The output circuit 1307 serves as a buffer, and is made up of a voltage follower circuit using, for example, a differential amplifier.

FIG. 18, FIG. 19(*a*) and FIG. 19(*b*) are timing charts of the input signals or output signals of the source driver 902 or the gate driver 903 (see FIG. 13) which were described with reference to FIG. 13 through FIG. 17. As shown in FIG. 18, the vertical synchronize signal inputted to the gate driver 903 from the controller 904 and the horizontal synchronize signal (latch signal Ls) inputted to the source driver 902 are outputted in a predetermined relationship. Further, the scanning signals outputted from the gate driver 903 to the gate signal lines $G_1$ through $G_n$ (correspond to the gate signal lines 1005 of FIG. 14) respectively have select pulses (voltage signal of High level shown in FIG. 16), one in each vertical synchronize period, which occur one after another in synchronism with the horizontal synchronize signal.

Further, there is a relationship, as described above, in the signal waveforms of the scanning signal, the clock signal CK for tone display, the start pulse SP, the digital display data DR, DG, DB (labelled "digital display data signal" in FIG. 19(*a*)), and the horizontal synchronize signal, as shown in FIG. 19(*a*). Further, there is a relationship in signal waveforms (labelled "source driver output" in FIG. 19(*b*)) outputted to the source signal lines 1004 from the output terminals 1308 of the source driver 902, as shown in FIG. 19(*b*). Note that, shown in FIG. 19(*b*) is an example in which the output terminals 1308 of the source driver 902 include a total of 300 terminals X1 through X100, Y1 through Y100, and Z1 through Z100 (i.e., 100 terminals for each color of R, G, B). This enables tone display of 64 patterns as will be explained later.

The following describes circuit structures of the reference voltage generator 1309, the DA converter 1306, and the output circuit 1307 in more detail, which are particularly relevant to the present invention, with reference to FIG. 17, FIG. 20, FIG. 21, and FIG. 22.

FIG. 20 is an exemplary circuit structure of the reference voltage generator 1309. In the case where the digital display data DR, DG, DB of the respective colors of RGB are, for example, data of 6 bits, respectively, then the reference voltage generator 1309 outputs 64 analog voltages, corresponding to tones of $2^6$=64 patterns. The following describes a specific structure of this case.

The reference voltage generator 1309 adopts a structure of the simplest form, in which a resistance divider including serially connected resistances $R_0$ through $R_7$ makes up the reference voltage generator 1309. Further, each of the resistances $R_0$ through $R_7$ is made up of serially connected eight resistance elements. For example, taking resistance $R_0$ as an example, as shown in FIG. 21, the resistance $R_0$ is made up of serially connected eight resistance elements $R_{01}$, $R_{02}$, . . . , $R_{08}$. This structure remains the same for the other resistances $R_1$ through $R_7$ as well. Therefore, the structure of the reference voltage generator 1309 can be regarded as the serial connection of a total of 64 resistance elements. The resistance values of resistances $R_0$ through $R_7$ are set by taking into account the effect of γ correction, etc., as will be explained later.

Further, the reference voltage generator 1309 includes nine half-tone voltage input terminals which correspond to nine reference voltages $V'_0$, $V'_8$, . . . , $V'_{56}$, $V'_{64}$. The half-tone voltage input terminal corresponding to the reference voltage $V'_{64}$ is connected to one end of the resistance $R_0$. The other end of the resistance $R_0$, i.e., the junction of resistance $R_0$ and resistance $R_1$, is connected to the half-tone voltage input terminal corresponding to the reference voltage $V'_{56}$. In the same manner, the half-tone voltage input terminals corresponding to the reference voltages $V'_{48}$, $V'_{40}$, . . . , $V'_8$ are respectively connected to the junctions of resistances $R_1$ and $R_2$, $R_2$ and $R_3$, . . . , $R_6$ and $R_7$ adjacent to each other. Further, the half-tone voltage input terminal corresponding to the reference voltage $V'_0$ is connected to the opposite end of the junction of the resistances $R_6$ and $R_7$.

This structure enables voltages $V_1$ through $V_{63}$ to be obtained from adjacent pairs of the 64 resistance elements. In addition, these voltages $V_1$ through $V_{63}$, combined with voltage $V_0$ which is directly obtained from the reference voltage $V'_0$, gives tone display analog voltages (voltages $V_0$ through $V_{63}$) of 64 patterns. That is to say, in the reference voltage generator 1309 which is made up of resistance dividers, the tone display analog voltages $V_0$ through $V_{63}$ are decided by the resistance ratio. The analog voltages of 64 levels (voltages $V_0$ through $V_{63}$) are inputted to the DA converter 1306 from the reference voltage generator 1309.

It should be noted here that, generally, the reference voltages $V'_0$ and $V'_{64}$ at the both ends of the voltage range are always inputted to the half-tone voltage input terminals. However, seven half-tone voltage input terminals corresponding to the remaining reference voltages $V'_8$ through $V'_{56}$ are used for the purpose of fine adjustment, and it is not necessarily the case that voltages are inputted to these terminals.

The following describes the DA converter 1306. FIG. 22 shows an exemplary structure of the DA converter 1306. A structure of the output circuit 1307 is also shown in FIG. 22.

The DA converter 1306 includes MOS transistors or transmission gates as analog switches ("switches" hereinafter), and selects and outputs one of the inputted 64 voltages $V_0$ through $V_{63}$ according to display data of a 6-bit digital signal. That is, the switches are switched ON or OFF according to the bits (Bit 0 to Bit 5) of the display data of a 6-bit digital signal. That is, one of the inputted 64 voltages is selected and outputted to the output circuit 1307. The following explains how this is carried out.

The 6-bit digital signal is such that Bit 0 is the LSB (Least Significant Bit) and Bit 5 is the MSB (Most Significant Bit). The switches are provided in pairs. Bit 0 corresponds to 32 pairs of switches (64 switches), and Bit 1 corresponds to 16 pairs of switches (32 switches). Subsequently, the number of switches becomes half for each subsequent bit, and thus Bit 5 corresponds to a single pair of switches (2 switches). Therefore, there exists a total of $2^5+2^4+2^3+2^2+2^1+1=63$ pairs of switches (126 switches).

One end of the switches which correspond to Bit 0 make up terminals for receiving the voltages $V_0$ through $V_{63}$. The other end of these switches are connected to each other in pairs and connected to one end of the switches which correspond to Bit 1. This structure is repeated for each group of switches up to the pair of switches corresponding to Bit 5. The switches corresponding to Bit 5 eventually lead to a single transmission line which is connected to the output circuit 1307.

The groups of switches corresponding to Bit 0 to Bit 5 will be called switch groups $SW_0$ through $SW_5$, respectively. Each switch of the switch groups $SW_0$ through $SW_5$ is controlled by the 6-bit digital display data (Bit 0 to Bit 5) in the following manner.

In the switch groups $SW_0$ through $SW_5$, one of each pair of analog switches (lower switch in FIG. 22) becomes ON when the corresponding Bit is 0 (Low level). Conversely, the other switch (upper switch in FIG. 22) becomes ON when the corresponding Bit is 1 (High level). In FIG. 22, Bit 0 to Bit 5 are (111111), and the upper switch is ON and the lower switch is OFF in all pairs of switches. In this case, the DA converter 1306 outputs voltage $V_{63}$ to the output circuit 1307.

In the same manner, for example, the DA converter 1306 outputs voltage $V_{62}$ to the output circuit 1307 when Bit 5 to Bit 0 are (111110), and outputs $V_1$ when (000001), and $V_0$ when (000000). In this manner, one of the tone display analog voltages (voltages $V_0$ to $V_{63}$) for digital display is selectively outputted so as to realize tone display.

The reference voltage generator 1309 is usually provided for each source driver IC and is shared. On the other hand, the DA converter 1306 and the output circuit 1307 are provided for each output terminal 1308 (FIG. 17).

Further, in the case of color display, since the output terminal 1308 corresponds to each color in this case, the DA converter 1306 and the output circuit 1307 are provided for each pixel and for each color. That is, when the number of pixels in a direction of a longer side of the liquid crystal panel 90 is N, the output terminals 1308 of red, green, and blue are denoted with subscript n (n=1, 2, . . . , N) by $R_1$, $G_1$, $B_1$, $R_2$, $G_2$, $B_2$, . . . , $R_N$, $G_N$, $B_N$. Thus, there will be required 3N DA converters 1306 and 3N output circuits 1307.

Further, in order to realize intended tone display, γ correction is commonly employed. For example, γ correction is carried out by varying the resistance values of the serially connected eight resistances $R_0$, $R_1$, . . . , $R_6$, $R_7$ making up the reference voltage generator 1309, so that the respective values of the outputted analog voltages (tone display reference voltages) become non-linear, which gives non-linear characteristics to the transmission characteristics of the liquid crystal panel (liquid crystal display element).

FIG. 26(*a*) shows an example of a relationship between the digital display data and the analog voltages (tone display reference voltages) after γ correction, where the vertical axis indicates, in order of magnitude, the 64 analog voltages (voltages $V_0$ to $V_{63}$) generated by the reference voltage generator 1309, and the horizontal axis indicates the 6-bit digital display data used to perform display of 64 tones. Note that, for clarity, the digital display data is indicated by hexadecimal numerals in FIG. 26(*a*), which nonetheless correspond to binary numerals in an ordinary manner such that 000000 (00h), . . . , 001000 (08h), . . . , 111000 (38h), . . . , 111111 (3Fh).

For example, when the digital display data is 00h, as described earlier, voltage $V_0$ is selectively outputted from the DA converter 1306, and when the digital display data is 08h, voltage $V_8$ is selectively outputted from the DA converter 1306. These voltages are outputted to the liquid crystal panel 901 via the output circuit 1307.

Further, as explained above, each of the resistances $R_0$, $R_1$, . . . , $R_6$, $R_7$ is made up of the serially connected eight resistance elements of the same resistance value, and therefore the γ correction characteristics of the liquid crystal panel 901 show the kinked characteristics as shown in FIG. 26(*a*).

Meanwhile, in liquid crystal display devices, it is known that reliability of the liquid crystal material or other members suffers when a voltage of the same polarity is applied to the liquid crystal panel (liquid crystal display element) as the liquid crystal driving voltage for extended periods of time. This is avoided by adopting AC driving so that the polarity of the liquid crystal driving voltage applied to each pixel of the liquid crystal display element is reversed at certain time intervals, so as to average the voltages applied to the respective pixels of the liquid crystal display element.

In reversing the applied voltages (including the liquid crystal driving voltage) to the liquid crystal, the digital display data also need to be reversed accordingly. The following describes how this is achieved, for example, based on a method of reversing the digital display data in positive polarity driving (when the liquid crystal driving voltage has a positive polarity), and a method of reversing the digital display data in negative polarity driving (when the liquid crystal driving voltage has a negative polarity).

In these methods, the digital display data of binary numerals is reversed from "1" to "0", or from "0" to "1". For example, digital display data 000000 (00h) used in positive polarity driving is converted to digital display data 111111 (3Fh) for negative polarity driving, or digital display data 001000 (08h) used in positive polarity driving is converted to digital display data 110111 (37h) used for negative polarity driving. That is, when the digital display data 00h, 08h, . . . , 38h, 3Fh as shown in FIG. 26(*a*) are regarded as the digital display data for positive polarity driving, and when these digital display data are reversed to the digital display data for negative polarity driving, then these data become the digital display data 3Fh, 37h, . . . , 07h, 00h as shown in FIG. 26(*b*). Note that, FIG. 26(*b*) shows an example of a relationship between the digital display data and the analog voltages after γ correction, when the digital display data for positive polarity driving as shown in FIG. 26(*a*) are reversed to the digital display data for negative polarity driving.

This reversion of digital display data can easily be realized, for example, by selecting whether the output of a flip/flop circuit F/F (not shown) which makes up the hold memory circuit 1304 in the source driver 902 is from a forward output terminal Q or from a reverse output terminal/Q. The voltage applied to the counter electrode of the liquid crystal panel 901 is, for example, a ground voltage (0 V) in positive polarity driving, and is the predetermined voltage $V_{64}$ in negative polarity driving.

Thus, for example, in positive polarity driving with the digital display data 00h, the DA converter 1306 selects the voltage $V_0$ corresponding to this data 00h. As a result, a voltage ($V_0$–0 (V)) is applied to the selected pixel of the liquid crystal panel 901. On the other hand, in negative polarity driving, the DA converter 1306 selects the voltage $V_{63}$ corresponding to the digital display data 3Fh which was obtained by reversing the digital display data 00h. As a result, a voltage ($.V_{63} - V_{64}$) is applied to the selected pixel of the liquid crystal panel 901.

Note that, in this example, the voltage levels are assumed to be $V_{64}>V_{63}>, \ldots, >V_0>0$ (V), and therefore the AC driving is such that the polarity of the liquid crystal driving voltage applied to the selected pixel is periodically changed between positive polarity driving and negative polarity driving. Apparently, not only the digital display data 00h but also the other digital display data are subject to this AC driving.

Incidentally, the digital display data are reversed in the foregoing AC driving. However, as described below, the AC driving may also be carried out without reversing the digital display data. For example, in the reference voltage generator 1309 as shown in FIG. 20, in positive polarity driving, the reference voltage $V'_0$ and the reference voltage $V'_{64}$ are inputted to their corresponding input terminals, respectively, and the potential of the counter electrode 906 of the liquid crystal panel 901 is set to ground potential, for example.

On the other hand, when reversing the polarity, i.e., in negative polarity driving, in the reference voltage generator 1309, the reference voltage $V'_{64}$ and the reference voltage $V'_0$ are inputted to the input terminal of the reference voltage $V'_0$ and the input terminal of the reference voltage $V'_{64}$, respectively, and the predetermined voltage $V_{64}$ is applied to the counter electrode 906 of the liquid crystal panel 901, thereby carrying out the AC driving for periodically changing the polarity of the liquid crystal driving voltage applied to the selected pixel.

Note that, as described earlier, in the reference voltage generator 1309 as shown in FIG. 20, the half-tone voltage input terminals of the reference voltages $V'_8$, $V'_{16}$, . . . $V'_{48}$, $V'_{56}$ are used for fine adjustment of output voltages, and thus, under normal conditions, these input terminals remain unconnected, i.e., an opened state. In the foregoing AC driving of the liquid crystal panel 901, the described methods are all an example of polarity reversion of liquid crystal driving in which the γ correction characteristics remain the same irrespective of the polarity of the liquid crystal driving.

However, depending on characteristics of the liquid crystal display element (liquid crystal panel), there are cases where the required γ correction characteristics may become different when the polarity of the liquid crystal driving is changed. In this case, such different γ correction characteristics are accommodated by inputting predetermined voltages also to the half-tone voltage input terminals of the reference voltages $V'_8$, $V'_{16}$, . . . , $V'_{48}$, $V'_{56}$ of the reference voltage generator 1309 only in either one of positive polarity driving and negative polarity driving. As an specific example, in the system where the digital display data are reversed between positive polarity driving and negative polarity driving, the γ correction characteristics of FIG. 26(*a*) and the γ correction characteristics of FIG. 26(*b*) are used in the positive polarity driving and the negative polarity driving, respectively. Note that, here, the γ correction characteristics are changed at the time of polarity reversion by changing the analog voltage values outputted from the reference voltage generator 1309, by way of applying predetermined voltages to the two half-tone voltage input terminals of reference voltages $V'_8$ and $V'_{56}$ (see FIG. 26(*c*)).

The following describes various ways to connect the reference voltage generator 1309, the DA converter 1306, and the output circuit 1307, which is provided as required, with reference to FIG. 23 through FIG. 25.

The example of connection as shown in FIG. 23 is an overview of the arrangements of FIG. 20 and FIG. 21, wherein the DA converter 1306 which receives the tone display voltages $V_0$ through $V_{63}$ from the reference voltage generator 1309 selects a tone display voltage according to the inputted digital display data (output signal from the level shifter), and outputs the selected voltage to the output circuit 1307.

This output is then supplied to the source signal lines 1004 in the liquid crystal panel via the output circuit 1307, which serves as a buffer, through the output terminals 1308. Note that, in FIG. 23, indicated by 1008 is a model showing a pixel of the liquid crystal panel and a wire capacitor of a source signal line 1004 connected thereto. Here, 1002 indicates the pixel capacitor, 1003 the TFT, 1006 the potential of the counter electrode, and 1007 the wire capacitor of the source signal line 1004.

As described, the circuit structure of FIG. 23 is adapted (1) to obtain voltages $V_0$ through $V_{63}$ of different levels from the resistance dividers which are made up of a plurality of serially connected resistances, (2) to select a voltage from the voltages $V_0$ through $V_{63}$ by the analog switches according to the digital display data, and (3) to output the voltage thus selected at low impedance via the output circuit 1307 which serves as a buffer, so as to charge the wire capacitor 1007 of the source signal line 1004, or the pixel capacitor 1002 in the liquid crystal panel.

Further, as shown in FIG. 24, the output circuit 1307 may be omitted from the circuit structure of FIG. 23. In this case, the circuit is adapted (1) to obtain voltages $V_0$ through $V_{63}$ of different levels from the resistance dividers which are made up of a plurality of serially connected resistances, (2) to select a voltage from the voltages $V_0$ through $V_{63}$ by the analog switches according to the digital display data, and (3) to directly input the voltage thus selected to the source signal line 1004, so as to charge the wire capacitor 1007 or the pixel capacitor 1002.

Further, as shown in FIG. 25, it is possible to have a circuit structure in which buffers 1310, equivalent to the output circuit 1307, electrically connects the reference voltage generator 1309 and the DA converter 1306, so that the buffers 1310 are provided for the respective voltage lines carrying the voltages $V_0$ to $V_{63}$. In this case, the voltages $V_0$ to $V_{63}$ are inputted to the DA converter 1306 at low impedance via their respective buffers 1310, and a voltage which corresponds to the digital display data is selected by the analog switches, so as to charge the wire capacitor 1007 or the pixel capacitor 1002.

Incidentally, as described earlier, the reference voltage generator 1309 is usually provided for each source driver IC, and is shared, whereas the DA converter 1306 and the output circuit 1307 are provided for each output terminal 1308 (see FIG. 23 to FIG. 25).

For example, each source driver IC (source driver 902) as shown in FIG. 17 has 300 output terminals 1308 (X1 to X100, Y1 to Y100, Z1 to Z100). Given this, the number of output terminals 1308 per source driver IC is expected to increase with the advancement of smaller and thinner liquid crystal display devices and finer pitched liquid crystal panels.

For example, in the circuit structure as shown in FIG. 23, the output circuit 1307 is provided for each output terminal 1308. This increases the layout area and thus the chip area of the source driver IC chip, resulting in higher cost. Further, the buffer (FIG. 25) or the output circuit 1307 (FIG. 23) which serves as the buffer comprises an analog circuit such as the differential amplifier. This requires an operation current for example, and the power consumption is generally increased. That is, in the circuit structure in which the output circuit 1307 of multiple stages is provided, the power consumed by the output circuit 1307 becomes an obstacle for reducing power consumption of the source driver IC.

The circuit structure as shown in FIG. 24 is adapted to reduce power consumption by omitting the output circuit 1307. Here, in order to charge the wire capacitor 1007 of the source signal line 1004 or the pixel capacitor 1002 within a predetermined time period (one scanning period), the respective resistance values of the resistance dividers provided in the reference voltage generator 1309 need to be reduced. The source signal lines 1004 in particular stretch over the liquid crystal panel from the upper portion to the lower portion of the panel as shown in FIG. 14, and therefore the capacitance of the wire capacitor 1007 is relatively large already. However, the smaller resistance values of the resistance dividers always require a large current through the resistance dividers. Such a current flow adds up to a reactive current to increase power consumption.

Further, reversion of the polarity of the liquid crystal driving voltage applied to the liquid crystal panel (liquid crystal display element) 901 may result in a change in γ correction characteristics, depending on characteristics of the liquid crystal display element. One way of solving this problem is to apply predetermined voltages through the other half-tone voltage input terminals (unused terminals before the polarity reversion) of the reference voltage generator 1309. However, this requires additional pads (electrodes), corresponding to the number of the half-tone voltage input terminals, on the IC chip (here, source driver IC) and thus, providing these pads increases a chip area of the IC chip.

Further, in the case of using the half-tone voltage input terminals of the reference voltages $V'_8$, $V'_{16}$, . . . , $V'_{48}$, $V'_{56}$ (also referred to as half-tone voltages), the liquid crystal driving power supply 905 of the liquid crystal display device as shown in FIG. 13 additionally requires a half-tone voltage supply circuit for supplying these reference voltages $V'_8$, $V'_{16}$, . . . $V'_{48}$, $V'_{56}$. Further, since the reference voltages $V'_8$, $V'_{16}$, . . . , $V'_{48}$, $V'_{56}$ need to be supplied at low impedance, larger transistors, etc., are required at the output section. These factors further increase the size of liquid crystal driving power supply 905.

Further, the use of the half-tone voltages requires a large number of half-tone voltage wires for electrically connecting the liquid crystal driving power supply 905 with the respective source driver ICs. This increases the wiring area, resulting in further increase in size of the liquid crystal display device.

Further, such a large number of half-tone voltage wires makes it difficult to properly provide the wires. As a result, external noise enters these half-tone voltage wires, for example, from the clock of the source driver, which may result in poor display quality of the liquid crystal display device.

Further, the circuit structure as shown in FIG. 25 is adapted to further reduce power consumption than that by the structure of FIG. 23 by providing the buffers 1310, which are equivalent to the output circuit 1307, for the respective output stages of the tone display voltages of the reference voltage generator 1309 which is commonly provided for each source driver IC. Further, compared with the structure of FIG. 24, the resistance values of the resistance dividers in the reference voltage generator 1309 can be further increased, thus reducing the reactive current.

However, if the circuit structure of FIG. 25 were to adapt to display of 64 tones for example (FIG. 18), it will be required to provide a total of 64 buffers 1310 for the respective output stages of the tone display voltages (voltages $V_0$ through $V_{63}$) of the reference voltage generator 1309, or the buffer 1310 needs to be provided for each output of 8-tone display, i.e., for each of eight lines between eight half-tone voltage input terminals of the reference voltages $V'_0$ to $V'_{56}$ and resistance dividing means. That is, the circuit structure of FIG. 25 still requires a plurality of buffers 1310 proportional to the number of display tones or the number of tones.

Incidentally, it has become common in recent years to actively employ the TFT system even for battery-powered liquid crystal display devices of a small size which are often incorporated in portable terminals. In this connection, driving devices which consume less power are in demand to encourage development of these applications. Therefore, there is strong need to reduce the number of output circuits 1307 or buffers 1310 which consume relatively large power, and to develop a driving circuit which is capable of stably performing tone display without constant supply of a large current to the reference voltage generator 1309.

SUMMARY OF THE INVENTION

The present invention was made in view of the foregoing problems, and an object of the present invention is to provide a tone display voltage generating device which switches modes of charging load capacitors of a tone display element, for example, from a tone power supply (reference voltage generating means), which is made up of resistance dividers, via selecting means such as a DA converter, between a rapid charging mode which utilizes a low output impedance circuit such as a buffer (buffer means) and a power-efficient charging mode which does not utilize the buffer, and also to provide a tone display device including such a tone display voltage generating device.

Another object of the present invention is to provide a tone display voltage generating device which accurately outputs a predetermined voltage without consuming large power by successively and time-sequentially switching tone display voltages of different levels which are outputted to the selecting means via the low output impedance circuit, and also to provide a tone display device including such a tone display voltage generating device.

In order to achieve the foregoing objects, a tone display voltage generating device according to the present invention, in an arrangement including reference voltage generating means for generating tone display voltages of different levels according to the number of bits of display data, and selecting means for selecting a voltage from the tone display voltages of different levels according to the display data so as to output the selected voltage to a tone display element, comprises: at least one buffer means with a lower output impedance with respect to the reference voltage generating means; switching means for switching a state of connection between an output stage (voltage drawing section) of the reference voltage generating means, the buffer means, and an input stage of the selecting means, so as to select whether to utilize the buffer means or not when outputting the tone display voltages from the reference voltage generating means to the selecting means; and first control means for controlling switching operations of the switching means according to a state of tone display of the tone display element, the at least one buffer means, the switching means, and the first control means being provided between the output stage of the reference voltage generating means and the input stage of the selecting means.

According to this arrangement, the tone display voltage can be outputted from the reference voltage generating means to the selecting means by utilizing or without utilizing the buffer means of a low output impedance. For example, by outputting the tone display voltage via the buffer means of a low output impedance, load capacitors (e.g., pixel capacitors) of the tone display element such as the liquid crystal panel or plasma display panel can be rapidly charged, thereby reducing charging time.

On the other hand, when the load capacitors have been charged and are in a steady state, the tone display voltage is outputted from the reference voltage generating means to the selecting means without utilizing the buffer means which consumes relatively large power. As a result, power consumption of the tone display voltage generating means can be reduced.

That is, it is possible to provide a tone display voltage generating device which can select a mode of supplying the tone display voltage to the selecting means, either from a rapid supply mode or a power-efficient supply mode.

Further, in order to achieve the foregoing objects, a tone display device according to the present invention includes a tone display voltage generating device of the foregoing arrangement, and a tone display element which carries out tone display by the tone display voltages which are supplied from the tone display voltage generating device.

According to this arrangement, it is possible to provide a tone display device which can carry out tone display according to display data both rapidly and at low power consumption on a tone display element such as a liquid crystal panel or plasma display device.

For a fuller understanding of the nature and advantages of the invention, reference should be made to the ensuing detailed description taken in conjunction with the accompanying drawings.

BRIEF DESCRIPTION OF THE DRAWINGS

FIG. 6(*b*) is an exemplary drawing showing how tone display voltages are supplied in the circuit structure of FIG. 4.

FIG. 7(*b*) is another exemplary drawing showing how tone display voltages are supplied in the circuit structure of FIG. 4.

FIG. 8(*b*) is still another exemplary drawing showing how tone display voltages are supplied in the circuit structure of FIG. 4.

FIG. 9(*b*) is yet another exemplary drawing showing how tone display voltages are supplied in the circuit structure of FIG. 4.

FIG. 19(*b*) is an explanatory drawing showing a detailed relationship of various signals supplied to the liquid crystal panel of the liquid crystal display device of FIG. 13.

FIG. 26(*a*) is a graph showing an example of γ correction characteristics of a liquid crystal panel included in a liquid crystal display device.

FIG. 26(*b*) is a graph showing an example of γ correction characteristics of a liquid crystal panel included in a liquid crystal display device.

FIG. 26(*c*) is a graph showing an example of γ correction characteristics of a liquid crystal panel included in a liquid crystal display device.

DESCRIPTION OF THE EMBODIMENTS

First Embodiment

The following will describe one embodiment of the present invention with reference to attached drawings.

Figure 2:
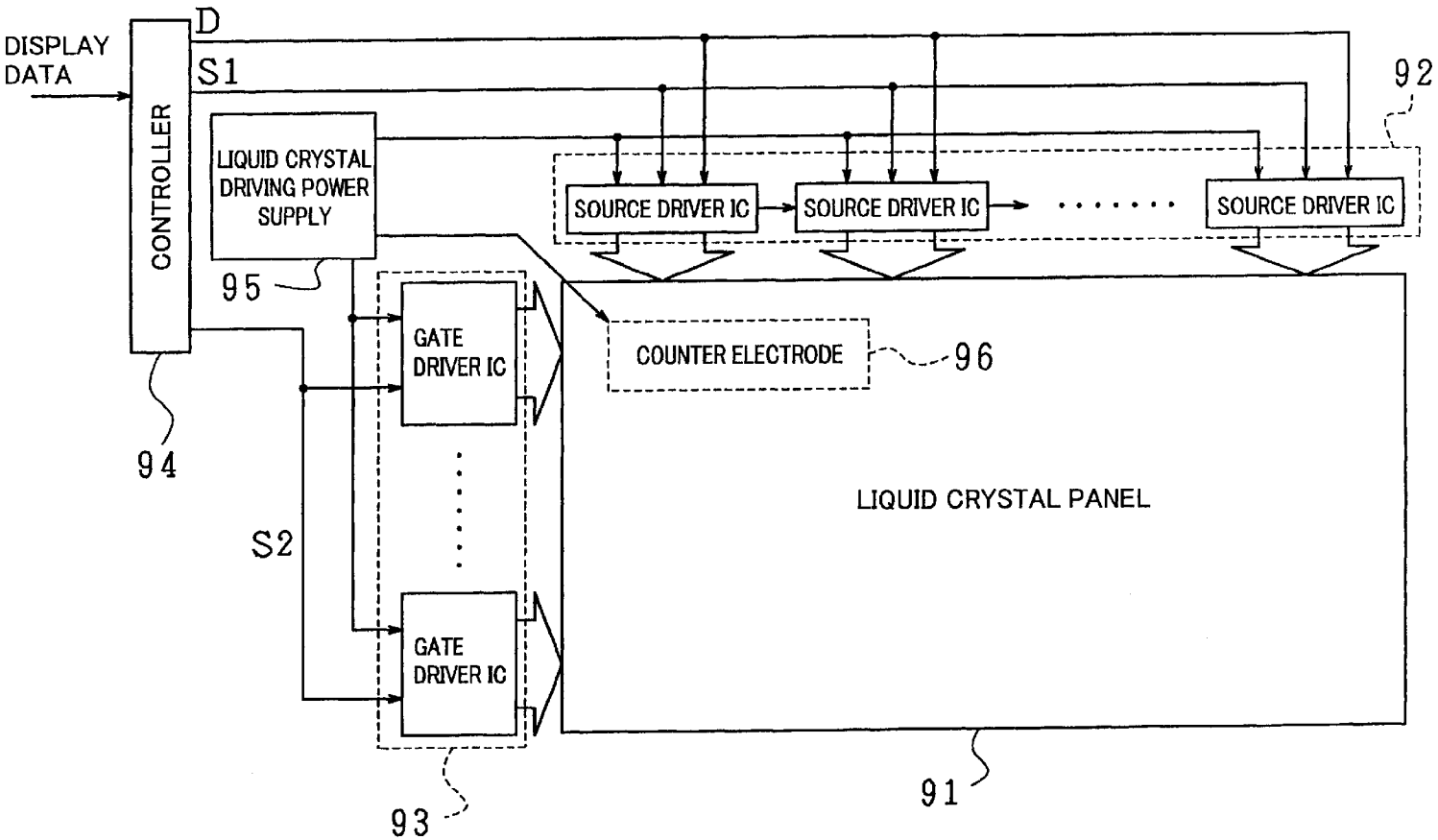
FIG. 2 is a schematic drawing showing a structure of a TFT liquid crystal display device with the source driver of FIG. 1.

FIG. 2 is a block diagram showing a structure of a liquid crystal display device (tone display device) of the TFT system including a tone display voltage generating device (tone display voltage generator) according to the present invention. As shown in FIG. 2, the liquid crystal display device includes a liquid crystal panel 91 which serves as a display section with other associated members such as a counter electrode 96, source signal lines, and gate signal lines; a controller 94 for generating display data D and control signals S1 and S2; a source driver (source driver ICs) 92 for supplying a tone display voltage to the source signal lines according to input of display data D and control signal S1; and a gate driver (gate driver ICs) 93 for activating the gate signal lines according to input of control signal S2 so as to control application of the tone display voltage to the respective pixels.

Figure 13:
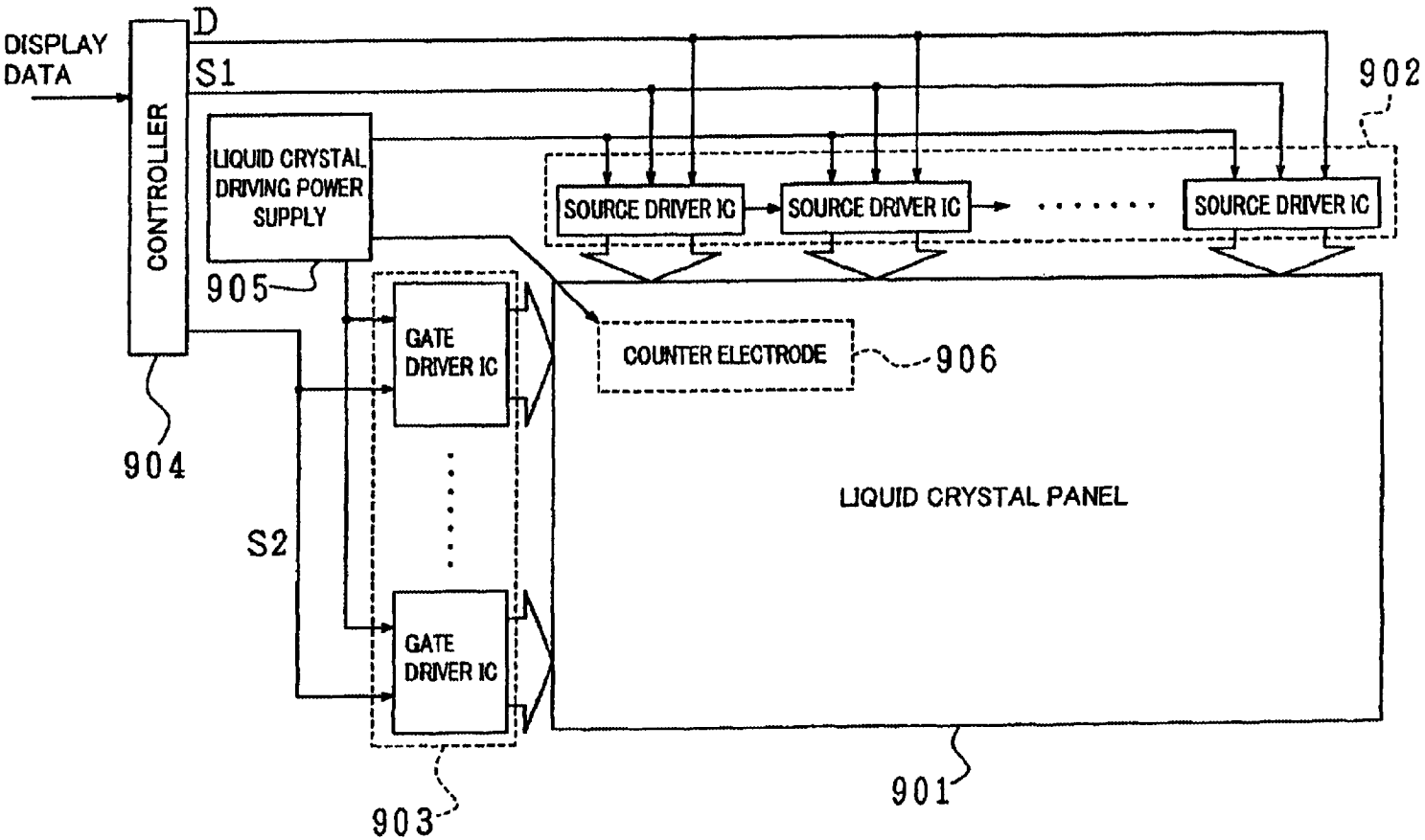
FIG. 13 CONVENTIONAL ART
FIG. 13 is a block diagram showing a schematic structure of a conventional liquid crystal display device.
Figure 14:
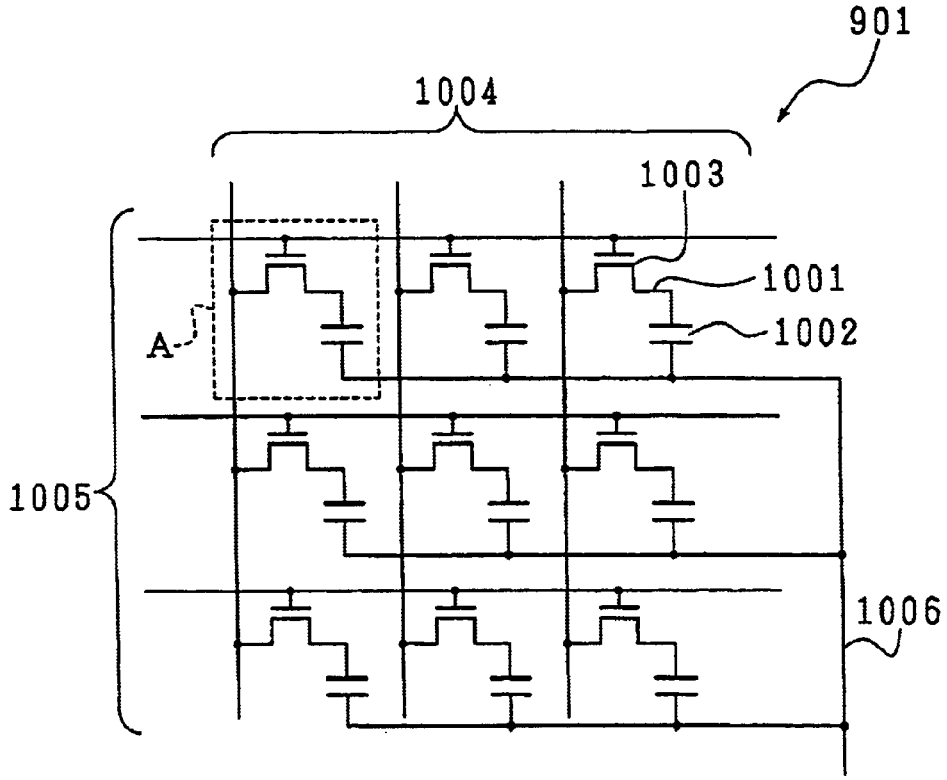
FIG. 14 CONVENTIONAL ART
FIG. 14 is a circuit diagram showing a schematic structure of a liquid crystal panel included in the liquid crystal display device of FIG. 13.
Figure 15:
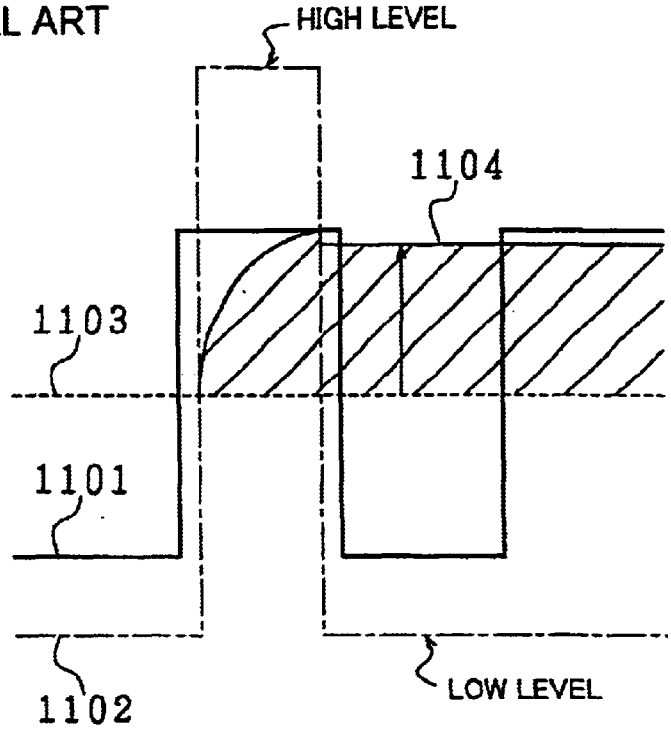
FIG. 15 CONVENTIONAL ART
FIG. 15 is an explanatory drawing showing an example of liquid crystal driving waveforms in the liquid crystal display device of FIG. 13.
Figure 16:
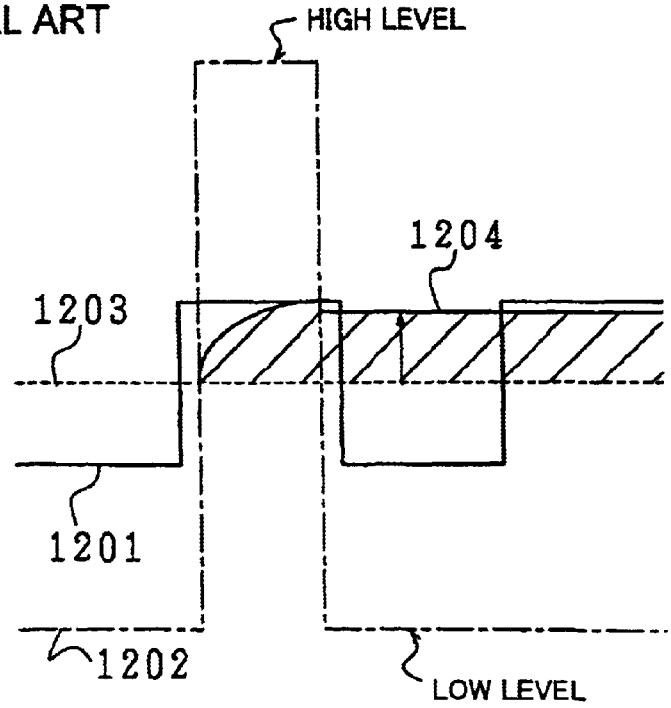
FIG. 16 CONVENTIONAL ART
FIG. 16 is an explanatory drawing showing another example of liquid crystal driving waveforms in the liquid crystal display device of FIG. 13.

The basic structure of this liquid crystal display device is essentially the same as that of the prior art indicated in FIG. 13, except that the control signal Si which is supplied from the controller 94 to the source driver (source driver ICs) 92 includes a switching control signal SW (described later) for time-sequentially switching an output state of reference voltages which are supplied from the reference voltage generator to a DA converter. The following explanation is chiefly based on the source driver 92 which makes up the tone display voltage generating device of the present invention.

Figure 1:
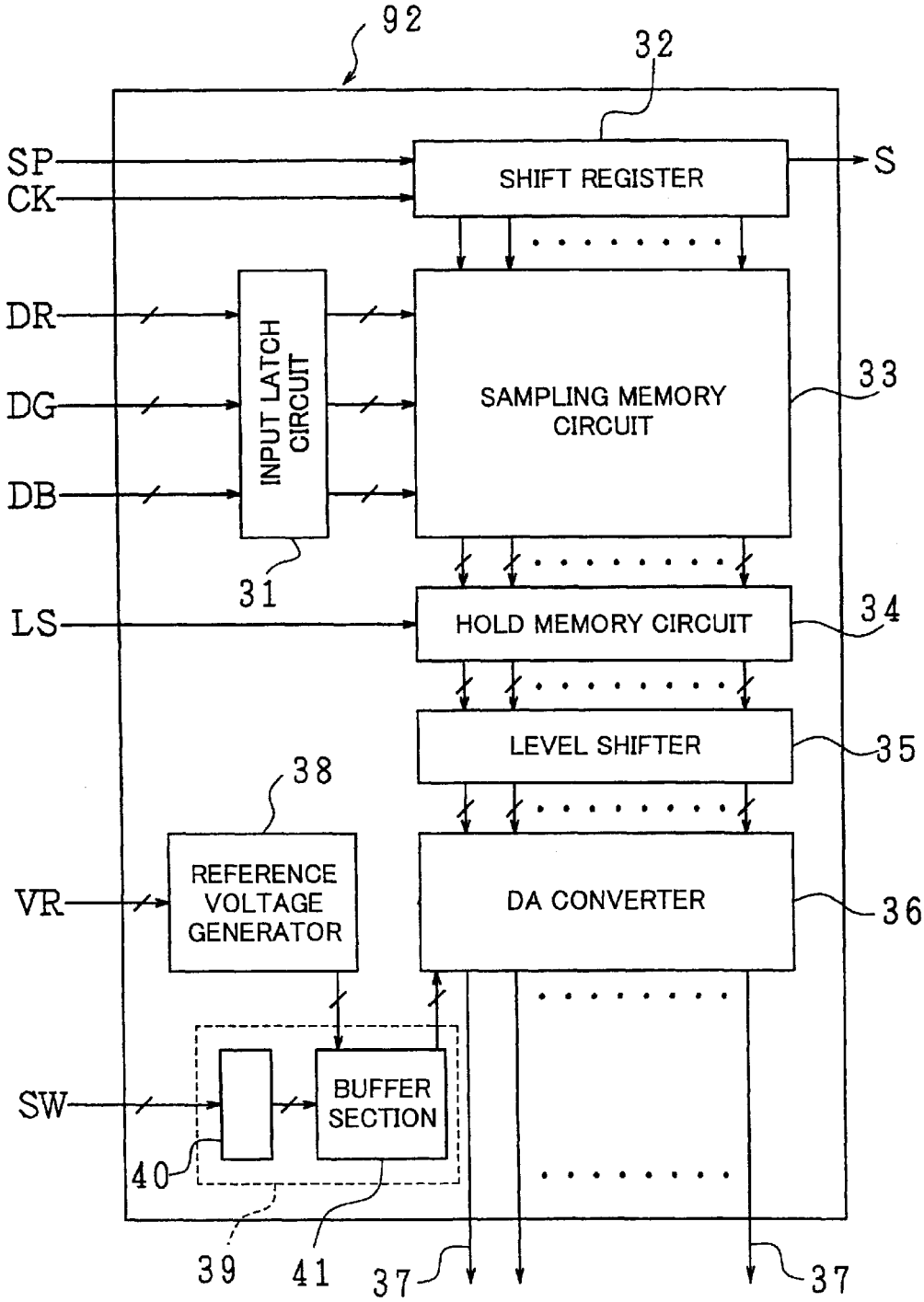
FIG. 1 is a block diagram showing a schematic structure of a source driver, which is a tone display voltage generating device according to one embodiment of the present invention.
Figure 17:
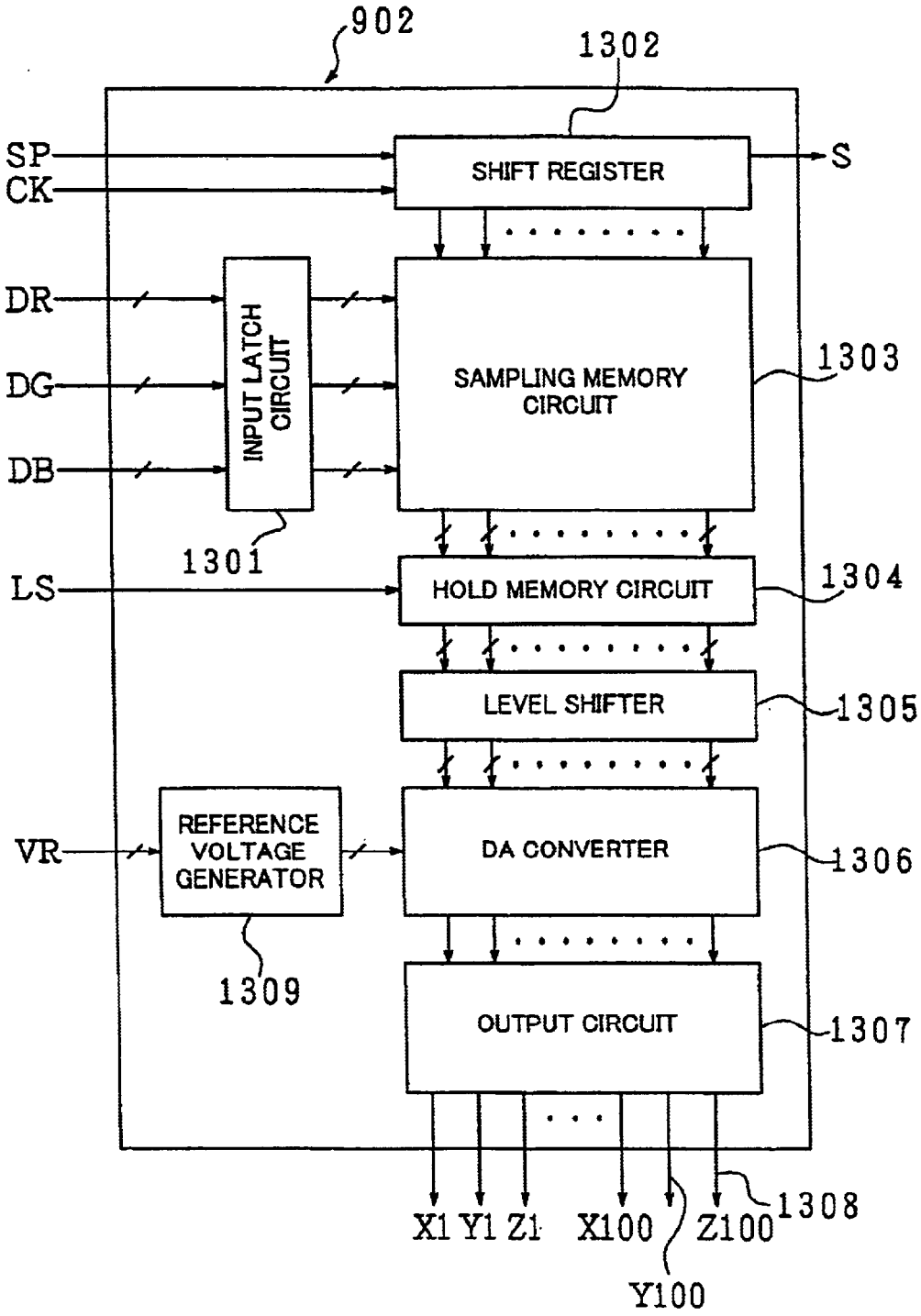
FIG. 17 CONVENTIONAL ART
FIG. 17 is a block diagram showing a schematic structure of a conventional source driver.

As shown by the schematic circuit structure of FIG. 1, the source driver (source driver ICs) 92 has a structure (equivalent to that shown in FIG. 17) including an input latch circuit 31, a shift register 32, a sampling memory circuit 33, a hold memory circuit 34, a level shifter 35, a reference voltage generator (reference voltage generating means) 38, and a DA converter (selecting means) 36, wherein the source driver 92 further includes a switching control circuit section (switching control means) 39 for time-sequentially switching an output state of reference voltages which are supplied from the reference voltage generator 38 to the DA converter 36.

Digital display data DR, DG, DB (e.g., each with 6 bits) sent from the controller 94 as shown in FIG. 2 are temporarily latched in the input latch circuit 31. Note that, the digital display data DR, DG, and DB correspond to display data of red, green, and blue, respectively, and are collectively referred to as display data D in FIG. 2.

Start pulse signal SP from the controller 94 is successively transferred through the shift register 32 in synchronism with clock signal CK, and is outputted in the form of start pulse signal SP (cascade output signal S) from the last stage of the shift register 32 to the source driver of the next stage.

The digital display data DR, DG, DB which were latched in the input latch circuit 31 are temporarily stored in the sampling memory circuit 33 in a time sequential manner in synchronism with output signals which were supplied from the respective stages of the shift register 32, and the digital display data DR, DG, DB are outputted to the hold memory circuit 34 of the next stage.

After the digital display data DR, DG, DB of one horizontal synchronize period are stored in the sampling memory circuit 33, the hold memory circuit 34 receives output signals from the respective stages of the sampling memory circuit 33 in accordance with a horizontal synchronize signal (latch signal Ls) supplied from the controller 94 (see FIG. 13), and outputs the output signals to the level shifter 35 on the next stage, and then maintains the display data until the next horizontal synchronize signal is inputted.

The level shifter 35 is the circuit which converts signal levels of the output signals from the hold memory circuit 34, for example, by raising their voltage levels, so that they can be suitably inputted into the DA converter 36 on the next stage which operates to process the levels of applied voltages to the liquid crystal panel. Further, the reference voltage generator 39 generates various analog voltages for tone display (voltages for tone display; also called "tone display voltage") in accordance with a plurality of reference voltages VR from a liquid crystal driving power supply 95 as shown in FIG. 2, and outputs the voltages so generated to the DA converter 36.

Note that, the switching control circuit section 39 electrically connects the reference voltage generator 38 with the DA converter 36, so as to enable switching of an output state of the analog voltages (tone display voltage) supplied from the reference voltage generator 38 to the DA converter 36. This feature will be described later in more detail.

The DA converter 36 selects one of the analog voltages supplied from the reference voltage generator 38, according to the display data which were converted into different levels by the level shifter 35. Here, the respective output stages of the DA converter 36 are directly connected to the corresponding source signal lines of the liquid crystal panel 91 (see FIG. 2) via liquid crystal driving voltage output terminals (simply "output terminals" hereinafter). That is, the source driver 92 is not provided with a circuit equivalent to the conventional output circuit which corresponds to the output terminal 37, and the output of the DA converter 36 is directly supplied to the liquid crystal panel.

The reference voltage generator 38, the switching control circuit 39, and the DA converter 36 make up a DA converter unit. One aspect of the liquid crystal display device of the present invention is that the DA converter unit comprises the liquid crystal driving circuit (source driver), so that the digital data (display data DR, DG, DB) to be displayed by the liquid crystal panel are applied to the respective liquid crystal display elements after DA conversion by the DA converter unit.

The following describes details of the switching control section 39 and a structure of the reference voltage generator 38 which outputs tone display voltages to the switching control section 39, which are one of the features of the present invention, with reference to attached drawings. Note that, the following explanation is based on the case where digital display data DR, DG, DB are each 6-bit data.

Figure 3:
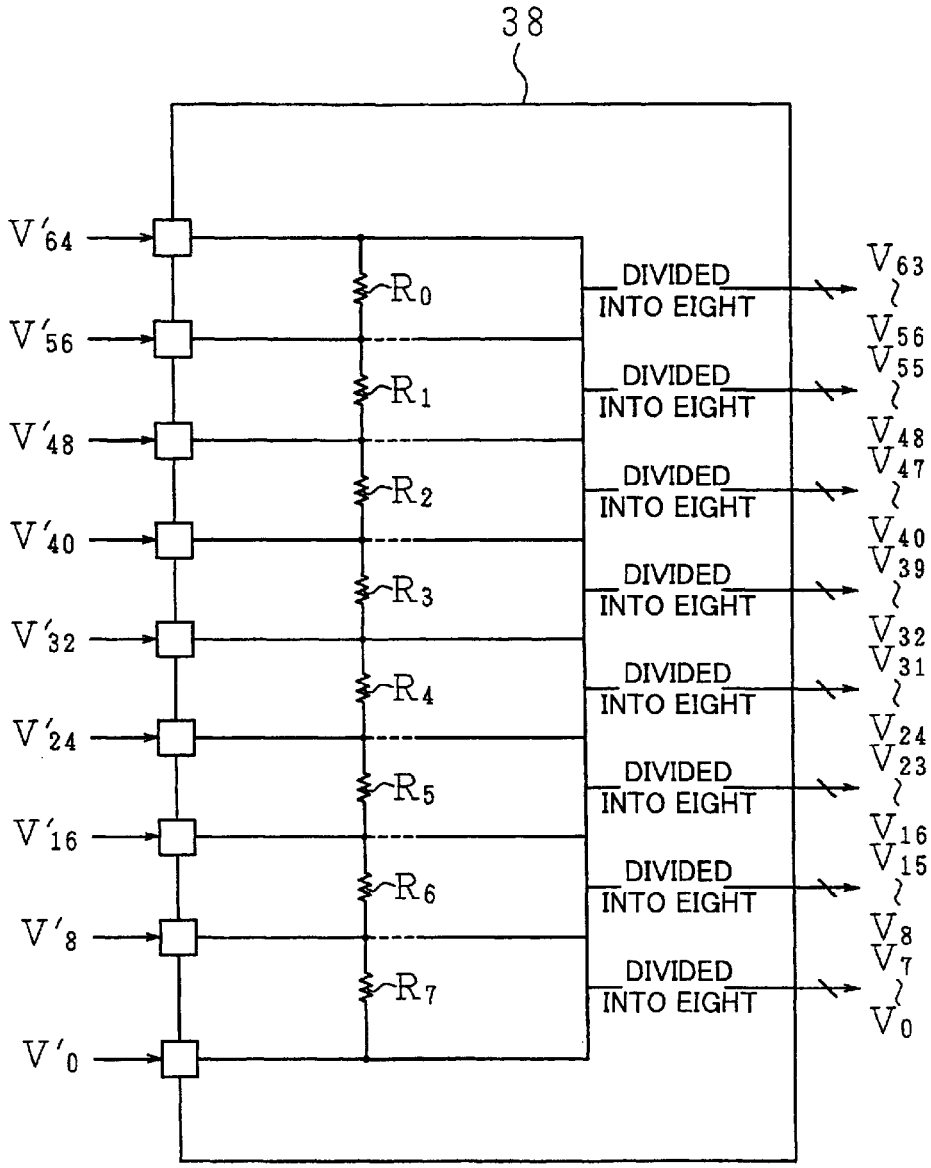
FIG. 3 is an explanatory drawing schematically showing a structure of a reference voltage generator which is provided in the source driver of FIG. 1.

As shown in FIG. 3, the reference voltage generator 38, which can suitable employ most conventional arrangements, generates $2^n$ (here, 64 voltages of different levels) tone display voltages $V_0$ through $V_{63}$ according to the display data of n bits (here, 6 bits), based on a plurality of inputted reference voltages (here, nine voltages $V'_0$, $V'_8$, $V'_{16}$, $V'_{24}$, $V'_{32}$, $V'_{40}$, $V'_{48}$, $V'_{56}$, $V_{64}$), and outputs these tone display voltages to the switching control circuit 39. The following explanation will be based on the simplest arrangement in which eight resistances $R_0$ through $R_7$ (each corresponding to a reference voltage generating block) are made up of serially connected resistance dividers, as with that shown in FIG. 20.

Note that, for convenience of explanation, the voltage levels of the tone display voltages $V_0$ through $V_{63}$ are assumed to increase in order from $V_1$ to $V_{63}$, and the denotations $V'_0$, $V'_1$, . . . , $V'_{62}$, $V_{63}$ are also used in some cases to indicate these voltage levels. Similarly, the voltage levels of the reference voltages are assumed to increase in order from $V'_0$ to $V'_{64}$, and the denotations $V'_0$, $V'_8$, . . . , $V'_{56}$, $V'_{64}$ are also used in some cases to indicate these voltage levels.

Figure 4:
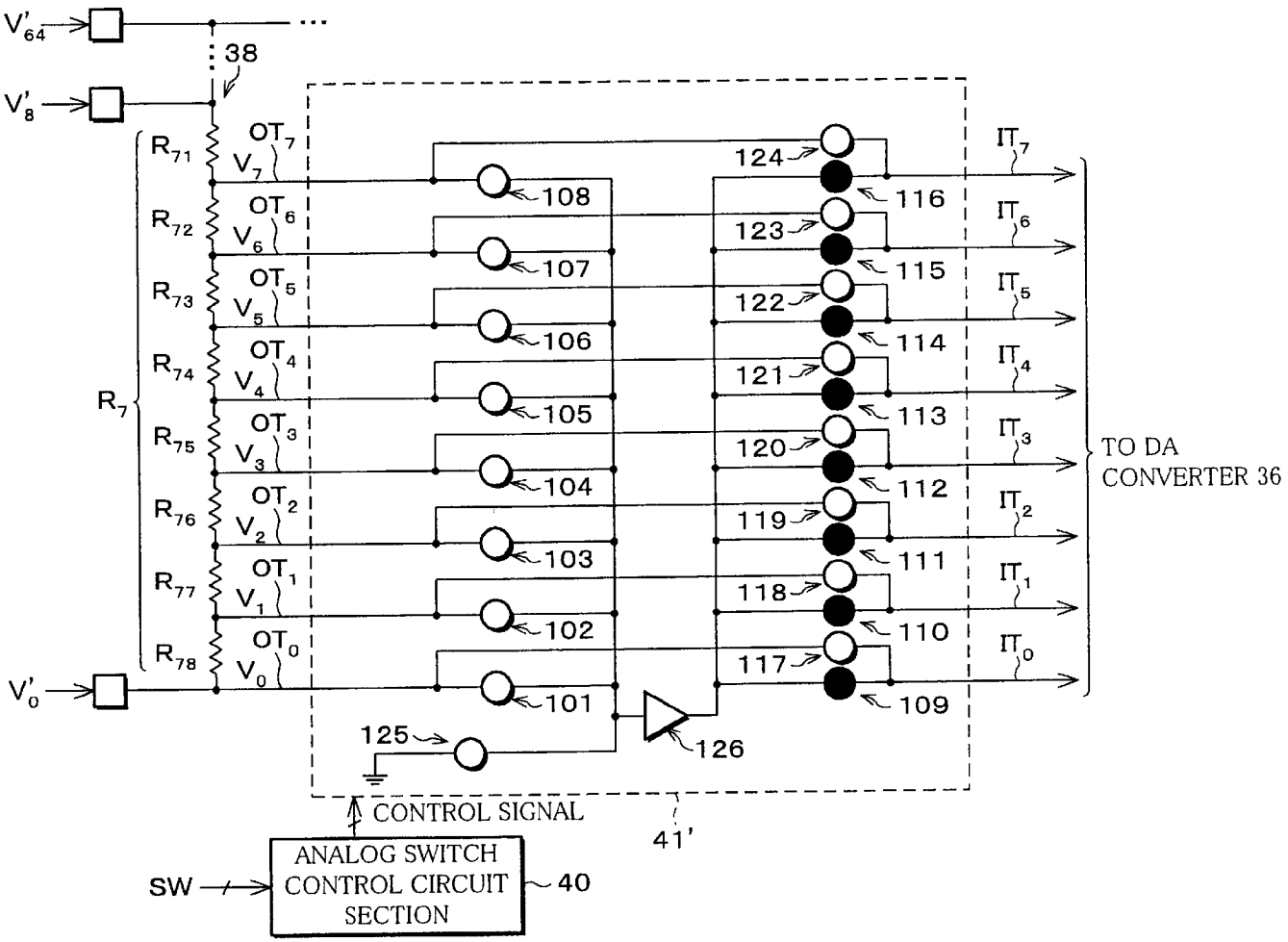
FIG. 4 is an explanatory drawing showing a main circuit structure of the source driver of FIG. 1.
Figure 20:
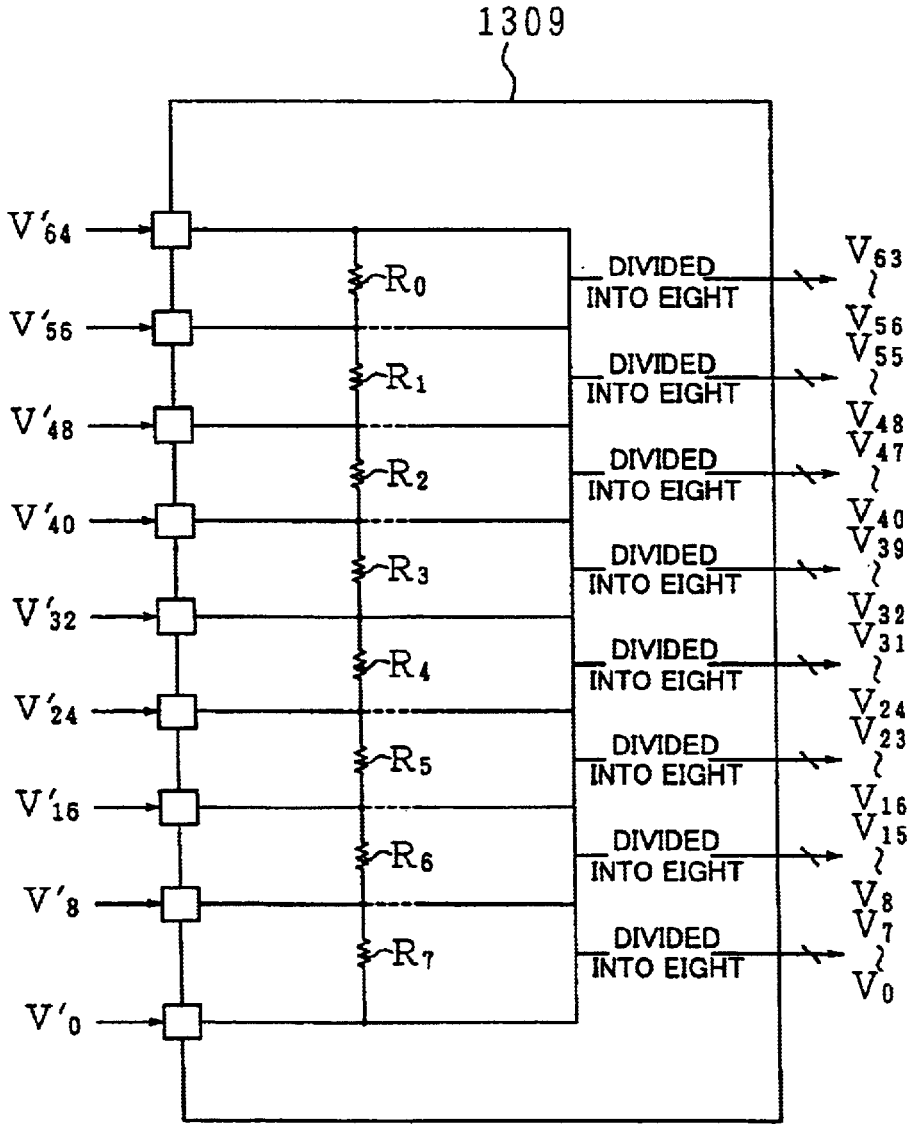
FIG. 20 CONVENTIONAL ART
FIG. 20 is an explanatory drawing showing a schematic structure of a reference voltage generator of the source driver of FIG. 17.
Figure 21:
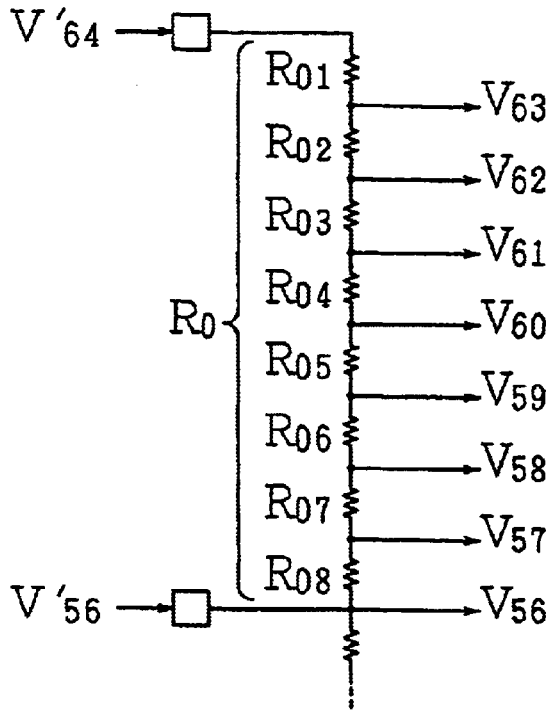
FIG. 21 CONVENTIONAL ART
FIG. 21 is a circuit diagram showing a detailed structure of resistances making up a resistance divider included in the reference voltage generator of FIG. 20.

As with the structure shown in FIG. 20, the resistances $R_0$ through $R_7$ are each made up of eight serially connected resistance elements. Taking resistance $R_7$ as an example, as shown in FIG. 4, eight resistance elements $R_{71}$, $R_{72}$, . . . , $R_{78}$ are serially connected in this order to make up resistance $R_7$. This structure remains the same for the other resistances $R_0$ through $R_6$ as well. Therefore, the structure of the reference voltage generator 39 can be regarded as the serial connection of a total of 64 resistance elements. The resistance values of resistances $R_0$ through $R_7$ are set by taking into account the effect of $\gamma$ correction, etc.

Further, as shown in FIG. 4, between the output stages of the reference voltage generator 38 and the input stages of the DA converter 36 is electrically interposed a buffer block 41' which includes 25 analog switch (switching means) circuits 101 through 125, and a buffer (buffer means) 126. In addition, there is provided an analog switch control circuit section 40 for switching ON/OFF operation of the analog switch circuits 101 through 125.

Note that, the reference voltage generator 38 shown in FIG. 4 is only ⅛ (portion corresponding to resistance $R_7$ in FIG. 3) of the whole. That is, the buffer block 41' is provided for resistance $R_7$ (one of the reference voltage generating blocks), which is one of the resistances making up the reference voltage generator 38. Thus, though not shown, a structure similar to the buffer block 41' is also provided for each of the other resistances $R_0$ through $R_6$ making up the reference voltage generator 38. Also, a buffer section 41 as shown in FIG. 1 is made up of these buffer blocks 41'. Further, the buffer section 41 and the analog switch circuit section 40 make up the switching control circuit section 39.

Further, the analog switch control circuit section 40 may be solely provided for the source driver 92 so that it is shared by all the buffer blocks 41', or it may be provided for each buffer block 41'. Note that, the operations of the buffer blocks 41' are basically the same irrespective of the corresponding reference voltage generating blocks (resistances $R_0$ through $R_7$). The following explanation is chiefly based on the operation of the buffer block 41' corresponding to resistance $R_7$.

The analog switch circuits 101 through 125 are switched ON/OFF by the analog switch control circuit section 40 according to the switching control signal SW. The switching control signal SW is generated, for example, by the controller 94 of the liquid crystal display device according to an operating state of tone display on the liquid crystal panel (a state of driving the gate signal lines or source signals lines).

In response to the input of switching control signal SW from the controller 94, the analog switch control circuit section 40 (serving as first control means in this case), based on this input signal, sends an output signal (control signal), which determines an ON/OFF state, to each of the analog switch circuits 101 through 125. As a result, the eight tone display voltages $V_0, V_1, \ldots, V_7$ which were drawn from adjacent pairs of eight resistance elements $R_{71}, R_{72}, \ldots, R_{78}$ by the resistance division of the two reference voltages $V'_0$ and $V'_8$ through the resistance elements $R_{71}, R_{72}, \ldots, R_{78}$ are inputted to the buffer block 41' via their respective output terminals $OT_0, OT_1, \ldots, OT_7$. These voltages are then inputted into the DA converter 36 via eight input terminals $IT_0, IT_1, \ldots, IT_7$ of the DA converter 36 as selected by the operating state of the analog switch circuits 101 through 125.

Here, the tone display voltages $V_0, V_1, \ldots, V_7$ are outputted either entirely or partially to the DA converter 36. In other cases, the tone display voltages $V_0, V_1, \ldots, V_7$ are inputted at least partially to the buffer 126 (buffer means) provided between the output terminals $OT_0, T_1, \ldots, OT_7$ of the reference voltage generator 38 and the input terminals $IT_0, T_1, \ldots, IT_7$, and then outputted to the DA converter 36 at low impedance. These different output states of the tone display voltages $V_0, V_1, \ldots, V_7$ are decided by the operating state of the analog switch circuits 101 through 125. This will be described later in more detail.

Note that, in conventional structures, the output terminals $OT_0, OT_1, \ldots, OT_7$ and the corresponding input terminals $IT_0, IT_1, \ldots, T_7$ were directly connected to each other without any intervening circuit such as the analog switch circuit, and all the tone display voltages $V_0, V_1, \ldots, V_7$ were directly inputted to the DA converter 36.

The following describes the circuit structure of the buffer block 41' made up of the buffer 126 and the analog switch circuits 101 through 125, and operation timings therein in more detail. The buffer 126 is realized by a circuit, for example, such as a voltage follower circuit with a differential amplifier, examples of which include a circuit element having a relatively low output impedance with respect to the output impedances of the tone display voltages from the reference voltage generator 38. The buffer 126 of this structure can be easily realized by a known technique. A specific structure of the buffer 126 will be described later. Note that, the following explanation assumes that the voltage gain of the buffer 126 is 1, but, apparently, it can take other values depending on structures of the buffer 126.

Meanwhile, the output terminal (voltage drawing section) $OT_0$, the input terminal $IT_0$, and the three analog switch circuits 101, 109, and 117, which are all involved in the output of the first tone display voltage $V_0$ from the reference voltage generator 38 to the DA converter 36, are connected in the following manner. That is, the output terminal $OT_0$ is connected to one terminal of the analog switch circuit 101 and one terminal of the analog switch circuit 117, and the other terminal of the analog switch circuit 117 is connected to one terminal of the analog switch circuit 109 and to the input terminal $IT_0$ of the DA converter 36.

In the same manner, the voltage drawing section (output terminal $OT_1$) of the second tone display voltage $V_1$ from the reference voltage generator 38 is connected to one terminal of the analog switch circuit 102 and one terminal of the analog switch circuit 118. Further, the other terminal of the analog switch circuit 118 is connected to one terminal of the analog switch circuit 110 and to the input terminal $IT_1$ of the DA converter.

The same connection pattern is also found in the following configurations (1) to (5): (1) the three analog switch circuits 103, 111, 119, the output terminal $OT_2$, and the input terminal $IT_2$ involved in the output of the third tone display voltage $V_2$ to the DA converter 36; (2) the three analog switch circuits 104, 112, 120, the output terminal $OT_3$, and the input terminal $IT_3$ involved in the output of the fourth tone display voltage $V_3$; (3) the three analog switch circuits 105, 113, 121, the output terminal $OT_4$, and the input terminal $IT_4$ involved in the output of the fifth tone display voltage $V_4$; (4) the three analog switch circuits 106, 114, 122, the output terminal $OT_5$, and the input terminal $IT_5$ involved in the output of the sixth tone display voltage $V_5$; and (5) the three analog switch circuits 107, 115, 123, the output terminal $OT_6$, and the input terminal $IT_6$ involved in the output of the seventh tone display voltage $V_6$. Further, the voltage drawing section (output terminal $OT_7$) of the eighth tone display voltage is connected to one terminal of the analog switch circuit 108 and one terminal of the analog switch circuit 124. The other terminal of the analog switch circuit 124 is connected to one terminal of the analog switch terminal 116 and to the input terminal $IT_7$ of the DA converter 36.

The eight analog switch circuits 101 through 108, with one end being connected to at least one of the corresponding eight output terminals $OT_0$ to $OT_7$, have the common other end (i.e., connected to one another by a single line). Also, this common end of the analog switch circuits 101 through 108 is electrically connected via one end of this common single line to the input terminal of the buffer 126 and to one terminal of the analog switch circuit 125. The other terminal of the analog switch circuit 125 is grounded.

Further, the analog switch circuits 109 through 116 (indicated by solid circles in FIG. 4), with one end being connected to at least one of the corresponding eight input terminals $IT_0$ to $IT_7$, have the common other end (i.e., connected to one another by a single line). Also, the common end of the analog switch circuits 109 through 116 is electrically connected via one end of this common single line to the output terminal of the buffer 126.

Note that, the analog switch circuits 101 through 125 are circuits including analog switches which are made up of MOS transistors and transmission gates, etc., and can be easily obtained by a known technique. Further, the ON/OFF control of the analog switch circuits 101 through 125 is made by inputting a control signal, which is generated by the analog switch control circuit section 40, to the respective control terminals (not shown) of the analog switch circuits, wherein the circuits become ON when the control signal is at High level, and OFF when the control signal is at Low level.

The analog switch control circuit section 40 can be easily realized, for example, with the use of such a circuit element as a shift register and gate, and by inputting a reset signal and a transfer signal thereto as the switch control signal SW from the controller 94. It should be noted however that the buffer 126, the analog switch circuits 101 to 125, and the analog switch control circuit section 40 can be realized in various ways and are not just limited to the structures disclosed in this embodiment.

Figure 5:
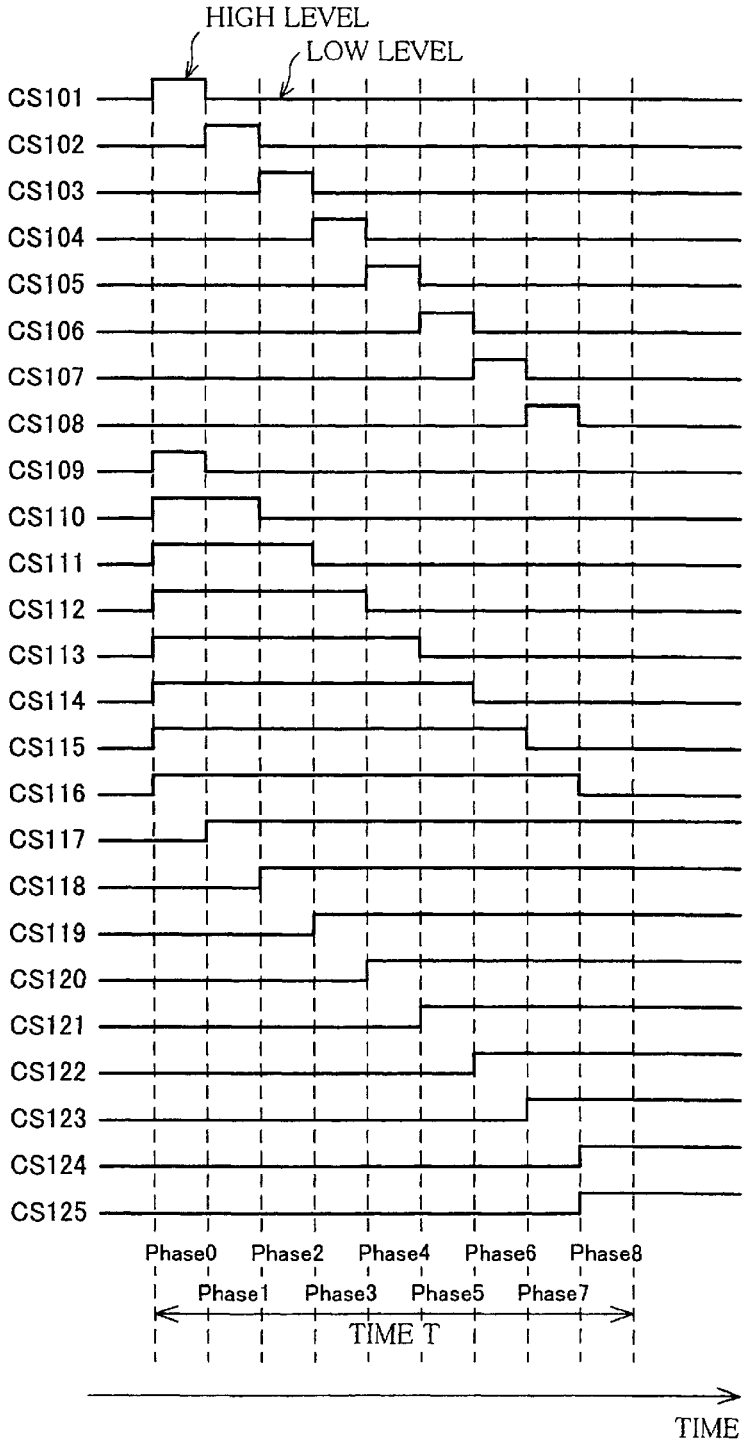
FIG. 5 is a timing chart showing timings of supplying control signals which are generated by an analog switch control circuit section shown in FIG. 4.

The following explains operations of the switching control circuit section 39 with reference to an ON/OFF timing chart of the analog switch circuits 101 through 125 shown in FIG. 5. Note that, the following explanation is based on only the switching operations of the analog switch circuits 101 through 125 of one of the buffer blocks 41' as shown in FIG. 4. However, operations of the other buffer blocks 41' in the source driver 92, if provided, will also be the same. Further, for convenience of explanation, the voltage levels of the eight tone display voltages $V_0$ through $V_7$ are assumed to increase in this order (ascending order).

Figure 6:
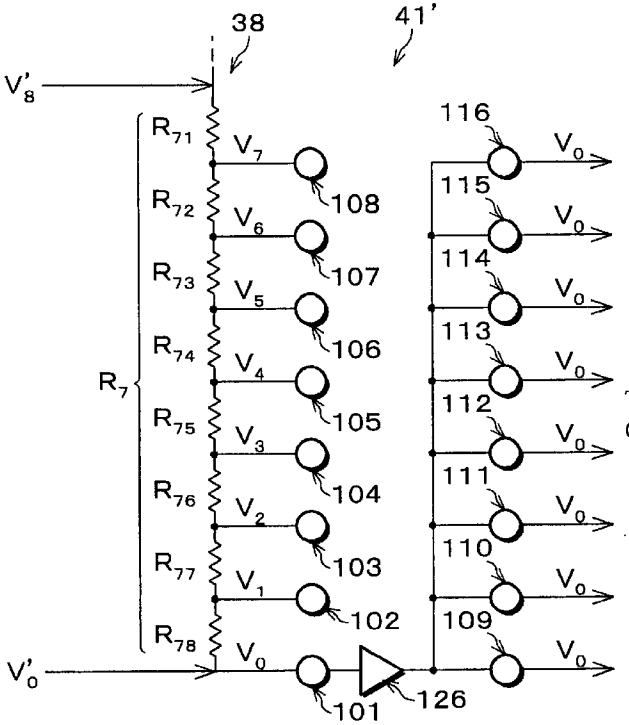
FIG. 6(*a*) is an exemplary drawing showing how tone display voltages are supplied in the circuit structure of FIG. 4.
Figure 6:
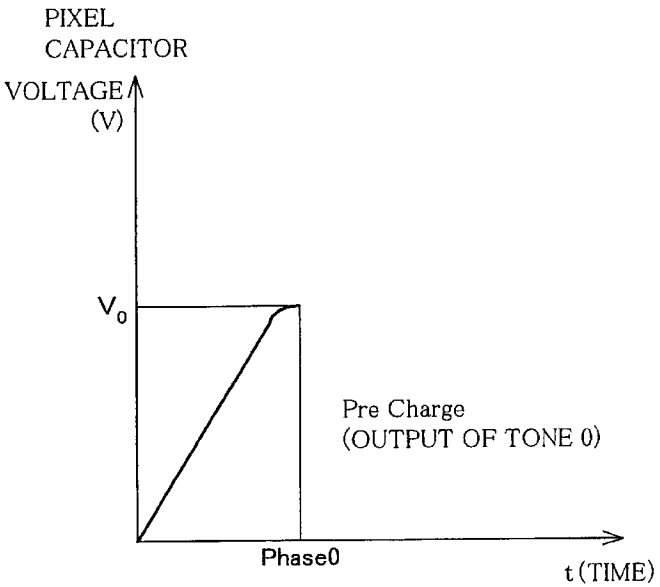

First, in Phase 0 of FIG. 5, the nine analog switch circuits 101, 109 through 116 are switched ON, while the other analog switch circuits remain OFF. Note that, in FIG. 5, CS 101 through CS 125 indicate control signals for the analog switch circuits 101 through 125, respectively. FIG. 6(*a*) schematically shows the buffer block 41' in this state. As a result, the first tone display voltage $V_0$ of the lowest voltage level is outputted via the buffer 126 as the output voltage from the reference voltage generator 38 to the DA converter 36.

Figure 22:
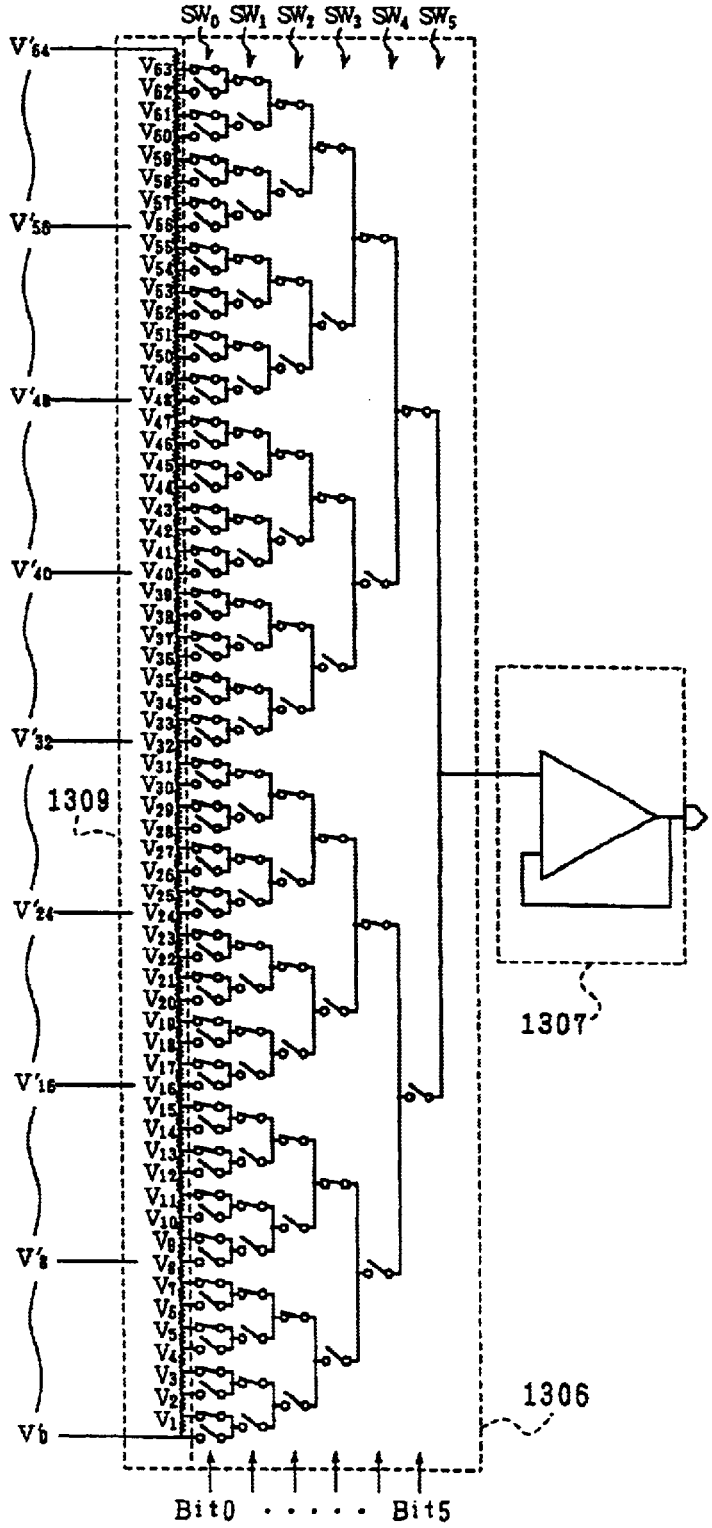
FIG. 22 CONVENTIONAL ART
FIG. 22 is an explanatory drawing schematically showing structures of the reference voltage generator, a DA converter, and an output circuit of the source driver.
Figure 23:
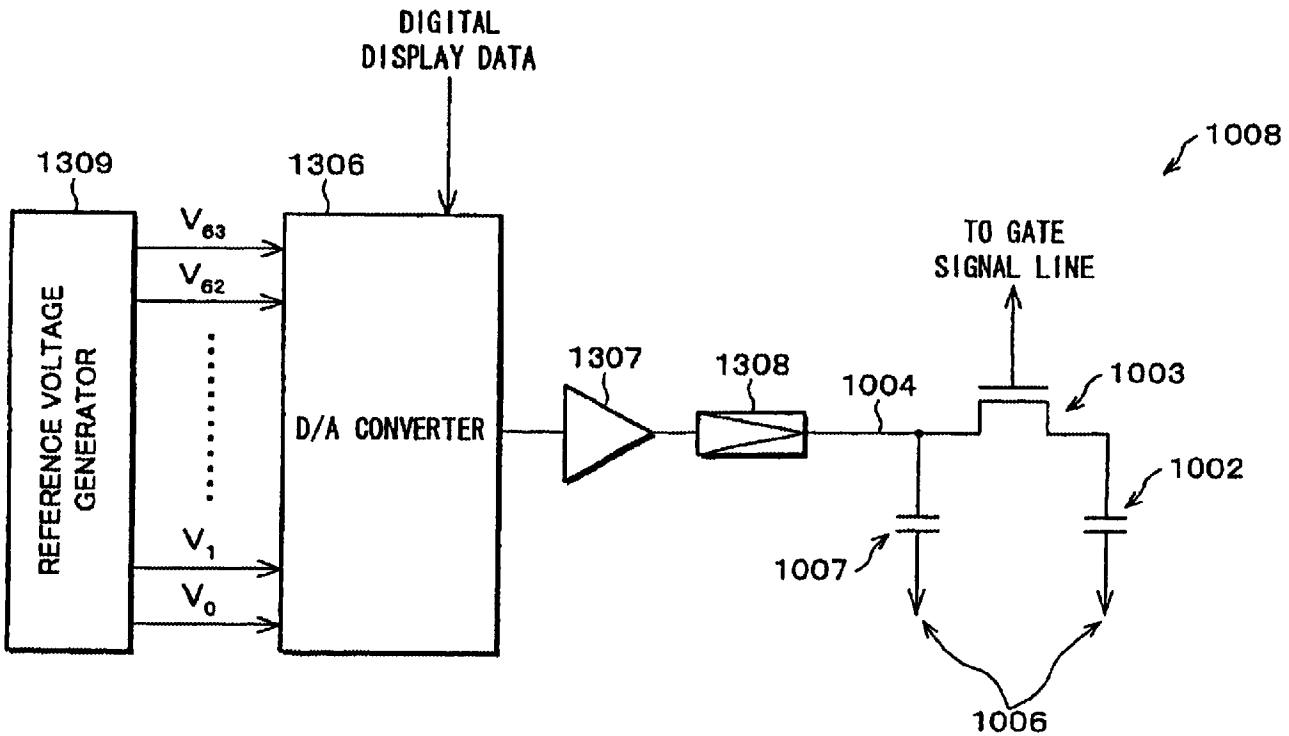
FIG. 23 CONVENTIONAL ART
FIG. 23 is an explanatory drawing showing a schematic structure of another conventional liquid crystal display device.
Figure 24:
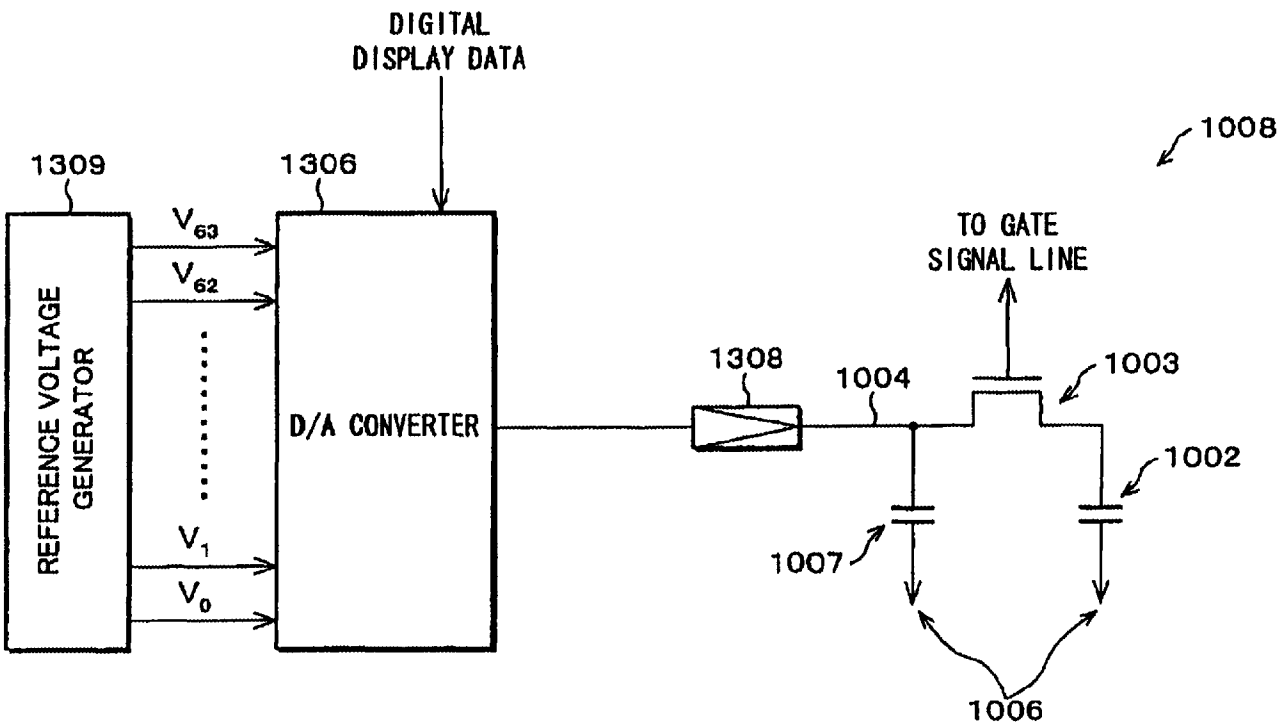
FIG. 24 CONVENTIONAL ART
FIG. 24 is an explanatory drawing showing a schematic structure of still another conventional liquid crystal display device.
Figure 25:
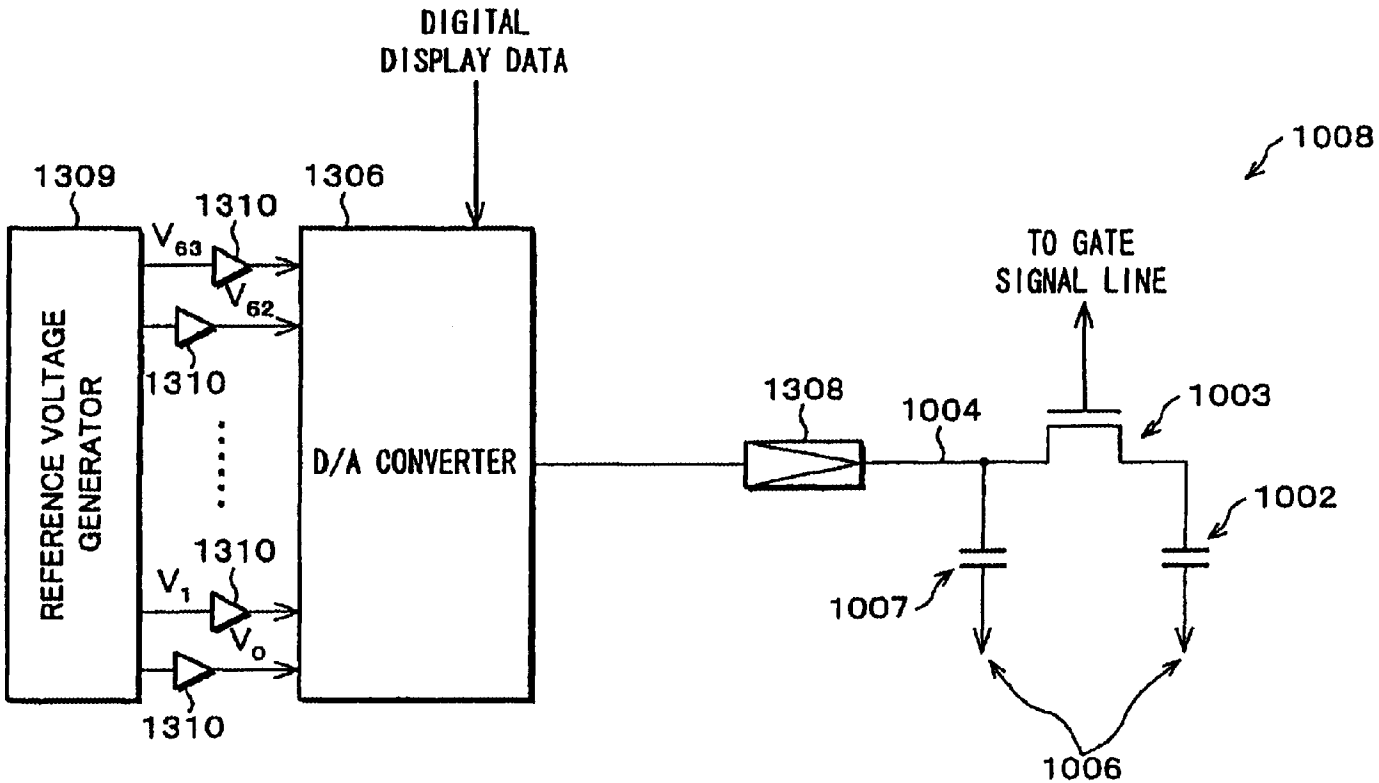
FIG. 25 CONVENTIONAL ART
FIG. 25 is an explanatory drawing showing a schematic structure of yet another conventional liquid crystal display device.

The first tone display voltage $V_0$ is outputted to all the pixels (pixels with ON TFTs by the scanning signal) of the liquid crystal panel 91 selecting one of the tone display voltages $V_0$ through $V_7$ as selected by the DA converter 36 according to the digital display data DR, DG, DB. The pixel capacitors of these pixels, including the wire capacitors of the source signal lines, are charged by the buffer 126 of the low output impedance, thus instantly attaining the level of the first tone display voltage $V_0$ (see FIG. 6(*b*)). Note that, the selecting operation of the tone display voltage in the DA converter 36 is decided according to the digital display data as with the conventional example (see FIG. 22), and a detailed explanation of such is omitted here.

Figure 7:
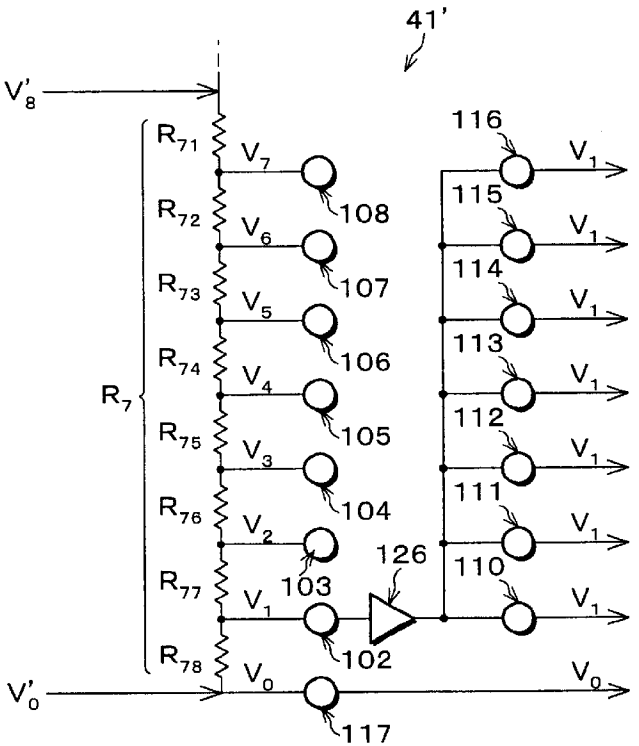
FIG. 7(*a*) is another exemplary drawing showing how tone display voltages are supplied in the circuit structure of FIG. 4.
Figure 7:
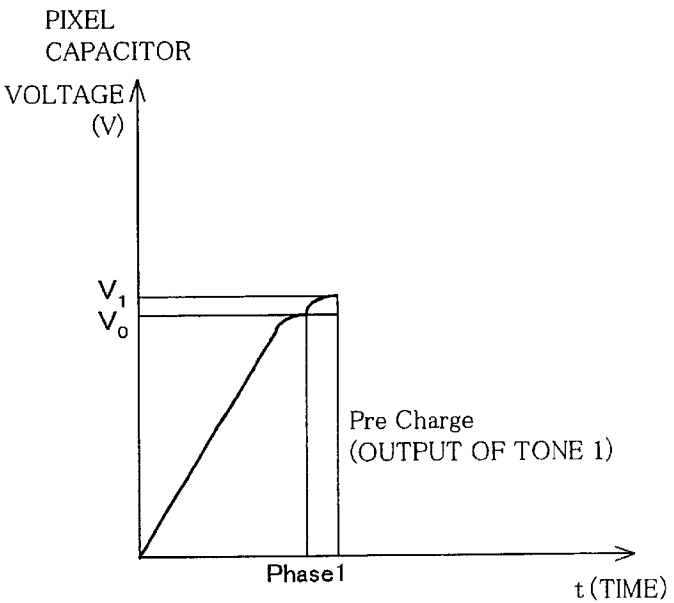

The sequence goes to Phase 1 as shown in FIG. 5 as the pixel capacitors of the selected pixels reach the level of the first tone display voltage $V_0$ after the charging in Phase 0. Here, the nine analog switch circuits 102, 110 through 117 are switched ON, while the other analog switch circuits are OFF. FIG. 7(*a*) schematically shows the buffer block 41' in this state.

Here, the pixel capacitors of the pixels (pixels with ON TFTs by the scanning signal) selecting the tone display voltage $V_0$ have been already charged to the predetermined voltage level ($V_0$) through Phase 0, and do not need further charging. However, since the TFTs of these pixels remain ON for one horizontal period, it is required to maintain this voltage level ($V_0$). Nevertheless, the voltage level can be made stable even in a high output impedance state without utilizing the buffer 126, and thus the analog switch circuit 117 is switched ON and the tone display voltage $V_0$ from the reference voltage generator 38 is directly inputted to the DA converter 36.

Meanwhile, the second tone display voltage $V_1$ of the next level via the buffer 126 is outputted to the DA converter 36 from the other seven input terminals (see FIG. 4) $IT_1$ through $IT_7$. The second tone display voltage $V_1$ is outputted to all the pixels (pixels with ON TFTs by the scanning signal) selecting one of the tone display voltages $V_1$ through $V_7$ except the tone display voltage $V_0$ as selected by the DA converter 36 according to the digital display data DR, DG, DB. The pixel capacitors of these pixels, including the wire capacitors of the source signal lines, are charged from $V_0$ to $V_1$ using the buffer 126 of the low output impedance, so as to instantly reach the level of the second tone display voltage $V_1$ (see FIG. 7(*b*)).

The sequence goes to Phase 2 as shown in FIG. 5 as the pixel capacitors of the selected pixels reach the level of the second tone display voltage $V_1$ after the charging in Phase 1. Here, the nine analog switch circuits 103, 111 through 118 are switched ON, while the other analog switch circuits are OFF.

Here, the pixel capacitors of the pixels (pixels with ON TFTs by the scanning signal) selecting the tone display voltage $V_1$ have been already charged to the predetermined voltage level ($V_1$) through Phase 1, and do not need further charging. Thus, the voltage level ($V_1$) can be made stable even in a high output impedance state without utilizing the buffer 126, and thus the analog switch circuit 118 is switched ON and the tone display voltage $V_1$ from the reference voltage generator 38 is directly inputted to the DA converter 36. The first tone display voltage $V_0$ is also directly inputted to the DA converter 36 via the analog switch circuit 117.

Meanwhile, the third tone display voltage $V_2$ of the next level is outputted from the other six input terminals (see FIG. 4) $IT_2$ through $IT_7$ via the buffer 126 into the DA converter 36. The second tone display voltage $V_2$ is outputted to all the pixels (pixels with ON TFTs by the scanning signal) selecting one of the tone display voltages $V_2$ through $V_7$ except the tone display voltages $V_0$ and $V_1$ as selected by the DA converter 36 according to the digital display data DR, DG, DB. The pixel capacitors of these pixels, including the wire capacitors of the source signal lines, are charged from $V_1$ to $V_2$ using the buffer 126 of the low output impedance, so as to instantly reach the level of the third tone display voltage $V_2$ (see FIG. 7(*b*)).

The sequence subsequently goes to Phase 3 through Phase 7 as shown in FIG. 5 as the pixel capacitors of the selected pixels reach the level of the tone display voltage $V_2$ after the charging in phase 2. For example, in Phase 3, only the nine analog switch circuits 104, 112 through 119 are switched ON to output only the fourth tone display voltage $V_3$ to the DA converter 36 via the buffer 126, while the first through third tone display voltages $V_0$ through $V_2$ are directly outputted without utilizing the buffer 126.

In Phase 4, only the nine analog switch circuits 105, 113 through 120 are switched ON to output only the fifth tone display voltage $V_4$ to the DA converter 36 via the buffer 126, while the first through fourth tone display voltages $V_0$ through $V_3$ are directly outputted without utilizing the buffer 126. Further, in Phase 5, only the nine analog switch circuits 106, 114 through 121 are switched ON to output only the sixth tone display voltage $V_5$ to the DA converter 36 via the buffer 126, while the first through fifth tone display voltages $V_0$ through $V_4$ are directly outputted without utilizing the buffer 126. Further, in Phase 6, only the nine analog switch circuits 107, 115 through 122 are switched ON to output only the seventh tone display voltage $V_6$ to the DA converter 36 via the buffer 126, while the first through sixth tone display voltages $V_0$ through $V_5$ are directly outputted without utilizing the buffer 126.

The levels of the tone display voltages outputted via the buffer 126 are thus raised stepwise from $V_0$ to $V_6$. In the subsequent Phase 7, only the nine analog switch circuits 108, 116 through 123 are switched ON to output only the eighth tone display voltage $V_7$ of the highest level to the DA converter 36 via the buffer 126, while the first through seventh tone display voltages $V_0$ through $V_6$ are directly outputted without utilizing the buffer 126 (see FIG. 8(*a*) and other drawings).

Figure 8:
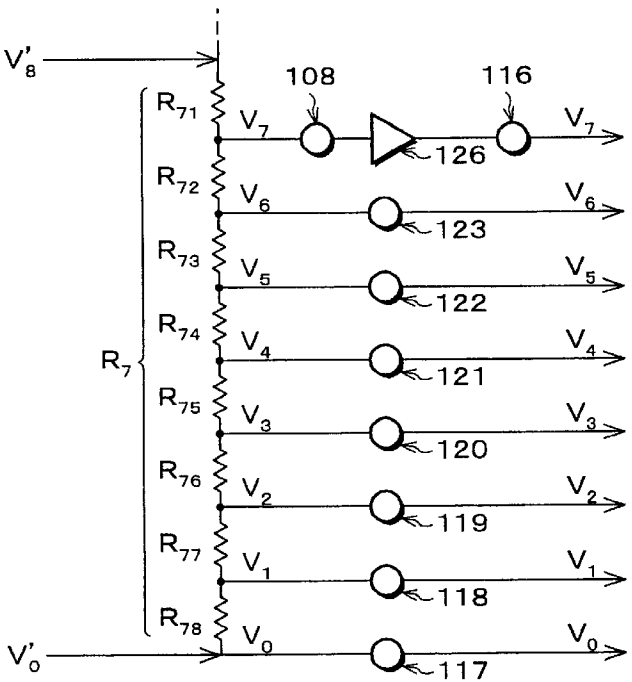
FIG. 8(*a*) is still another exemplary drawing showing how tone display voltages are supplied in the circuit structure of FIG. 4.
Figure 8:
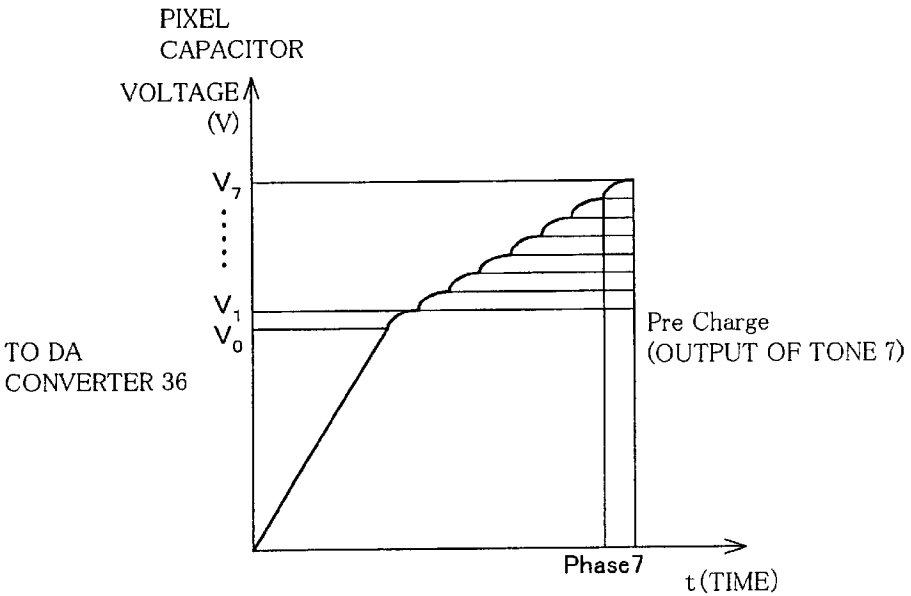

As a result, the pixel capacitors of the pixels (pixels with ON TFTs by the scanning signal) selecting the eighth tone display voltage $V_7$ are instantly charged from $V_6$ to $V_7$ (see FIG. 8(*b*)). Here, the pixels selecting the tone display voltages $V_0$ through $V_6$ have already become a steady state and do not require further charging. Therefore, the pixels are only required to maintain their voltage levels ($V_0$ through $V_6$), and the voltage levels can be made stable even in a high impedance state. Thus, the seven analog switch circuits 117 through 123 are switched ON so as to directly output the tone display voltages $V_0$ through $V_6$ which were drawn from the reference voltage generator 38.

The sequence goes to Phase 8 after the voltage level becomes a steady state at $V_7$ at the completion of the charging of the pixel capacitors (including wire capacitors of the source signal lines) of the pixels (pixels with ON TFTs by the scanning signal) of the liquid crystal panel selecting the eighth tone display voltage $V_7$.

Figure 9:
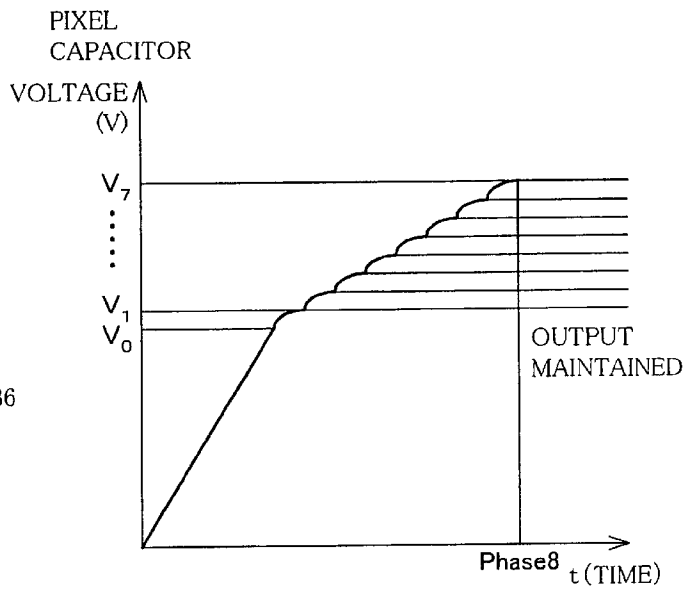
FIG. 9(*a*) is yet another exemplary drawing showing how tone display voltages are supplied in the circuit structure of FIG. 4.
Figure 9:
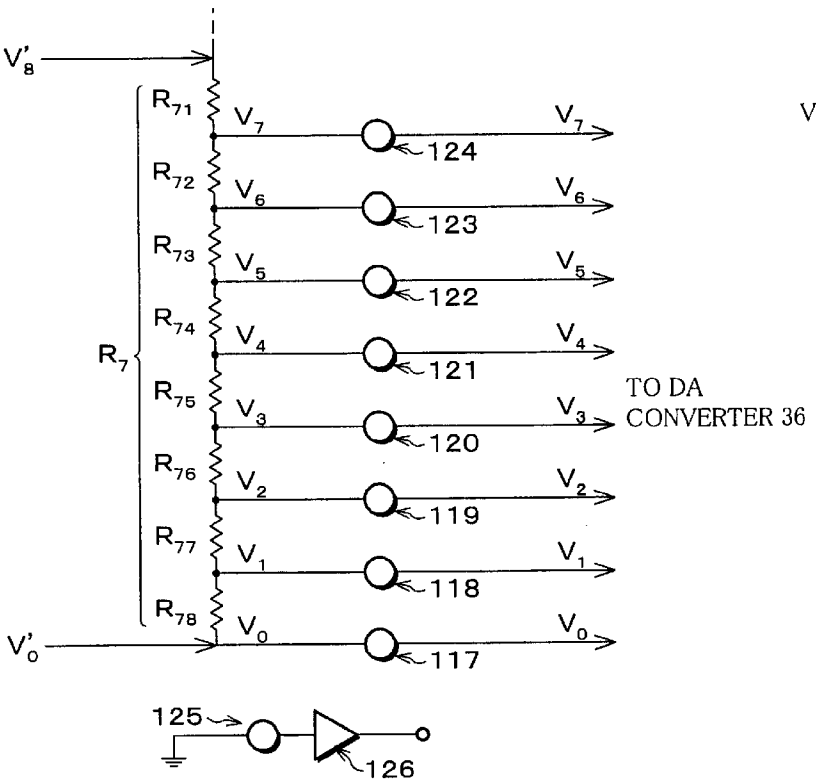

Phase 8 is the state in which all the pixel capacitors have been charged by the supply of the tone display voltages, and the voltage levels of the pixel capacitors have become a steady state at any of the tone display voltages $V_0$ through $V_7$ (see FIG. 9(*b*)). FIG. 9(*a*) shows a circuit structure in this state. In Phase 8, the analog switch circuits 117 through 125 are switched ON, while the other analog switch circuits are OFF.

This separates the input and output of the buffer 126 from the reference voltage generator 38 and the DA converter 36. As a result, the voltages (tone display voltages) $V_0$ through $V_7$ which were drawn from the reference voltage generator 38 are directly outputted to the DA converter 36 without utilizing the buffer 126.

The reason the analog switch circuit 125 is switched OFF to have the input terminal of the buffer 126 grounded is to reduce the power consumption of the buffer 126, for example, when the input stage of the buffer 126 is made up of an NMOS transistor, by switching OFF the transistor, and to prevent such adverse effects as oscillation. In other cases, the input terminal may be fixed at a potential, for example, a power voltage.

Figure 18:
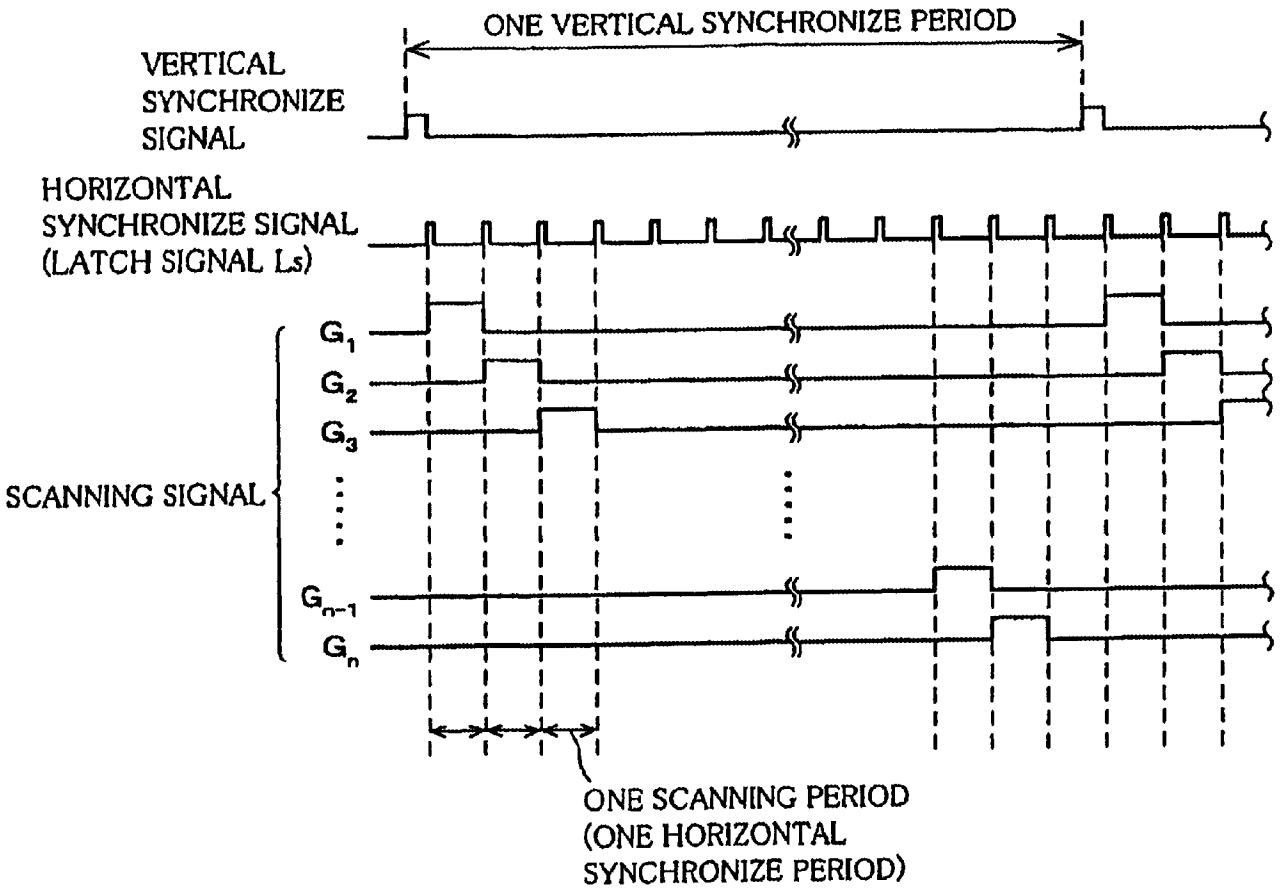
FIG. 18 CONVENTIONAL ART
FIG. 18 is an explanatory drawing showing a relationship of various signals supplied to the liquid crystal panel of the liquid crystal display device of FIG. 13.
Figure 19:
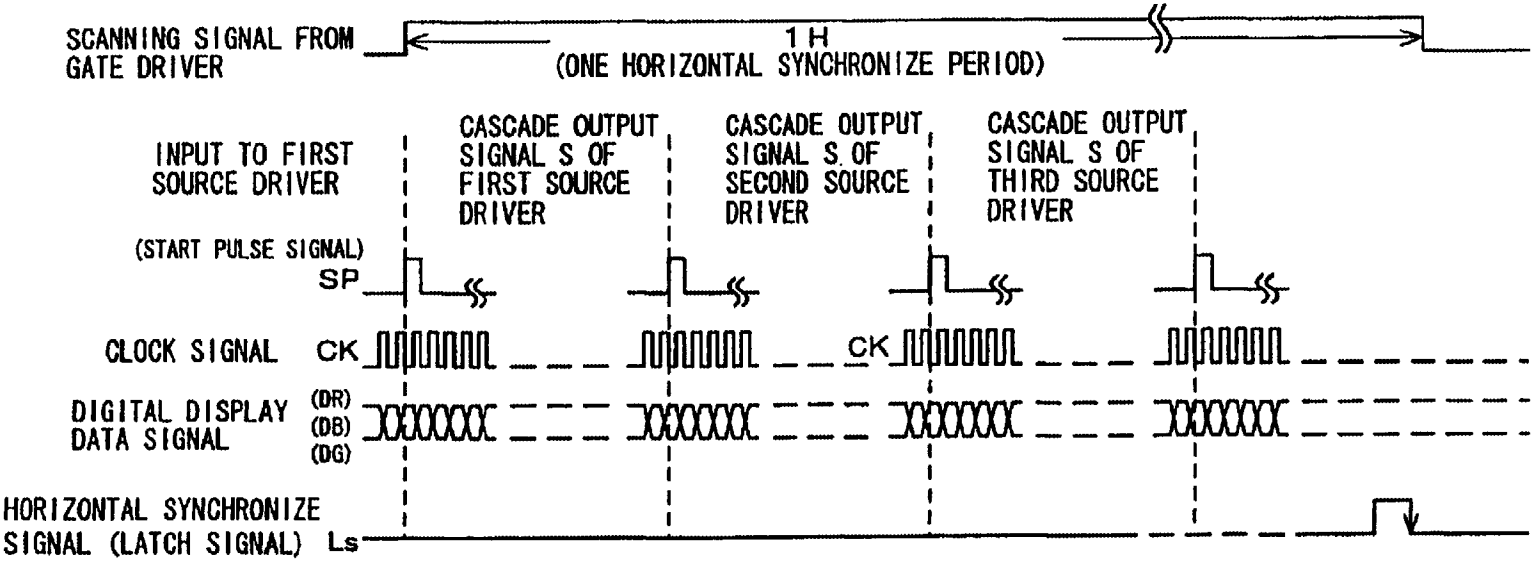
FIG.19 (a) CONVENTIONAL ART
FIG. 19(*a*) is an explanatory drawing showing a detailed relationship of various signals supplied to the liquid crystal panel of the liquid crystal display device of FIG. 13.
Figure 19:
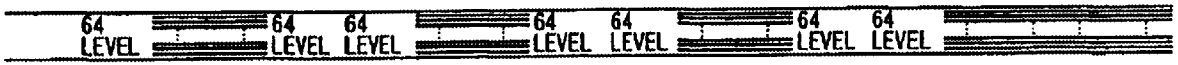
FIG.19 (b) CONVENTIONAL ART

Note that, a time period for all the eight tones (tones corresponding to the tone display voltages $V_0$ through $V_7$) of the circuit block of FIG. 4 to reach a steady state, i.e., time T from Phase 0 to Phase 8 may be of any length, provided that it is no longer than one scanning period (FIG. 18). For example, in the circuit block of FIG. 4, the output voltage level to the DA converter 36 is raised stepwise from $V_0$ to $V_7$ while a predetermined gate line $G_1$ is selected (while the input scanning signal to this signal line is at High level). The operation of bringing all the tone display voltages $V_0$ through $V_7$ corresponding to the eight tones to a steady state (operation corresponding to that of Phase 8) is carried out before the gate signal line $G_1$ becomes non-selected. As a result, the pixel capacitors with the TFTs receiving the scanning signal (High level) through the gates are charged to predetermined voltages which are required for the display of the respective tones. Subsequently, when the scanning signal becomes Low level, the TFTs become OFF, and the OFF voltage is maintained until the high-level scanning signal is inputted again to the gate signal line $G_1$ (see FIG. 18).

Thereafter, the scanning signal to the gate signal line $G_2$, adjacent to the gate signal line $G_1$, becomes High level so as to select new pixel capacitors to be charged, thus repeating the operation of raising the voltages in a stepwise manner by the circuit block of FIG. 4. The same operation is also repeated for the subsequent gate signal lines $G_3$ through $G_n$.

Note that, here, the explanation is limited to the output operations of the tone display voltages $V_0$ through $V_7$ corresponding to eight tones. However, as noted already, FIG. 4 only shows one of the circuit blocks (FIG. 3) for carrying out display of 64 tones. Further, as a modification example of the present embodiment, a circuit block of 64 tones corresponding to tone display voltages $V_1$ through $V_{63}$ may be regarded as a single circuit block, and a single buffer 126 may be provided therein. In this case, the 64 tone display voltages $V_0$ through $V_{63}$ are also outputted successively to the DA converter 36 via the buffer 126 in the described manner. That is, the number of circuit blocks, or the number of tones in each circuit block, is not particularly limited.

Further, the foregoing explanation of the present embodiment was based on the example in which the tone display voltages $V_0$ through $V_7$ assigned to one circuit block were outputted in a stepwise manner to the DA converter 36 in order from the lowest level to the highest level. However, the way the tone display voltages are outputted is not particularly limited to this example.

That is, the gist of the present invention lies in switching of output state; that is, the tone display voltages are outputted via the buffer with a low output impedance, only when a large charge or discharge current is required for the pixel capacitors of the liquid crystal panel or the wire capacitors of the source signal lines (also including associated capacitors such as wire capacitors of the TCP mounting the source driver ICs), so as to attain spontaneous rise and fall of the tone display voltages, whereas the tone display voltages drawn from the reference voltage generator are directly outputted without utilizing the buffer when in a steady state and no such large current is required, i.e., when a high output impedance state does not pose any problem.

Thus, the tone display voltage levels outputted to the DA converter 36 via the buffer may be set to fall in a stepwise manner. Further, the tone display voltages may be set to rise and fall alternately in a stepwise manner. Further, the stepwise change of the levels of the inputted tone display voltages to the buffer is not necessarily required. Despite all this, the described method of the present embodiment, in which the voltage levels are set to rise in a stepwise manner (i.e., stepwise increase of the voltage levels) is preferable, since it offers low power consumption by less charging time and less charging current, and simpler operation control.

Further, the timing chart of FIG. 5 described the case where the analog switch circuits 101 through 125 were switched continuously without interruption from Phase 0 to Phase 8. However, apparently, it is also possible to provide an OFF period for all the analog switch circuits 101 through 125 at switching of these analog switch circuits. The provision of such an OFF period prevents a current flow through the analog switch circuits, which is caused by inconsistency in ON/OFF switching timings of the analog switch circuits 101 through 125, thus further reducing power consumption.

Figure 10:
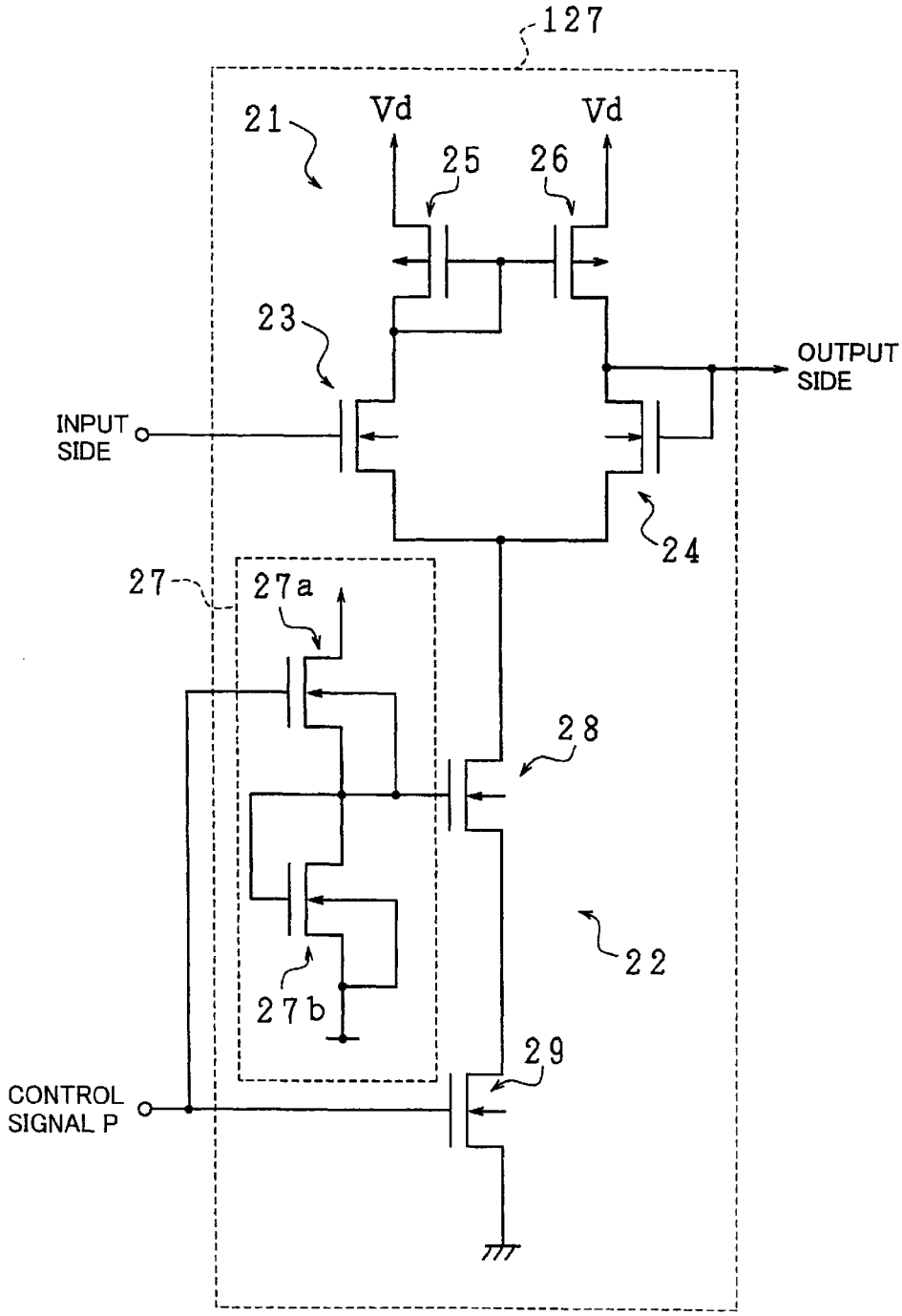
FIG. 10 is a circuit diagram showing a schematic structure of a buffer included in the source driver of FIG. 1.

Further, the buffer generally consumes large power. In view of this, a buffer (buffer means) 127 as shown in FIG. 10 may be used instead of the buffer 126 (FIG. 4) to reduce power consumption. As described below in detail, the buffer 127 is made up of a voltage follower circuit 21 and a control section 22, and has a function of inactivating itself and cutting consumed current when there is no need to operate.

The voltage follower circuit 21 includes N-channel MOS (simply "NMOS" hereinafter) transistors 23 and 24, and P-channel (simply "PMOS" hereinafter) transistors 25 and 26. The NMOS transistors 23 and 24 make up a differential pair. The PMOS transistors 25 and 26 make up a current mirror circuit (active load circuit).

The gate of the NMOS transistor 23 is connected to an input terminal, which is an in-phase input terminal. The sources of the NMOS transistors 23 and 24 are connected to each other, and to the drain of an NMOS transistor 28 (described later) of the control section 22. Further, the gate (reverse-phase input terminal) and drain of the NMOS transistor 24, which are connected to each other, are connected to an output terminal.

Further, the drain of the NMOS transistor 23 is connected to the drain of the PMOS transistor 25, and the source of the PMOS transistor 25 is connected to power supply Vd. On the other hand, the drain of the NMOS transistor 24 is connected to the drain of the PMOS transistor 26, and the source of the PMOS transistor 26 is connected to the power supply Vd.

The control section 22 is made up of a bias voltage setting section 27 which determines an operating point, an NMOS transistor 28 through which an operation current is flown, and an NMOS transistor 29 which is provided as a switching element for switching ON/OFF the operation current.

The bias voltage setting section 27 is made up of NMOS transistors 27*a* and 27*b*. Control signal P is inputted to the gate of the NMOS transistor 27*a*. The source of the NMOS transistor 27*a* is connected to the gate and drain of the NMOS transistor 27*b* and to the gate of the NMOS transistor 28. As a result, the gate of the NMOS transistor 28 is biased. Further, the drain of the NMOS transistor 27*a* is connected to a power supply (not shown). The source of the NMOS transistor 27*b* is either connected to a reference potential or grounded.

The source of the NMOS transistor 28 is connected to the drain of the NMOS transistor 29, and the source of the NMOS transistor 29 is grounded. The control signal P is also inputted to the gate of the NMOS transistor 29.

In the buffer 127 of the foregoing structure, the control signal P is set to High level (Vd level in FIG. 10) when operations of the circuit is called for. The control signal P is set to Low level (ground level in FIG. 10) when inactivating the circuit. The control signal P at Low level switches OFF the NMOS transistor 27*b*, which determines the operating point of the differential amplifier, and the NMOS transistor 29. This stops a current flow to the NMOS transistor 28 which withdraws a current from the voltage follower circuit 21. As a result, operations of the voltage follower circuit 21 are stopped, thereby completely cutting the consumed current in the voltage follower circuit 21.

As described, during an inactivated state, the buffer 127 comes to have a high output impedance according to the control signal P to cut the operation current in the voltage follower circuit 21 which is provided as the differential amplifier. This ensures that the power is not dissipated during an inactivated state of the circuit, thus significantly reducing power consumption of the circuit.

That is, the bias voltage setting section 27 serves as a constant current circuit, and decides an operating point of the differential amplifier (voltage follower circuit 21). When the control signal P inputted to the NMOS transistor 27*a* becomes Low level, a current flow to the bias voltage setting section 27 is stopped and the NMOS transistor 29 becomes OFF, thereby cutting all the current flow through the buffer 127.

The foregoing operations can be employed to set the control signal P at Low level to reduce unnecessary power consumption, for example, in a portable tone display device (e.g., liquid crystal display device or plasma display device), while the power is ON but display is not carried out, or when the circuits in the device, immediately after being activated, have not reached a steady state. Further, in the case of displaying transmitted TV images using the tone display device, power can be saved recurrently, for example, by the control of inactivating the operations of the buffer 127 at such timings which have no effect on displayed images, as in the blanking period of the vertical synchronize signal or horizontal synchronize signal.

Note that, the control signal P may be directly inputted to the control terminal of the buffer 127 via the input terminal of the source driver IC, or outputted via the analog switch control circuit section (see FIG. 1) 40. However, in the latter case, the input signals from the controller 94 to the switch control circuit section 40 need to include, in addition to the switch control signal SW, the control signal P. Further, in the case where there is a plurality of circuit blocks (equivalent of the buffer block 41' as shown in FIG. 4) including the buffer 127, the control signal P may be shared between all the buffers 127 of the respective circuit blocks. Alternatively, the control signal P may be different for each circuit block to independently control operations of the plurality of buffers 127.

With the structure including a plurality of circuit blocks having the buffers 127 in which different control signals P are used for the respective circuit blocks, the buffers 127 can be independently operated only at the timing when they are used. This makes it possible to save power recurrently. For example, in the case where the entire display image has the same background, or when an image is superimposed on the displayed background, only the buffer 127 of the circuit block associated with the display of this background may be activated, while the buffers 127 of the other circuit blocks remain OFF at the timing when this background is displayed, because the same tone display voltage is used for the display of this background.

Second Embodiment

The following will describe another embodiment of the present invention with reference to attached drawings. Note that, for convenience of explanation, those structural elements as already described in the First Embodiment are given the same reference numerals and explanations thereof are omitted here.

Figure 11:
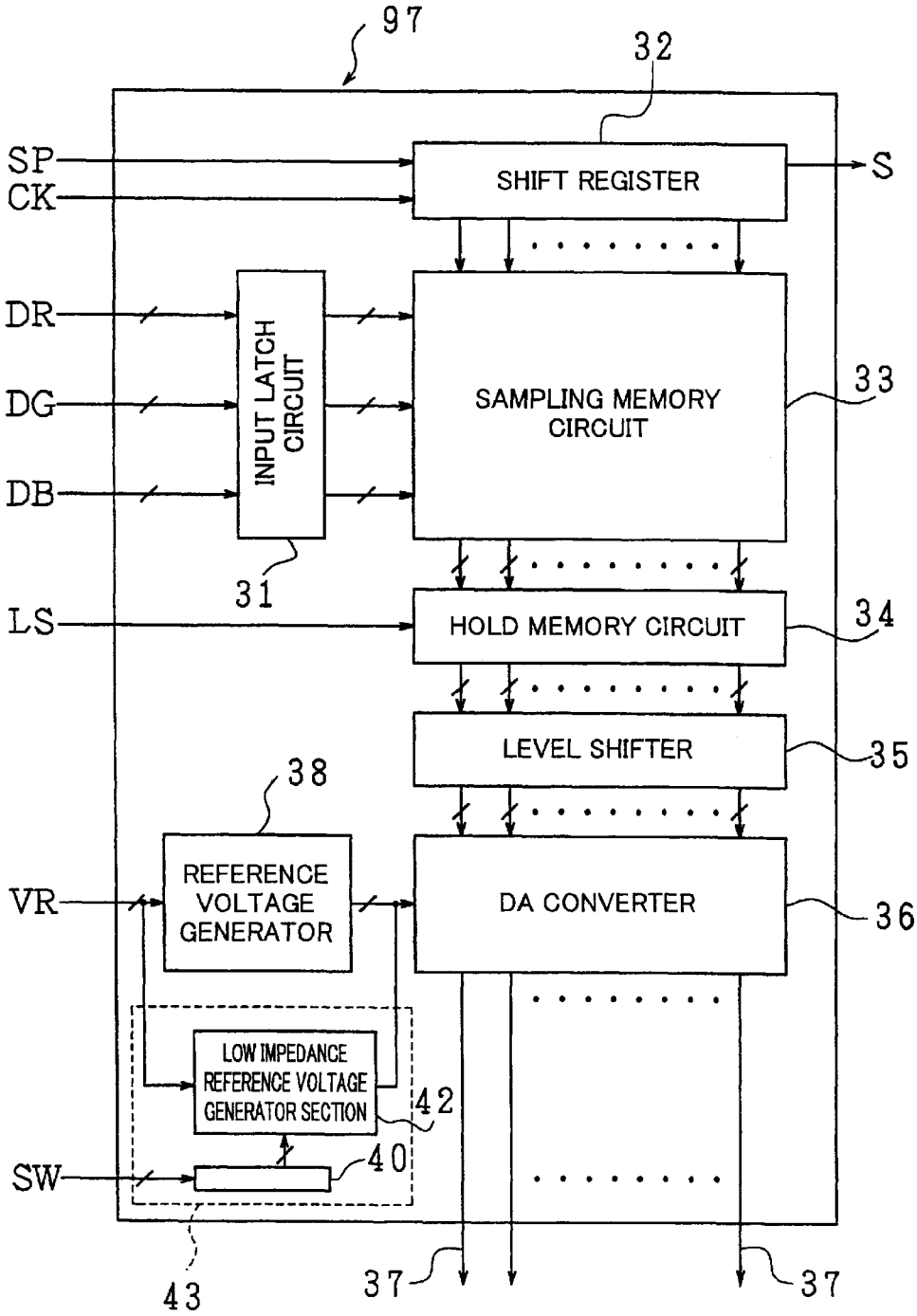
FIG. 11 is a block diagram schematically showing a structure of a source driver, which is a tone display voltage generating device according to another embodiment of the present invention.
Figure 12:
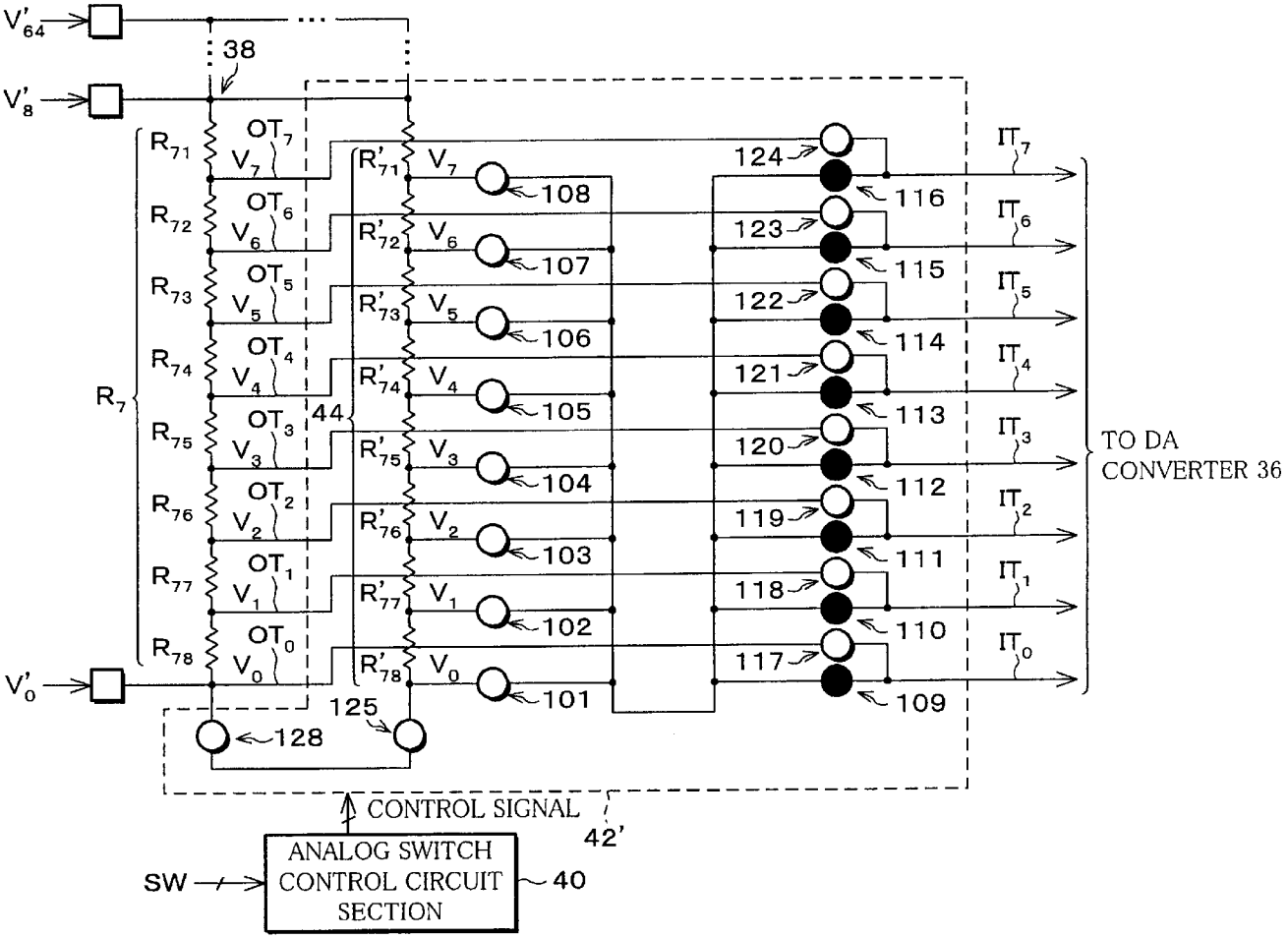
FIG. 12 is an explanatory drawing showing a main circuit structure of the source driver of FIG. 11.

As shown in FIG. 11 and FIG. 12, a source driver (tone display voltage generating device) 97 of the present embodiment is provided with a low impedance reference voltage generator block 42' including a resistance divider (voltage generating means) 44, instead of the buffer block 41' including the buffer 126 as shown in FIG. 4. The low impedance reference voltage generator block 42', as with the buffer block 41', is also provided, corresponding one to one, for each of the resistances $R_0$ through $R_7$ (see FIG. 3) making up a reference voltage generator 38. These eight low impedance reference voltage generator blocks 42' are provided to make up a low impedance reference voltage generator section 42. That is, the low impedance reference voltage generator section 42 includes a total of eight resistance dividers 44 (only one is shown) which are connected to one another in series, as in the reference voltage generator 38 of the First Embodiment. These resistance dividers 44 are used to generate 64 analog voltages (tone display voltages $V_0$ through $V_{63}$ (see FIG. 3)). The eight resistance dividers 44 and the reference voltage generator 38 will also be collectively referred to as a reference voltage generating unit.

As described below in detail, the reference voltage generator 38 and the low impedance reference voltage generator section 42 are both for generating plural tone display voltages from a plurality of reference voltages VR, and may be used in combination or individually based on a control signal which is generated by an analog switch control circuit section (serving as first control means) in response to the switch control signal SW. The following is a more detailed explanation of the resistance divider 44 which is provided for resistance $R_7$ of the resistance divider 38.

The resistance divider 44 is made up of a plurality of (eight) serially connected resistance elements $R'_{71}$ through $R'_{78}$, as with the reference voltage generator 38 of the First Embodiment which is made up of resistances $R_0$ through $R_7$ (see FIG. 3). Further, the resistance elements $R'_{71}$ through $R'_{78}$ have the same resistance ratio as that of eight resistance elements $R_{71}$ through $R_{78}$ which make up the corresponding circuit block (resistance $R_7$: reference voltage generating block) of the reference voltage generator 38. Also, the resistance elements $R'_{71}$ through $R'_{78}$ are set to have low resistance values.

That is, when resistance values of the eight resistance elements $R'_{71}$ through $R'_{78}$ making up the resistance divider 44 are R'71, R'72, . . . , R'78, respectively, and resistance values of the eight resistance elements $R_{71}$ through $R_{78}$ making up a block of the reference voltage generator 38 are R71, R72, R78, respectively, then the following relation R'71: R'72: . . . : R'78=R71: R72: . . . : R78 is established, wherein the sum of R'71 through R'78 is smaller than the sum of R71 through R78. This enables the resistance divider 44 to output voltages $V_0$ through $V_7$ of the same levels, but under low output impedance conditions, as those of the tone display voltages $V_0$ through $V_7$ which are drawn from resistance $R_7$ of the reference voltage generator 38, as shown in FIG. 12.

Note that, though not described in detail, for example, the resistances $R_0$ through $R_6$ making up the reference voltage generator 38 and their corresponding resistance dividers 44 (not shown) have the same relationship as that between resistance $R_7$ and the corresponding resistance divider 44. Thus, the remaining tone display voltages $V_{63}$ through $V_8$ can also be outputted under low output impedance conditions.

Further, similar to the First Embodiment, the low impedance reference voltage generator block 42' includes analog switch circuits 101 through 125 which make up switching means, and an analog switch circuit 128, wherein ON/OFF timings of these analog switch circuits are controlled by a control signal generated by an analog switch control circuit section 40. This enables switching of output of analog voltages (tone display voltages) $V_0$ through $V_7$ to the DA converter 36, as to whether they should be outputted from the reference voltage generator 38 or from the resistance divider 44. That is, the analog switch control circuit section 40 and the low impedance reference voltage generator section 42 make up a voltage supply switching control section 43.

Note that, the mode of connection of the 25 analog switch circuits 101 through 125 of the low impedance reference voltage generating block 42' is essentially the same as that described in the First Embodiment (FIG. 4) except for the following two respects. (1) The eight analog switch circuits 117, 118, . . . , 124 on one end are connected only to their respective output terminals $OT_0$, $OT_1$, . . . , $OT_7$ of the reference voltage generator 38. (2) The analog switch circuit 101 on one end is connected to one end of resistance element $R'_{78}$, and the analog switch circuits 102 through 108 on one end are connected between resistance elements $R'_{78}$ and $R'_{77}$, resistance elements $R'_{77}$ and $R'_{76}$, resistance elements $R'_{76}$ and $R'_{75}$, resistance elements $R'_{75}$ and $R'_{74}$ resistance elements $R'_{74}$ and $R'_{73}$, resistance elements $R'_{73}$ and $R'_{72}$, and resistance elements $R'_{72}$ and $R'_{71}$, respectively, while the other ends of these analog switch circuits are connected to a common line to which one end of the analog switch circuits 109 through 116 is connected.

Operations of the analog switch circuits 101 through 124 can also be explained by the timing chart of FIG. 5, and the output operation of tone display voltages, essentially the same as that described with reference to FIG. 6 through FIG. 9, can be realized by this switching operation. The voltage output operation of the First Embodiment is analogous to that of the present embodiment in that the former utilizes the buffer 126 whereas the latter utilizes the resistance divider 44. That is, these two output operations are common in that they both have a low output impedance with respect to the output of the reference voltage generator 38.

Further, with regard to the timing of the analog switch circuit 125 shown in FIG. 5, a detailed explanation thereof is omitted here because the only difference from the First Embodiment is that Low level and High level are reversed, and its operation and effect remain the same.

In the case where the tone display voltage is not required, an analog switch circuit 128 may be provided between resistance $R_7$ of the reference voltage generator 38 and the resistance divider 44 which are connected to each other in parallel. In this way, power consumption can be further reduced by switching OFF the analog switch circuit 128. This is also applicable to the First Embodiment.

Portable liquid crystal display devices generally incorporate small screens, and accordingly the wire capacitors of the source signal lines or pixel capacitors are relatively small. This is where the present embodiment is particularly effective because a low output impedance as low as that attained by the buffer of the First Embodiment is not required in this case. The foregoing arrangement of the present embodiment can be realized only with resistances, which is advantageous in terms of layout area, and it can possibly reduce reactive current compared with the buffer, though it depends on the screen size. Further, since the fabrication of this arrangement employs a single process, less variance is caused in the resistance ratio of the resistance which makes up the reference voltage generator 38 to the resistance divider 44. Thus, the output voltage deviates less often when these resistances are switched, and a superior image quality is obtained.

Third Embodiment

The following will describe yet another embodiment of the present invention with reference to attached drawings. Note that, for convenience of explanation, those structural elements as already described in the First Embodiment are given the same reference numerals and explanations thereof are omitted here.

One of the features of a source driver (tone display voltage generating device) according to the present embodiment is that it includes, in the source driver 92 (see FIG. 1) of the First Embodiment, another type of reference voltage generator which is capable of generating a reference voltage of a voltage level different from that generated by the reference voltage generator 38.

In order to prevent such adverse effects as flicker, liquid crystal display devices (tone display device) generally employ AC driving for periodically changing a liquid crystal driving voltage between positive polarity (positive polarity driving) and negative polarity (negative polarity driving). The source driver of the present embodiment is provided with a plurality of reference voltage generators (negative polarity driving generator and positive polarity driving generator) so as to adapt to such a liquid crystal display element (liquid crystal panel) which comes to have different γ correction characteristics when the liquid crystal driving voltage is switched between positive polarity and negative polarity. The following describes, with reference to attached drawings, only a structure around the reference voltage generators where the difference from the structure of the source driver 92 of the First Embodiment is present.

Figure 27:
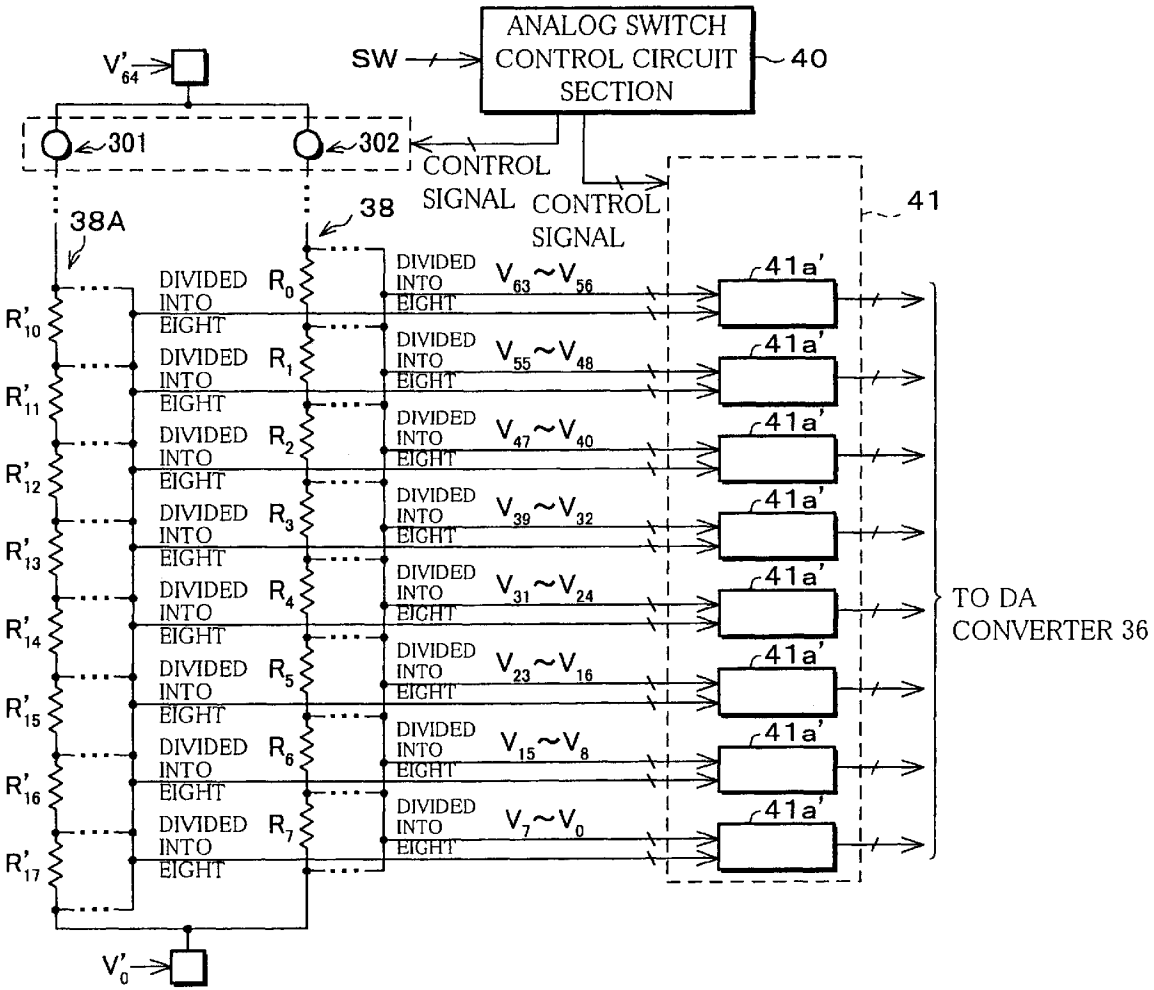
FIG. 27 is an explanatory drawing showing a main circuit structure of a source driver (tone display voltage generating device) according to still another embodiment of the present invention.

As shown in FIG. 27, as in the First Embodiment, the source driver according to the present embodiment also includes a reference voltage generator 38 which is made up of eight blocks (reference voltage generating blocks) of resistances $R_0$, $R_1$, . . . , $R_6$, $R_7$, and eight analog voltages generated by each block are inputted to the corresponding buffer block 41*a*' (structure of which will be described later in detail). That is, there are provided eight buffer blocks 41*a*', corresponding to the number of blocks of the reference voltage generator 38, to make up a buffer section 41. Note that, details of the reference voltage generator 38 are as already described in the First Embodiment.

A reference voltage generator (reference voltage generating means) 38A, which is newly provided in the present embodiment, is made up of serially connected eight resistances $R'_{10}$, $R'_{11}$, . . . , $R'_{16}$, $R'_{17}$ (reference voltage generating blocks), wherein each of the resistances $R'_{10}$, $R'_{11}$, . . . , $R'_{16}$, $R'_{17}$ is further made up of serially connected eight resistance elements. For example, resistance $R'_{17}$ is made up of eight resistances $R'_{171}$ through $R'_{178}$ (see FIG. 28).

The reference voltage generator 38A is also adapted to output eight analog voltages, which are generated by each of the resistances $R'_{10}$, $R'_{11}$, . . . , $R'_{16}$, $R'_{17}$, to the corresponding buffer blocks 41*a*'. Further, the resistances $R_0$, $R_1$, . . . , $R_6$, $R_7$ making up the reference voltage generator 38 correspond to the resistances $R'_{10}$, $R'_{11}$, . . . , $R'_{16}$, $R'_{17}$ of the reference voltage generator 38A, respectively, and an analog voltage generated by a pair of corresponding resistances is inputted to the corresponding buffer block 41*a*'.

Figure 28:
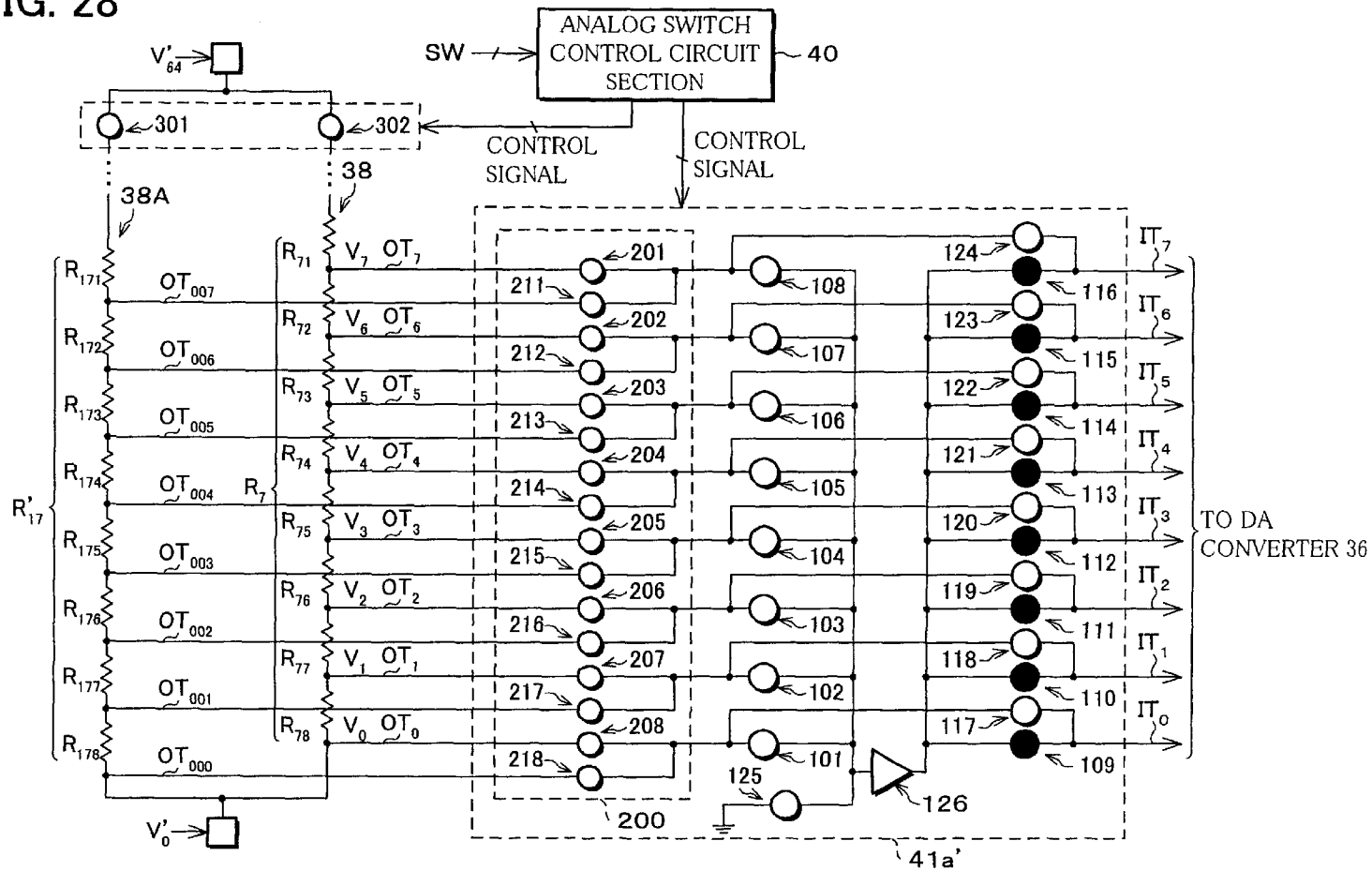
FIG. 28 is an explanatory drawing showing a detailed portion of the circuit structure of FIG. 27.

The following describes a structure of the buffer blocks 41*a*' according to the present embodiment, with reference to FIG. 28 and other drawings. Note that, the buffer blocks 41*a*' as shown in FIG. 27 basically have the same structure, and thus the following only describes the buffer block 41*a*' with the pair of resistances $R_7$ and $R'_{17}$.

In the source driver IC according to the present embodiment, the buffer block 41*a*' is realized by providing the buffer block 41' (FIG. 4) with selecting means (switching means) 200 for selecting the reference voltage generator 38A or reference voltage generator 38A.

The selecting means 200 includes a set of analog switch circuits 201, 202, . . . , 208, and a set of analog switch circuits 211, 212, . . . , 218. Output terminals $OT_0$, $OT_1$, . . . , $OT_7$ of the reference voltage generator 38 are connected via their respective analog switch circuits 208, 207, . . . , 201 to one end (input terminal) of analog switch circuits 101, 102, . . . , 108, respectively (as already explained in the First Embodiment). On the other hand, output terminals $OT_{000}$, $OT_{001}$, . . . , $OT_{007}$ of the reference voltage generator 38A are connected via their respective analog switch circuits 218, 217, . . . , 211 to the respective outputs of the analog switch circuits 208, 207, . . . , 201 and to one end (input terminal) of the analog switch circuits 101, 102, . . . , 108, respectively.

Further, there are provided analog switch circuits 302 and 301 for cutting a current flow through the reference voltage generators 38 and 38A when no current supply is required. Note that, the analog switch circuits 302 and 301 are provided for the set of the reference voltage generators 38 and 38A, in the vicinity of an input terminal of reference voltage $V'_{64}$ or $V'_0$.

The present embodiment generates a tone display analog voltage using only some of the plurality of reference voltages (reference voltage $V'_{64}$ of the highest voltage level and reference voltage $V'_0$ of the lowest voltage level) inputted to the reference voltage generators 38 and 38A. For example, the source driver of the present embodiment can be suitably used as a liquid crystal panel source driver (tone display element for the liquid crystal display element) without using a reference voltage (intermediate voltage) which is used for fine adjustment of γ correction in AC driving.

In the following detailed explanation it is assumed that the reference voltage generator 38 is used for the γ correction of positive polarity driving and the reference voltage generator 38A is used for the γ correction of negative polarity driving.

As described earlier, in the reference voltage generator 38, the resistances $R_0$, $R_1$, . . . , $R_6$, $R_7$ have the same resistance value, and the input voltage across terminals of each resistance $R_0$, $R_1$, . . . , $R_6$, $R_7$ is divided into eight voltages before outputted. On the other hand, in the reference voltage generator 38A, the resistance ratio of resistances $R'_{10}$ , $R'_{11}$, . . , $R'_{16}$, $R'_{17}$ is set to be different from the resistance ratio of resistances $R_0$, $R_1$, . . . $R_6$, $R_7$.

That is, in the reference voltage generator 38A, the input reference voltages $V'_{64}$ and $V'_0$ are divided unequally between at least some of the resistances $R'_{10}R'_{11}$, . . . , $R'_{16}$, $R'_{17}$. Thus, while the number of analog voltages (tones display voltages) generated by the reference voltage generator 38 and those by the reference voltage generator 38A will be the same (64 analog voltages corresponding to 64 tones), the voltage levels of at least some of the analog voltages will be different.

The analog switch circuits 302, 201 through 208 are closed or opened (ON/OFF) in a linking action. Also, the analog switch circuits 301, 211 through 218 are closed or opened in a linking action. Here, the analog switch circuits 302, 201 through 208 are controlled to switch ON in positive polarity driving and to switch OFF in negative polarity driving and when not employed. On the other hand, the analog switch circuits 301, 211 through 218 are controlled to switch ON in negative polarity driving and to switch OFF in positive polarity driving and when not employed.

Further, the analog switch circuits provided in the selecting means, and the analog switch circuits 301 and 302 are controlled to switch ON or OFF according to a control signal from the analog switch control circuit section 40 (serving as first and second control means). Note that, the method of inputting the tone display voltage from the reference voltage generator 38A to the DA converter 36 either directly or via the buffer 126 according to the ON/OFF control of the analog switch circuits 101 through 124 is basically the same as that in the reference voltage generator 38, and an explanation thereof is omitted here (refer to the First Embodiment).

For example, in order to realize both the γ correction characteristics in positive polarity driving as shown in FIG. 26(*a*) and the γ correction characteristics in negative polarity driving as shown in FIG. 26(*c*), the digital display data is reversed and the output voltage (tone display voltage) to the liquid crystal panel (not shown) is varied according to the respective γ correction characteristics at the time of polarity reversion as conventionally done. In the present embodiment, the output voltage to the liquid crystal panel is varied between negative polarity driving and positive polarity driving by switching between the reference voltage generator 38 and the reference voltage generator 38A.

For example, given the γ correction characteristics as shown in FIG. 26(*a*) by the reference voltage generator 38, in order to realize the γ correction as shown in FIG. 26(*c*), it is required to lower the potential of the tone display voltage $V_8$ and increase the potential of the tone display voltage $V_{56}$. To this end, the resistance value of resistance $R'_{16}$ (made up of eight equivalent resistance elements) in the reference voltage generator 38A, corresponding to resistance $R_6$ for outputting tone display voltage $V_8$, is increased with respect to a reference resistance value of this resistance $R_6$. Further, the resistance value of resistance $R'_{10}$ (made up of eight equivalent resistance elements) in the reference voltage generator 38A, corresponding to resistance $R_0$ (made up of eight equivalent resistance elements) for outputting tone display voltage $V_{56}$, is set to decrease with respect to a reference resistance value of this resistance $R_0$. In other words, using the resistance value of resistance $R_1$ (made up of eight equivalent resistance elements) as a reference, the resistance value of the corresponding resistance $R'_{11}$ in the reference voltage generator 38A is increased. Also, using the resistance value of resistance $R_7$ (made up of eight equivalent resistance elements) as a reference, the resistance value of the corresponding resistance $R'_{17}$ (made up of eight equivalent resistance elements) in the reference voltage generator 38A is set to decrease.

Switching between positive polarity driving and negative polarity driving, i.e., the polarity reversion of liquid crystal driving at certain time intervals is performed in the same manner as driving of a conventional liquid crystal display element and will not be explained in detail. For example, the polarity reversion is performed by the unit period of a vertical synchronize period, e.g., at the intervals of several vertical synchronize periods (including one vertical synchronize period). Further, depending on driving modes, the polarity reversion may be performed by the unit period of a horizontal synchronize period, e.g., at the intervals of several horizontal synchronize periods (including one horizontal synchronize period).

Further, as to switching of an applied voltage to the counter electrode of the liquid crystal display element in the polarity reversion of liquid crystal driving, and the way the digital display data is reversed, conventional methods are applicable and no detailed explanation will be given.

As described, in the structure including the plurality of reference voltage generators as in the source driver IC (tone display voltage generating device) of the present embodiment, tone display voltages of different levels can be outputted using the common reference voltages $V'_{64}$ and $V'_0$. That is, the reference voltages of intermediate levels (those corresponding to $V'_8, V'_{16}, \ldots, V'_{56}$ (intermediate voltages)) will not be required at all even when adapting to such a liquid crystal display element having different γ correction characteristics between positive polarity driving and negative polarity driving. Further, even in case of using these intermediate voltages, only some of these voltages need to be inputted. This allows the number of pads on the source driver IC to be reduced, thus preventing increase in chip area of the device. Further, the adverse effect of external noise in the reference voltages of intermediate levels can be prevented, so as to maintain desirable display quality of the liquid crystal display element. Further, less wires are required between the liquid crystal driving power supply (see FIG. 2) and the respective source driver ICs, thus further reducing size of the liquid crystal display device and offering easier system design for the liquid crystal display device.

Further, the buffers, which are provided as analog circuits including a differential amplifier, etc., have offset variance in their input stages due to variance in manufacturing conditions. However, as in the First Embodiment, the liquid crystal display element, after being charged through the buffer, directly receives a predetermined voltage, even though it is high impedance output, from the reference voltage generators 38 and 38A without utilizing the buffer. This solves the output deviation of buffers, thus realizing uniform display. Further, since the problem of offset variance of input stages becomes less prominent, it becomes easier to design the buffer.

Fourth Embodiment

The following will describe still another embodiment of the present invention with reference to attached drawings. Note that, for convenience of explanation, those structural elements as already described in the First through Third Embodiments are given the same reference numerals and explanations thereof are omitted here.

A source driver IC (tone display voltage generating device) according to the present embodiment includes two or more of the reference voltage generating unit explained in the Second Embodiment, wherein the plurality of tone display voltages generated by the plurality of reference voltage generating units are different for each reference voltage generating unit.

Figure 29:
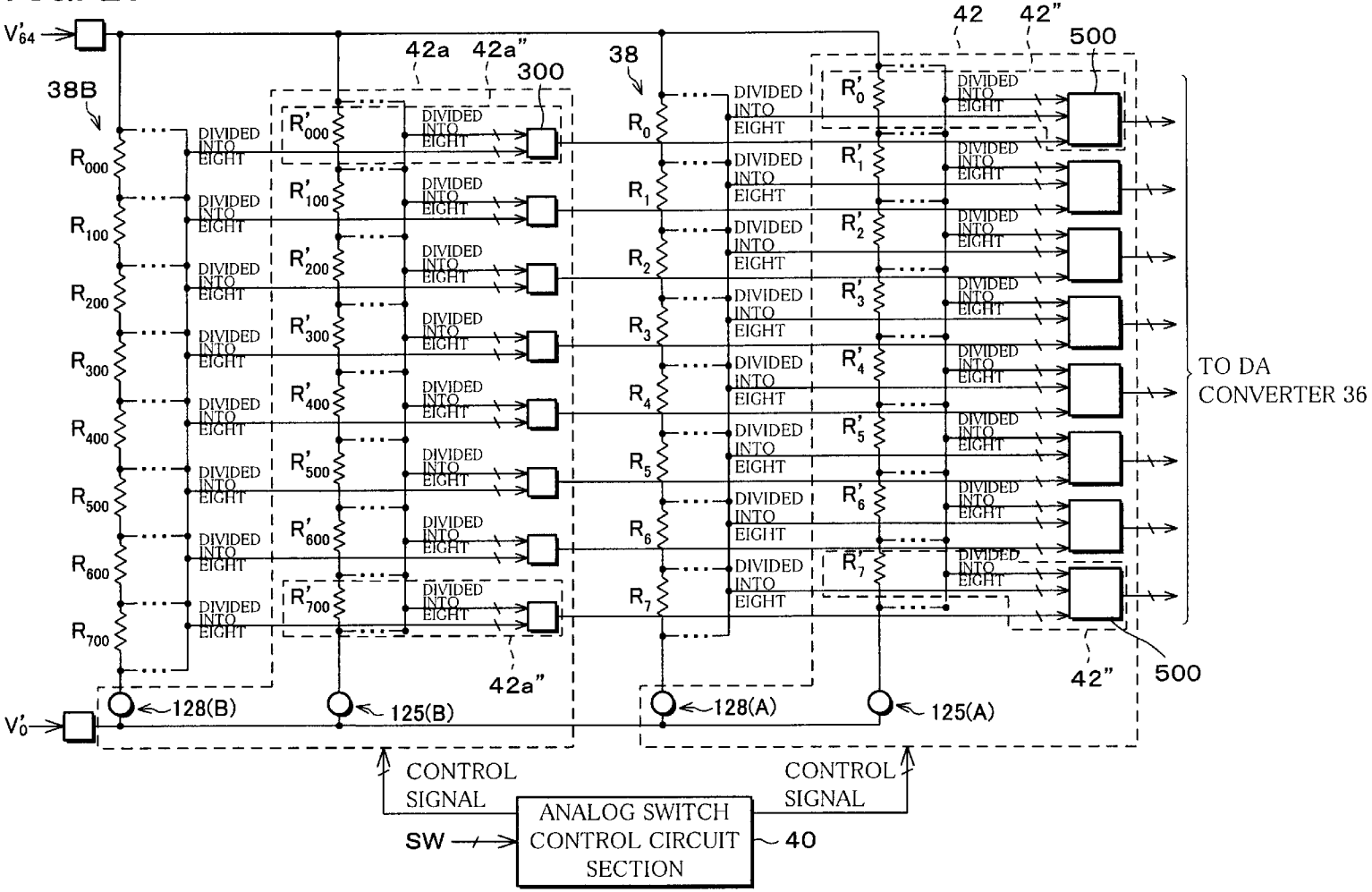
FIG. 29 is an explanatory drawing showing a main circuit structure of a source driver (tone display voltage generating device) according to yet another embodiment of the present invention.

More specifically, the source driver IC according to the present embodiment includes two reference voltage generating units as shown in FIG. 29. One of the reference voltage generating units is a collection of a reference voltage generator 38 and eight resistance dividers (voltage generating means) $R'_0$ through $R'_7$, while the other reference voltage generating unit is a collection of a reference voltage generator 38B and eight resistance dividers (voltage generating means) $R'_{000}$ through $R'_{700}$. As with the foregoing reference voltage generator 38, the reference voltage generator 38B comprises resistance dividing means which is made up of eight serially connected resistances $R_{000}$ through $R_{700}$ (each made up of eight equivalent resistance elements).

Each of these two reference voltage generating units is divided into eight blocks for respectively outputting voltages of eight tones. That is, one of the reference voltage generating units has eight unit blocks, each including a low impedance reference voltage generating block 42" with any one of the eight resistance dividers $R'_0$ through $R'_7$ (each made up of eight equivalent resistance elements), and any one of the eight resistances $R_0$ through $R_7$ (each made up of eight equivalent resistance elements) making up the reference voltage generator 38. The other reference voltage generating unit has eight unit blocks, each including a low impedance reference voltage generating block 42*a*" with any one of the eight resistance dividers $R'_{000}$ through $R'_{700}$ (each made up of eight equivalent resistance elements), and any one of the eight resistances $R_{000}$ through $R_{700}$ (each made up of eight equivalent resistance elements) making up the reference voltage generator 38B.

As described in the Second Embodiment, the resistance divider $R'_7$ and the resistance $R_7$ of one of the blocks of one reference voltage generating unit can independently generate eight tone display voltages $V_0$ through $V_7$. Likewise, the resistance divider $R'_6$ and the resistance $R_6$, the resistance divider $R'_5$ and the resistance $R_5$, the resistance divider $R'_4$ and the resistance $R_4$, the resistance divider $R'_3$ and the resistance $R_3$, the resistance divider $R'_2$ and the resistance $R_2$, the resistance divider $R'_1$ and the resistance $R_1$, and the resistance divider $R'_0$, and the resistance $R_0$ can independently generate eight tone display voltages $V_8$ through $V_{15}$, $V_{16}$ through $V_{23}$, $V_{24}$ through $V_{31}$, $V_{32}$ through $V_{39}$, $V_{40}$ through $V_{47}$, $V_{48}$ through $V_{55}$, and $V_{56}$ through $V_{63}$, respectively. Further, whether resistance divider $R'_{300}$ and the resistance $R_{300}$, the resistance divider $R'_{200}$ and the resistance $R_{200}$, the resistance divider $R'_{100}$ and the resistance $R_{100}$, and the resistance divider $R'_{000}$ and the resistance $R_{000}$ can independently generate eight tone display voltages, respectively. Thus, combined with the other reference voltage generating unit, a total of 64 voltages can be generated. However, as will be explained with reference to FIG. 30, at least some of the 64 voltages generated by the two reference voltage generating units have different levels.

In one reference voltage generating unit, the output impedances of the eight resistance dividers $R'_{700}$, $R'_{600}$, $R'_{500}$, $R'_{400}$, $R'_{300}$, $R'_{200}$, $R'_{100}$, $R'_{000}$ are smaller with respect to their respective resistances $R_{700}$, $R_{600}$, $R_{500}$, $R_{400}$, $R_{300}$, $R_{200}$, $R_{100}$, $R_{000}$. Further, whether to use the voltage output of the reference voltage generator 38B or the resistance dividers $R'_{000}$ through $R'_{700}$ is selected by selecting means 300, which is provided for each block, according to the control signal from the analog switch control circuit section 40. Further, whether to output the voltage selected by the selecting means 300 to the DA converter 36 is decided by the selecting means 500.

Note that, in one of the reference voltage to use the voltage output of the reference voltage generator 38 or the resistance dividers $R'_0$ through $R'_7$, and whether to use the voltage output of which of the two reference voltage generating units are selected by selecting means (switching means) 500, which is provided for each block, according to a control signal from an analog switch control circuit section 40.

Note that, as will be described later with reference to a detailed structure shown in FIG. 30, the resistance divider $R'_7$ is the same as the resistance divider 44 (FIG. 12) of the Second Embodiment, and the output impedance when outputting the tone display voltages $V_0$ through $V_7$ is smaller with respect to resistance $R_7$. Likewise, the output impedances of the other seven resistance dividers $R'_6$, $R'_5$, $R'_4$, $R'_3$, $R'_2$, $R'_1$, $R'_0$ are smaller with respect to their respective resistances $R_6$, $R_5$, $R_4$, $R_3$, $R_2$, $R_1$, $R_0$.

The resistance divider $R'_{700}$ and the resistance $R_{700}$ of one of the blocks of one reference voltage generating unit are related in the same manner as the resistance divider $R'_7$ and the resistance $R_7$, so as to independently generate eight voltages. Likewise, the resistance divider $R'_{600}$ and the resistance $R_{600}$, the resistance divider $R'_{500}$ and the resistance $R_{500}$, the resistance divider $R'_{400}$ and the resistance $R_{400}$, the generating units, the structure made up of the eight low impedance reference voltage generating blocks 42" and analog switch circuits 125(A) and 128(A) is equivalent to the structure of the low impedance reference voltage generator section 42 (see FIG. 11). Also, the structure made up of the eight low impedance reference voltage generating blocks 42*a*" and analog switch circuits 125(B) and 128(B) in the other reference voltage generating unit is equivalent to the structure of the low impedance reference voltage generator section 42*a*.

In the following explanation of the detailed structure with reference FIG. 30 in particular, the basic structures of the eight blocks making up each reference voltage generating unit are essentially the same, and thus only one block is shown for the purpose of explanation. Note that, the selecting means 300 as shown in FIG. 29 is made up of analog switch circuits 130, 101(B) through 108(B) as shown in FIG. 30, whereas the selecting means 500 as shown in FIG. 29 is made up of analog switch circuits 140, 141 through 124 as shown in FIG. 30. Further, the resistance dividers $R'_7$ and $R'_{700}$ shown in FIG. 29 are the same as resistance dividers 44 and 44B as shown in FIG. 30.

The relation between resistance $R_{700}$ making up one of the blocks of the reference voltage generator 38B, and the resistance divider 44B is basically the same as that between resistance $R_7$ and the resistance divider 44. That is, when resistance values of eight resistance elements $R'_{710}$ through $R'_{780}$ making up the resistance divider 44B are R'710, R'720, . . . , R'780, and when resistance values of eight resistance elements $R_{710}$ through $R_{780}$ making up one of the blocks of the reference voltage generator 38B are R710, R720, . . . , R780, respectively, the following relation

R'710: R'720: . . . : R'780=R710: R720: . . . : R780 is established, wherein the sum of R'710 through R'780 is smaller than the sum of R710 through R780. Thus, as shown in FIG. 30, the resistance divider 44B can output voltages $V_{000}$ through $V_{007}$ of the same levels as the tone display voltages $V_{000}$ through $V_{007}$ which are drawn from the resistance $R_{700}$ of the reference voltage generator 38B but under lower output impedance conditions.

Further, in the present embodiment, some of the tone display voltages generated by the two reference voltage generating units are different between the reference voltage generating units. Specifically, for example, the tone display voltage $V_{000}$ which is outputted to the DA converter 36 via the common input terminal $IT_0$ is different from the tone display voltage $V_0$. Note that, the voltage levels of the tone display voltages generated by the reference voltage generating units are decided as described in the Third Embodiment, according to desired γ correction characteristics of positive polarity driving or negative polarity driving of the liquid crystal display panel. More specifically, the resistance values of the reference voltage generator 38 or 38B and the resistance values of the resistance dividers 44 and 44B are set according to desired γ correction characteristics.

The following explains switching operations of the analog switches, for example, when the reference voltage generating unit made up of the reference voltage generator 38 and the eight resistance dividers 44 (i.e., resistance dividers $R'_0$ through $R'_7$ as shown in FIG. 29) is a positive polarity driving unit, and when the other reference voltage generating unit is a negative polarity driving unit.

In negative polarity driving, voltages are applied only to the reference voltage generating unit for negative polarity driving, so that analog switch circuits 125(B) and 128(B) are switched ON, and analog switch circuits 125(A) and 128(A) are switched OFF. In addition, the analog switch circuits 140 and 141 are both switched OFF. Also, the analog switch circuits 101(B) through 108(B) and the analog switch circuit 130 in the low impedance reference voltage generating block 42*a*", which are switched ON/OFF according to the ON/OFF operation of the analog switch circuits 101 through 124, are activated (ON).

Note that, the ON/OFF operation of the analog switch circuits 101 through 124 in negative polarity driving are as already described in the Second Embodiment, and a further explanation thereof is omitted here. Further, the analog switch circuits 101(B) through 108(B) are controlled to switch ON only when the corresponding analog switch circuits 101 through 108 (electrically connected thereto) are ON, and the analog switch circuit 130 is controlled to switch ON only when the corresponding analog switch circuits 117 through 124 are ON, so as to output voltages from either one of the resistance $R_{700}$ and the resistance divider 44B.

On the other hand, in positive polarity driving, voltages are applied only to the reference voltage generating unit for positive polarity driving, so that the analog switch circuits 125(B) and 128(B) are switched OFF, and the analog switch circuits 125(A) and 128(A) are switched ON. In addition, the analog switch circuits 101(B) through 108(B) and the analog switch circuit 130 are all switched OFF. Also, the analog switch circuits 140 and 141 in the low impedance reference voltage generating block 42*a*", which are switched ON/OFF according to the ON/OFF operation of the analog switch circuits 101 through 124, are activated (ON).

Note that, the ON/OFF operation of the analog switch circuits 101 through 124 in positive polarity driving are as already described in the Second Embodiment, and a further explanation thereof is omitted here. Further, the analog switch circuit 140 is controlled to switch ON only when the corresponding analog switch circuits 117 through 124 (electrically connected thereto) are ON, and the analog switch circuit 141 is controlled to switch ON only when the corresponding analog switch circuits 101 through 108 are ON, so as to output voltages from either one of the resistance $R_7$ and the resistance divider 44. Note that, the operation control of the analog switch circuits in positive polarity driving and negative polarity driving is carried out according to the control signal from the analog switch control circuit section 40 (serving as first and second control means).

Figure 30:
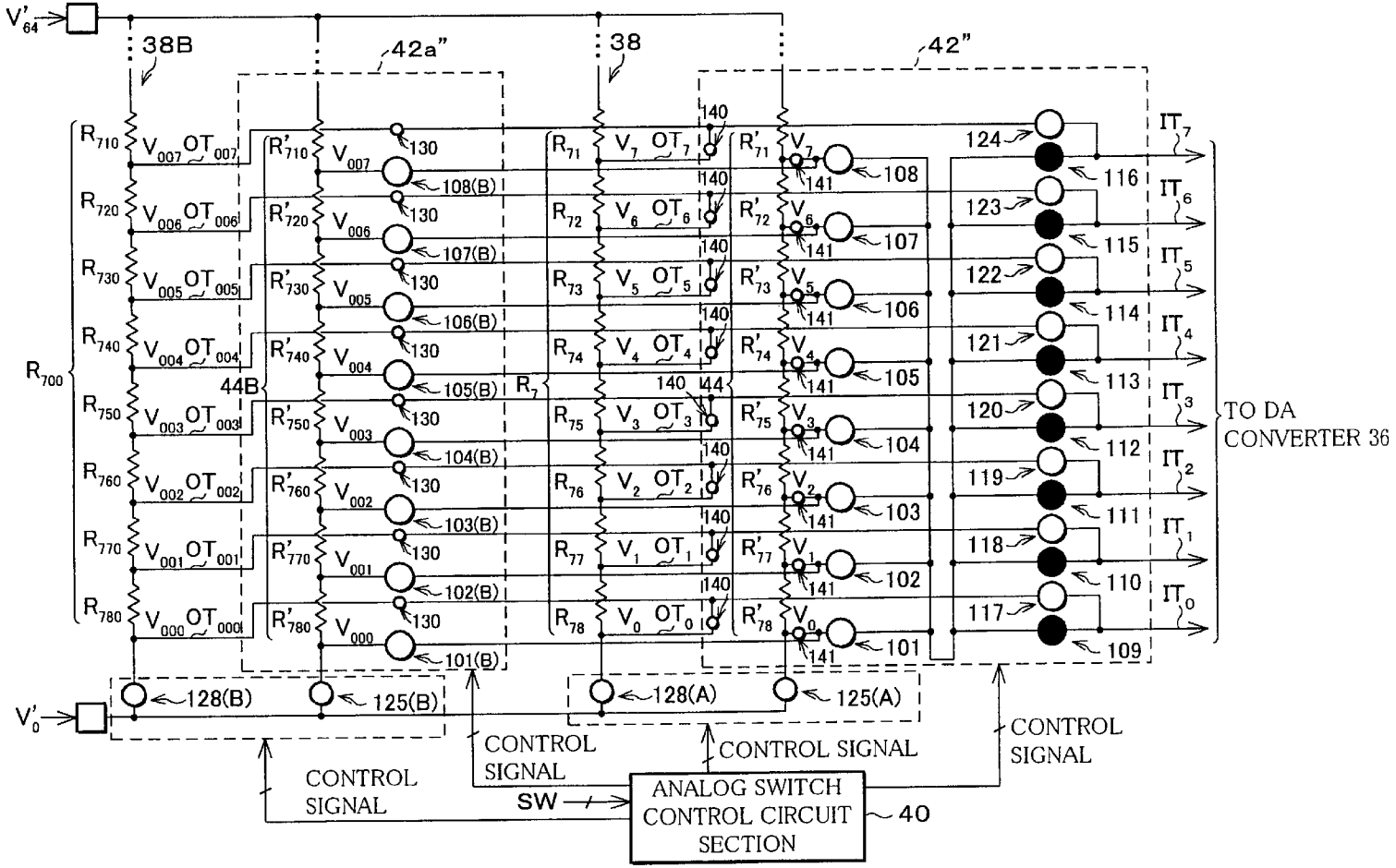
FIG. 30 is an explanatory drawing showing a detailed portion of the circuit structure of FIG. 29.
Figure 13:
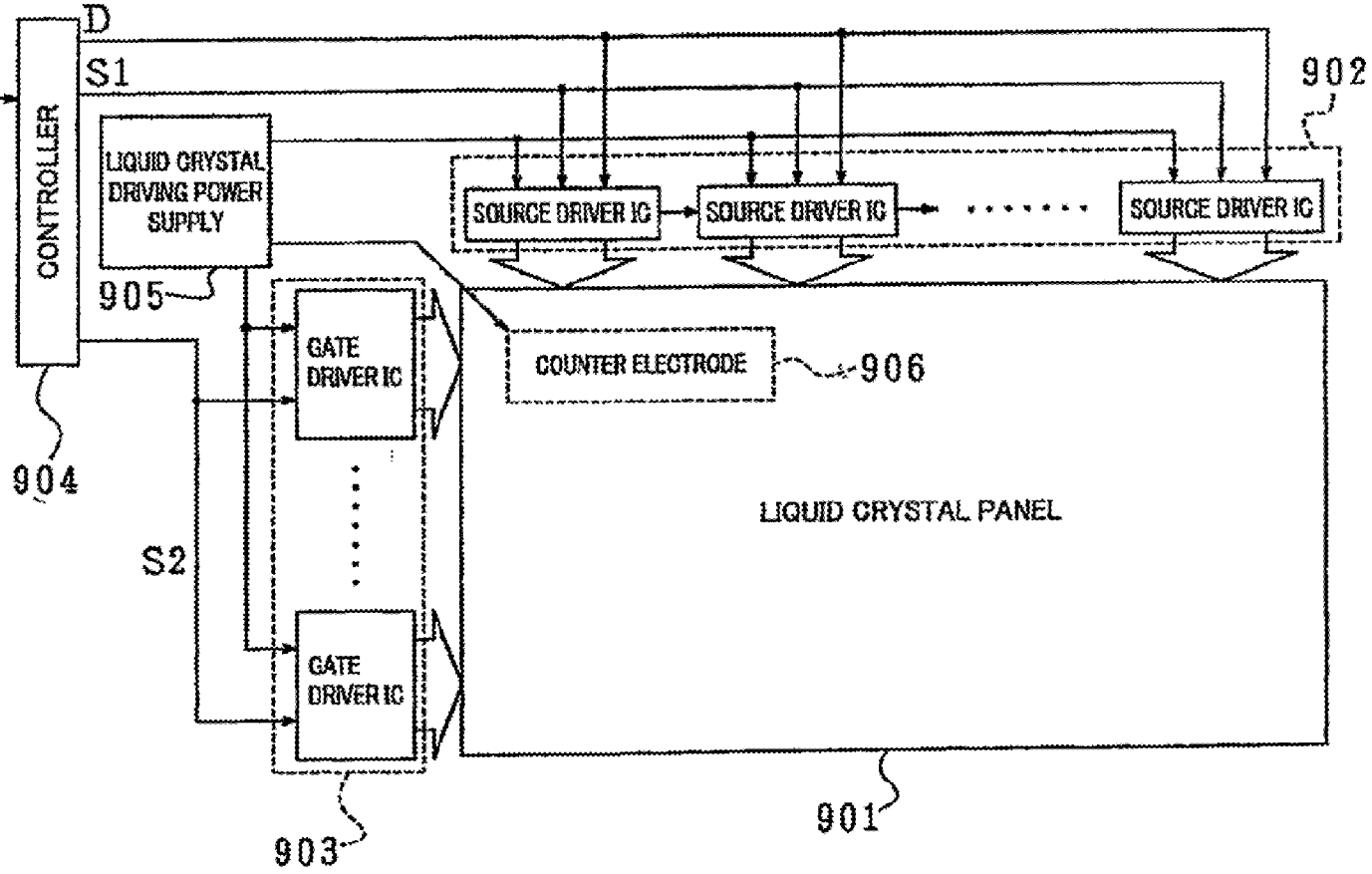
FIG. 13 CONVENTIONAL ART
Figure 14:
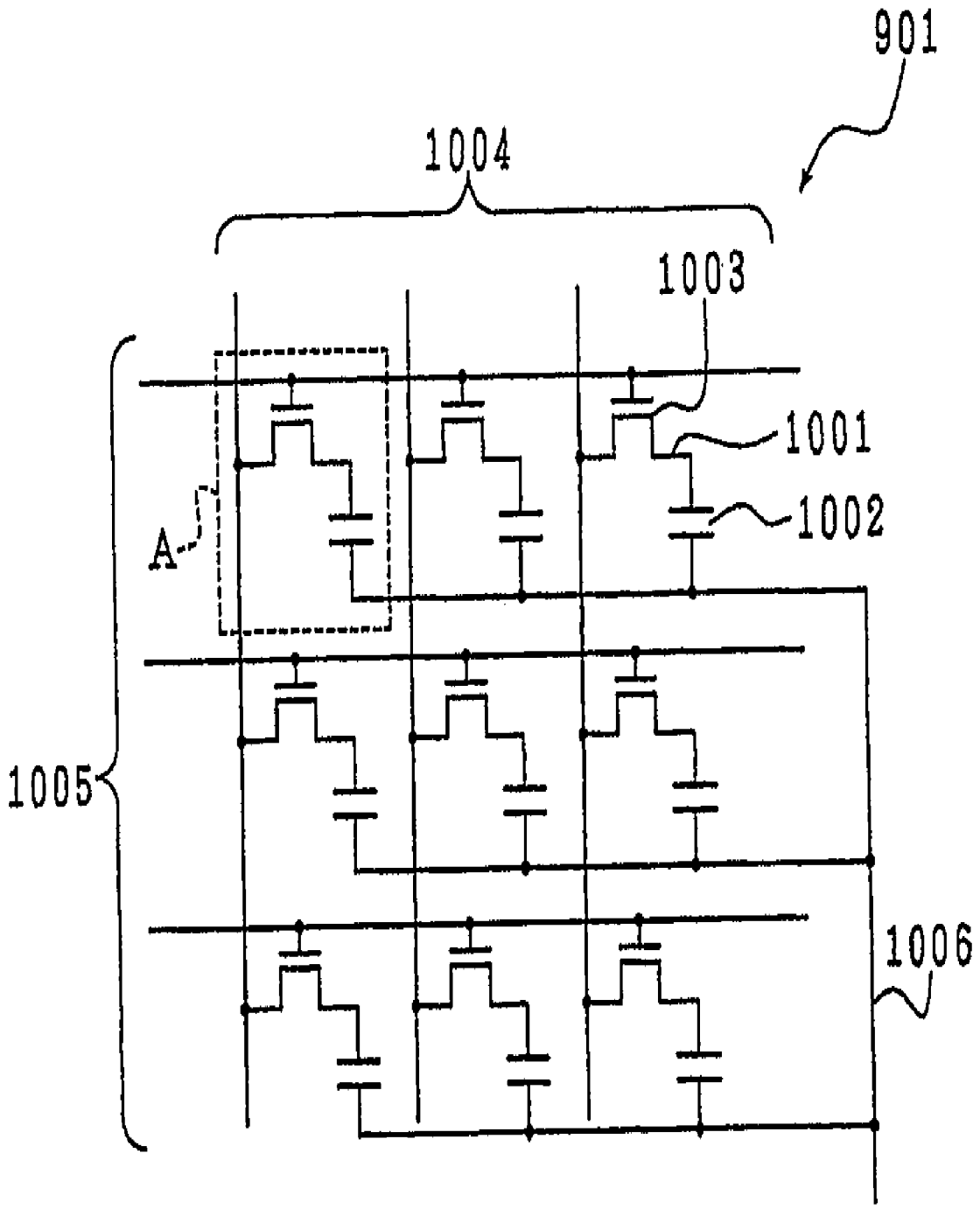
FIG. 14 CONVENTIONAL ART
Figure 15:
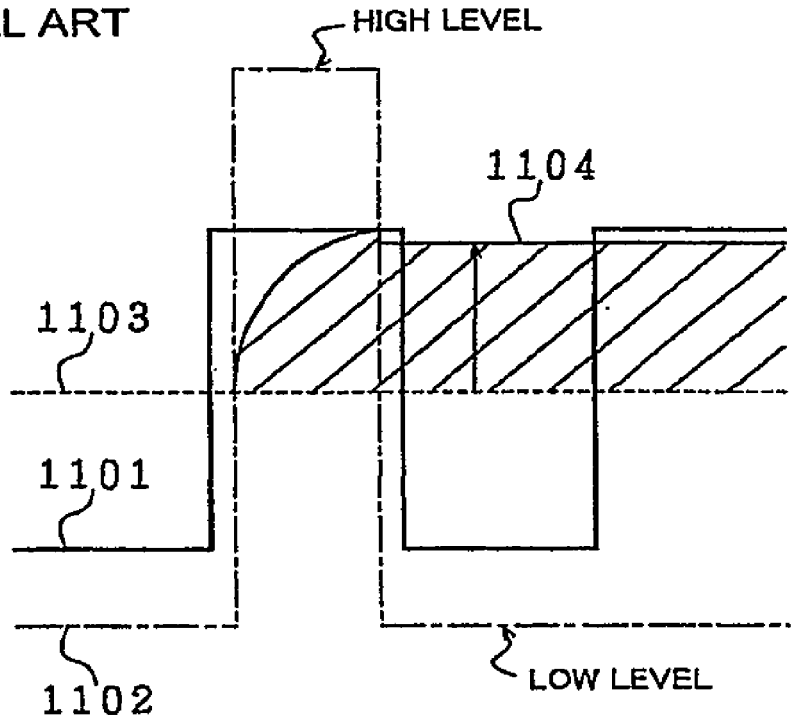
FIG. 15 CONVENTIONAL ART
Figure 16:
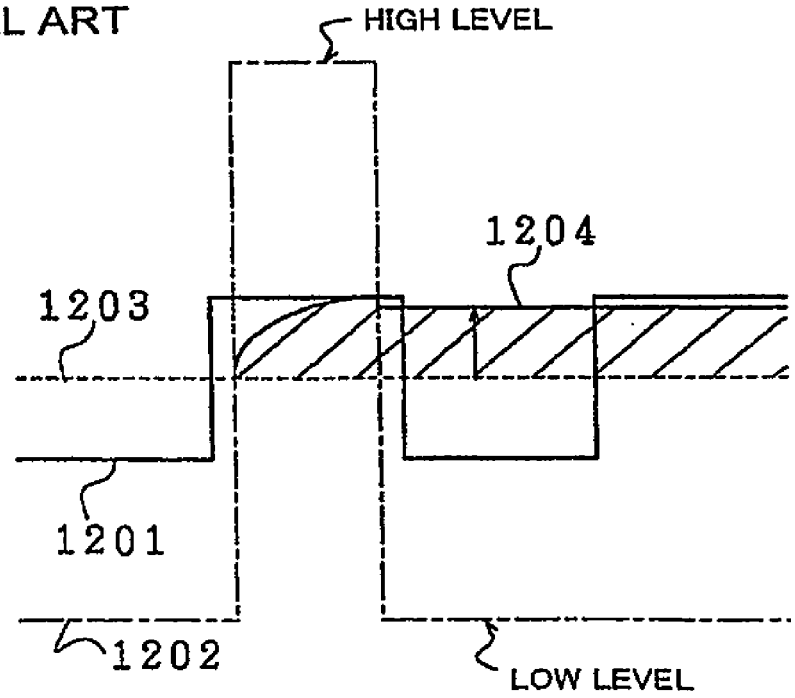
FIG. 16 CONVENTIONAL ART
Figure 17:
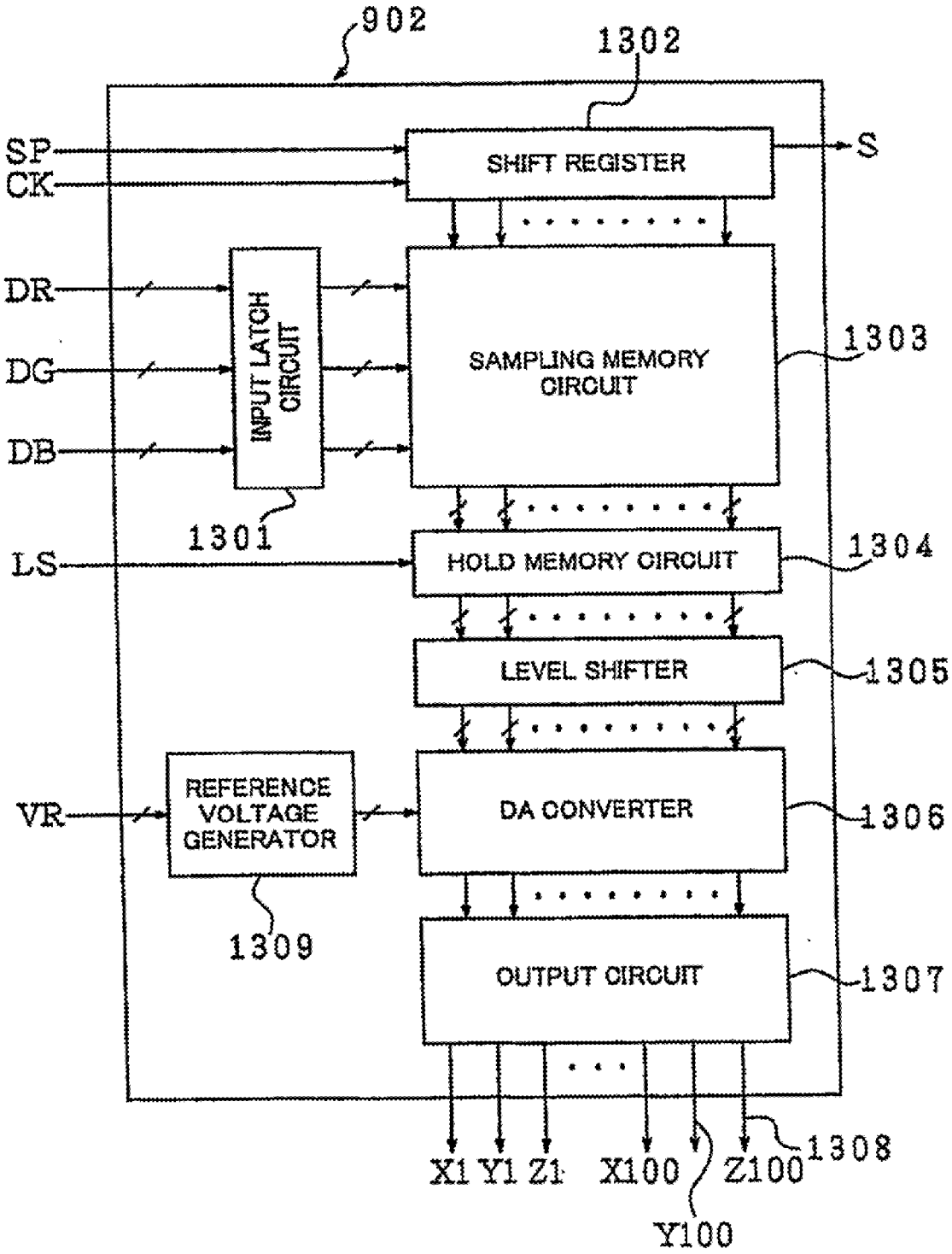
FIG. 17 CONVENTIONAL ART
Figure 18:
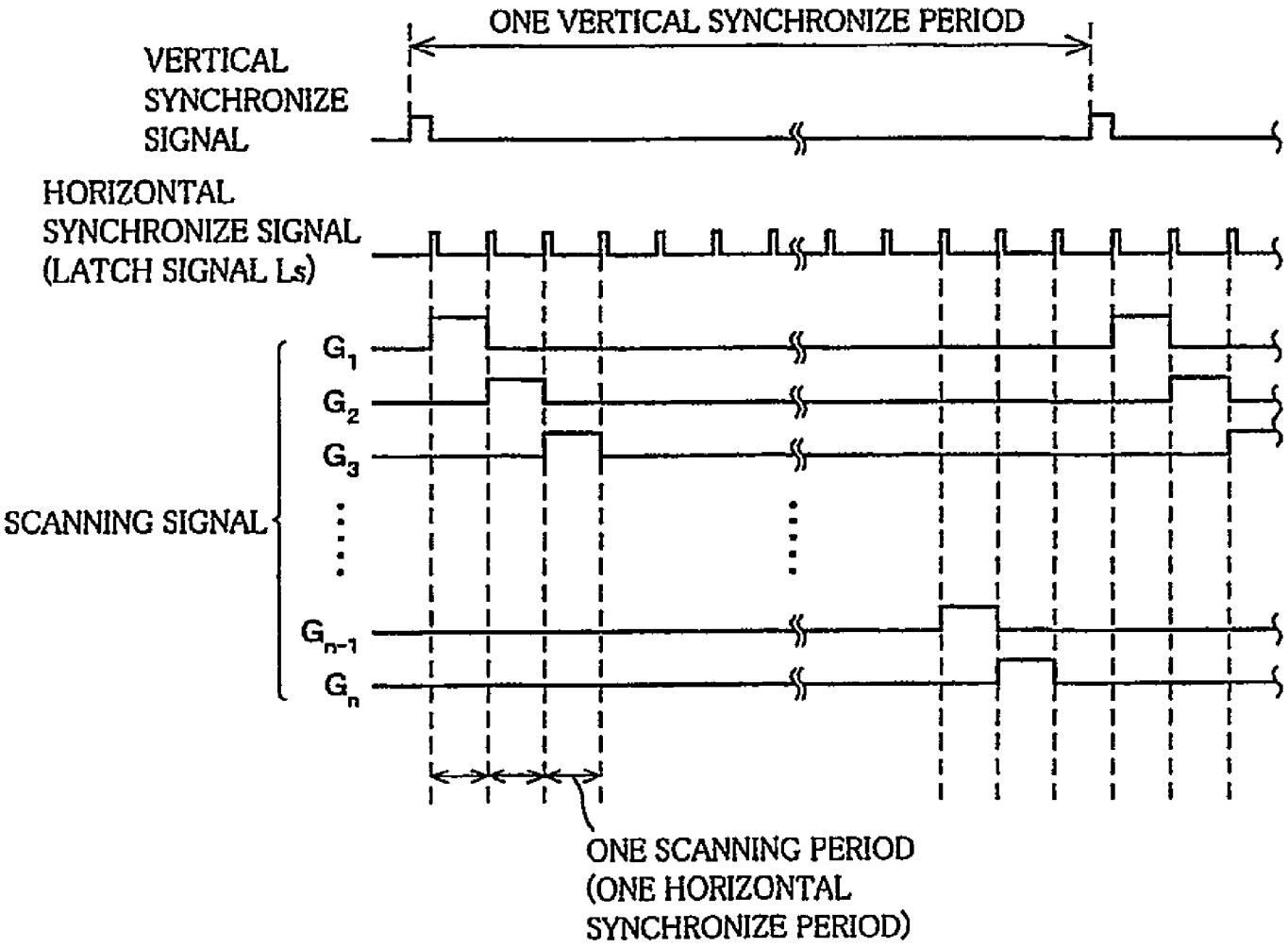
FIG. 18 CONVENTIONAL ART
Figure 19:
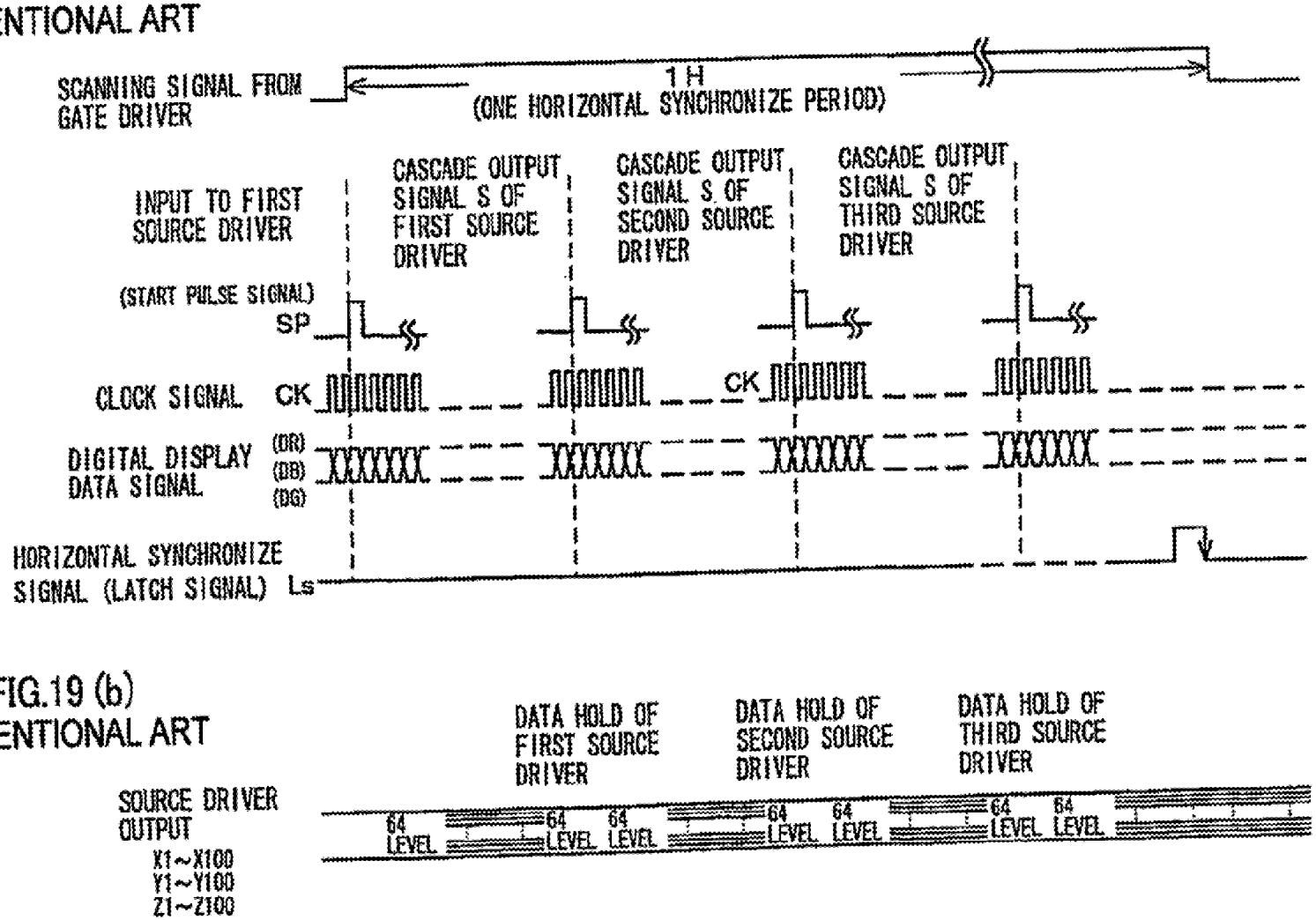
FIG.19 (a) CONVENTIONAL ART
FIG.19 (b) CONVENTIONAL ART
Figure 20:
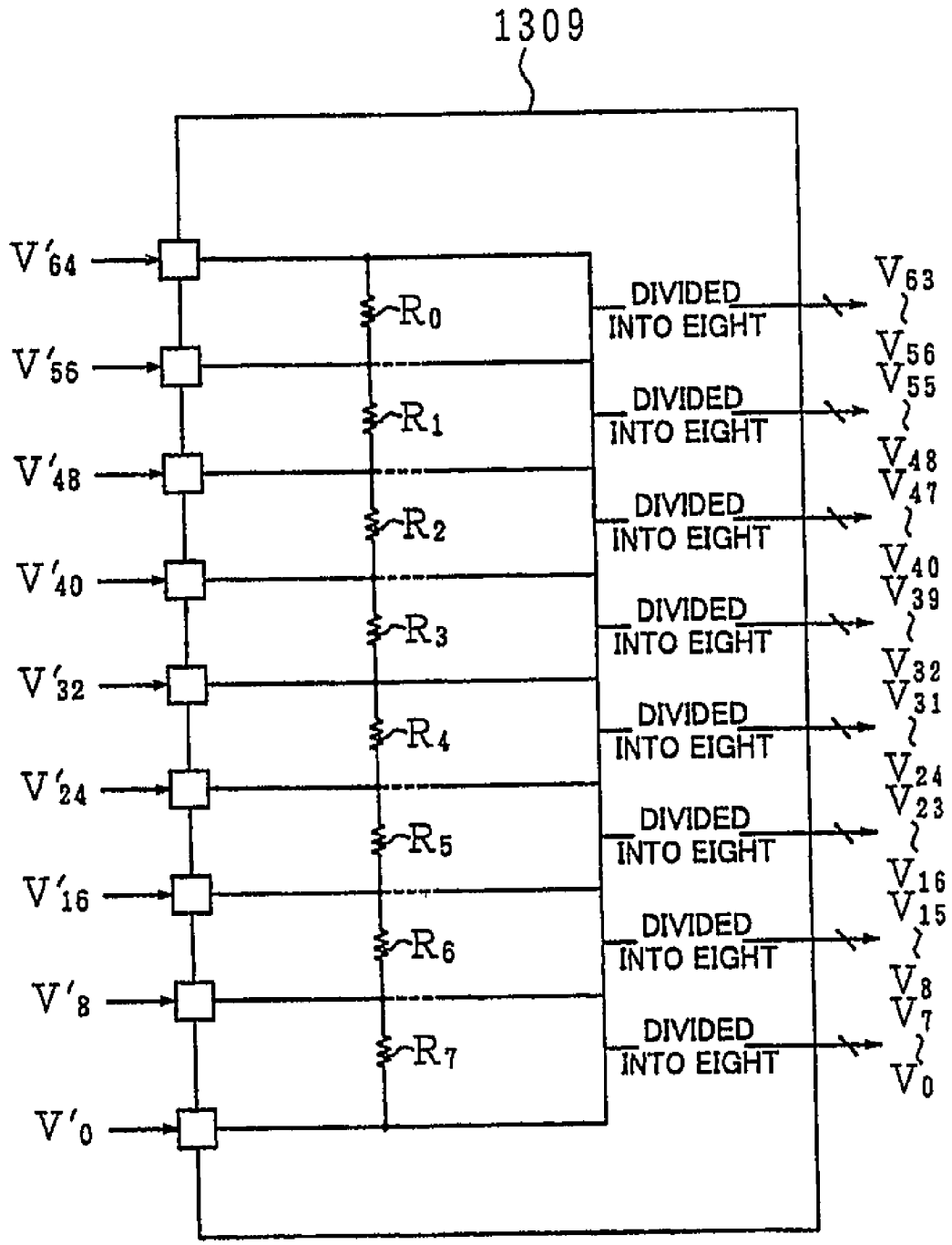
FIG. 20 CONVENTIONAL ART
Figure 21:
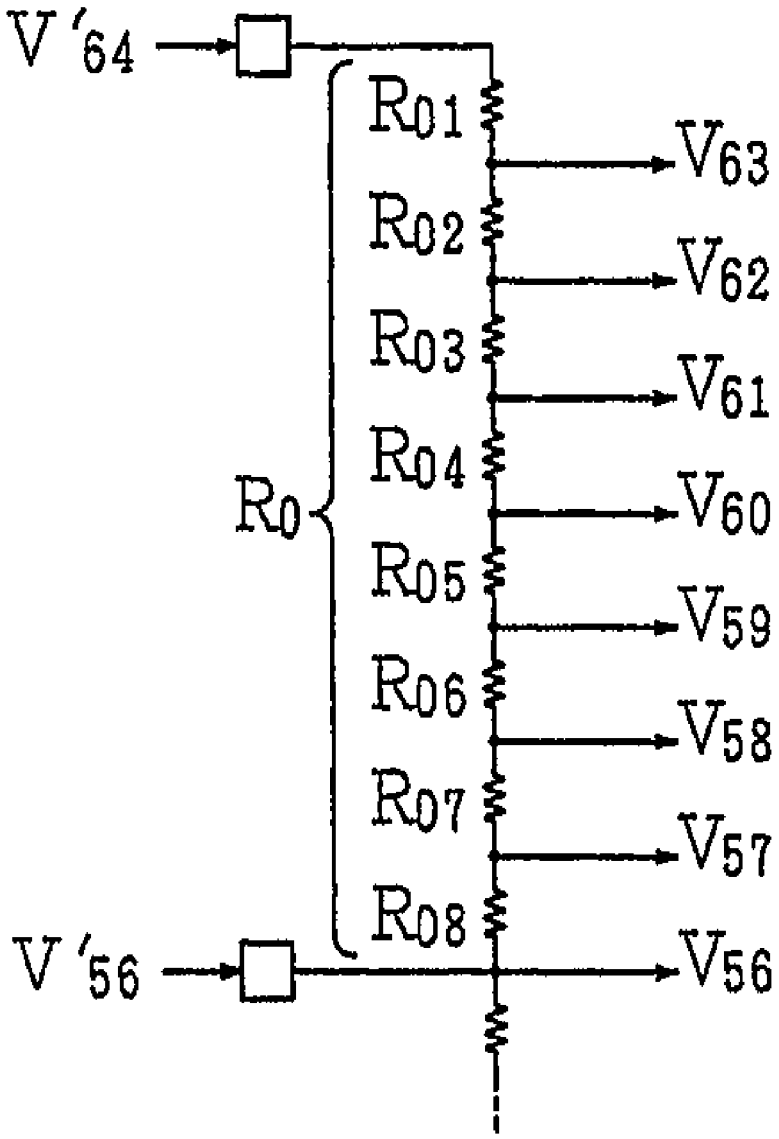
FIG. 21 CONVENTIONAL ART
Figure 22:
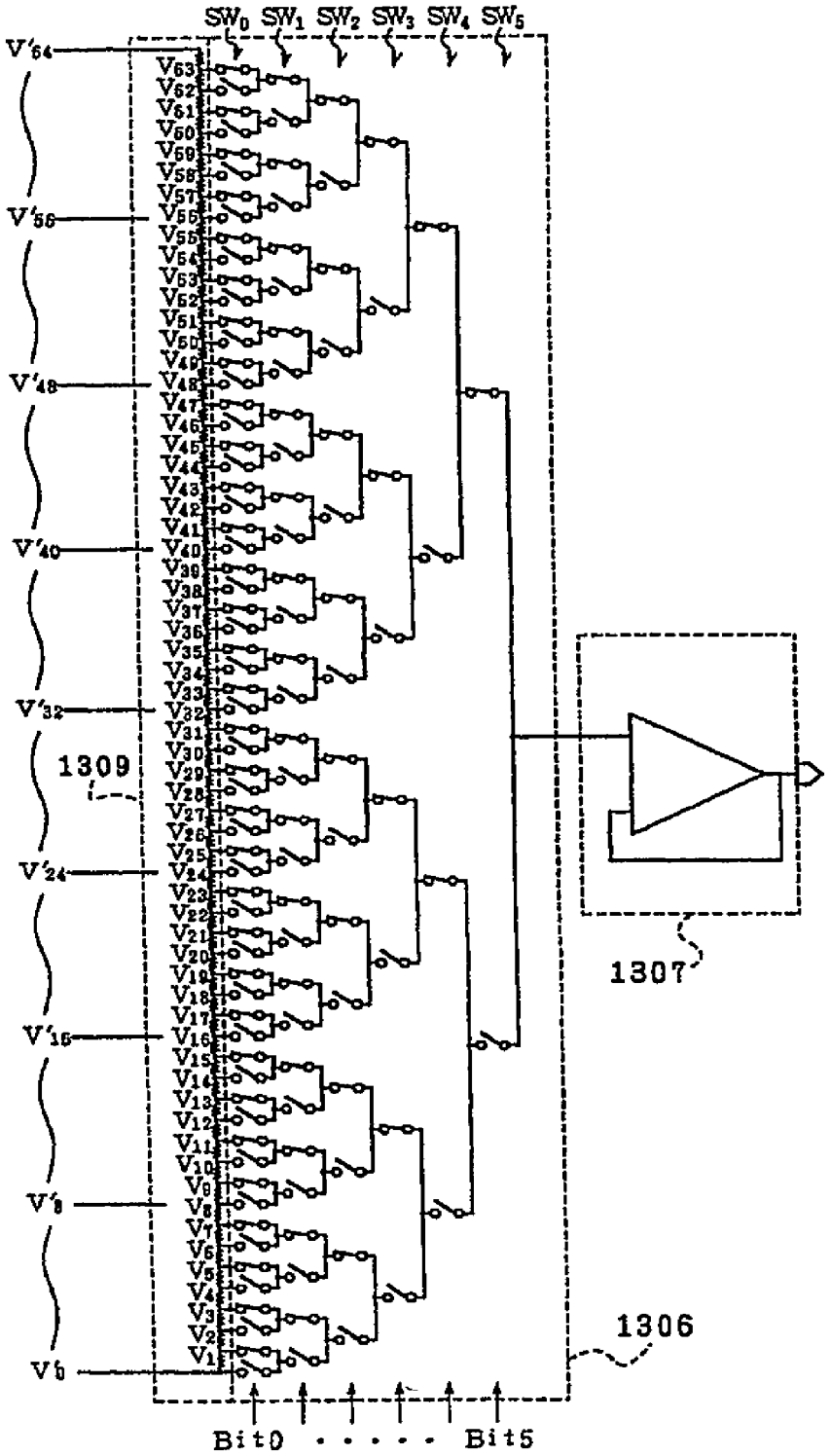
FIG. 22 CONVENTIONAL ART
Figure 23:
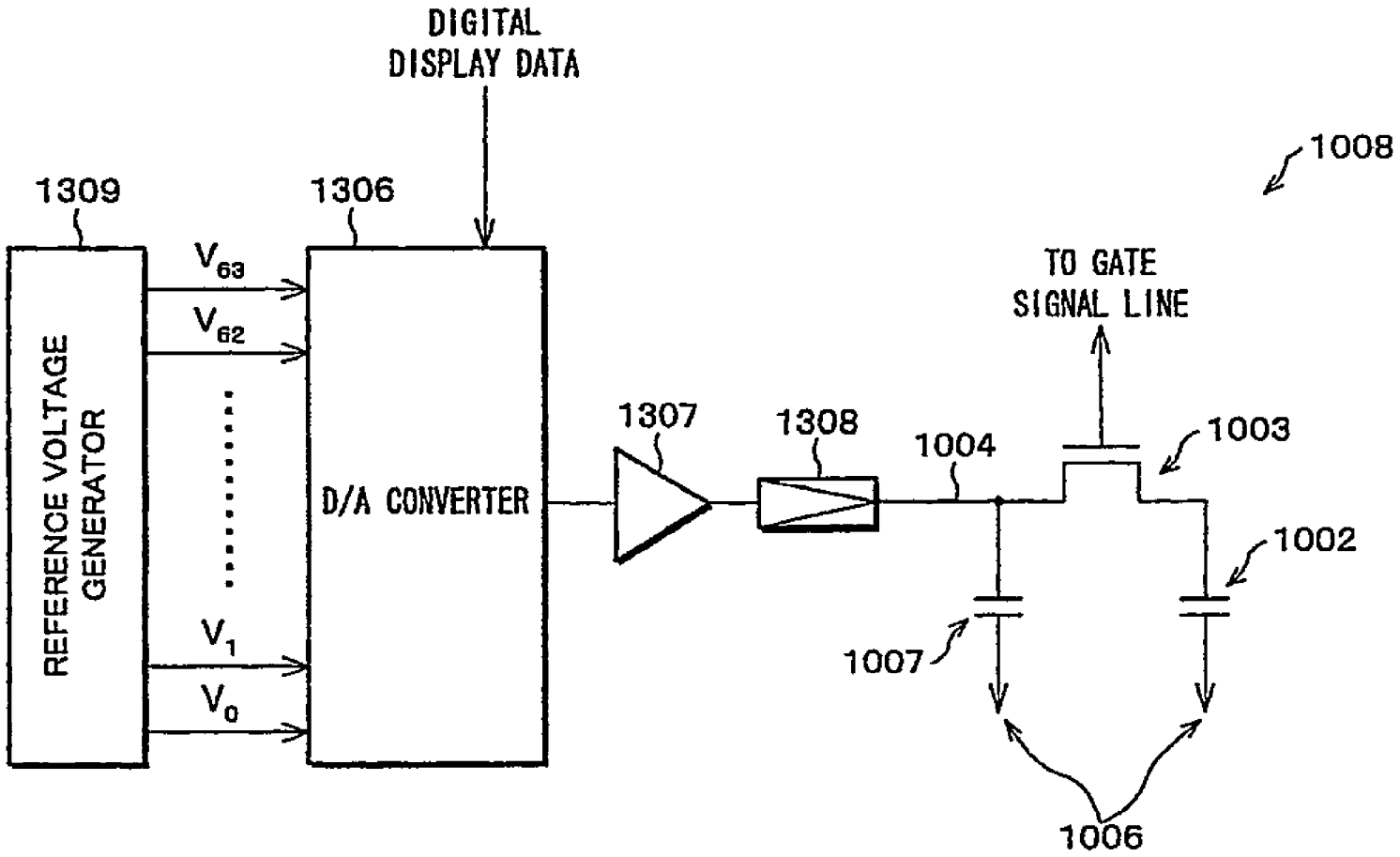
FIG. 23 CONVENTIONAL ART
Figure 24:
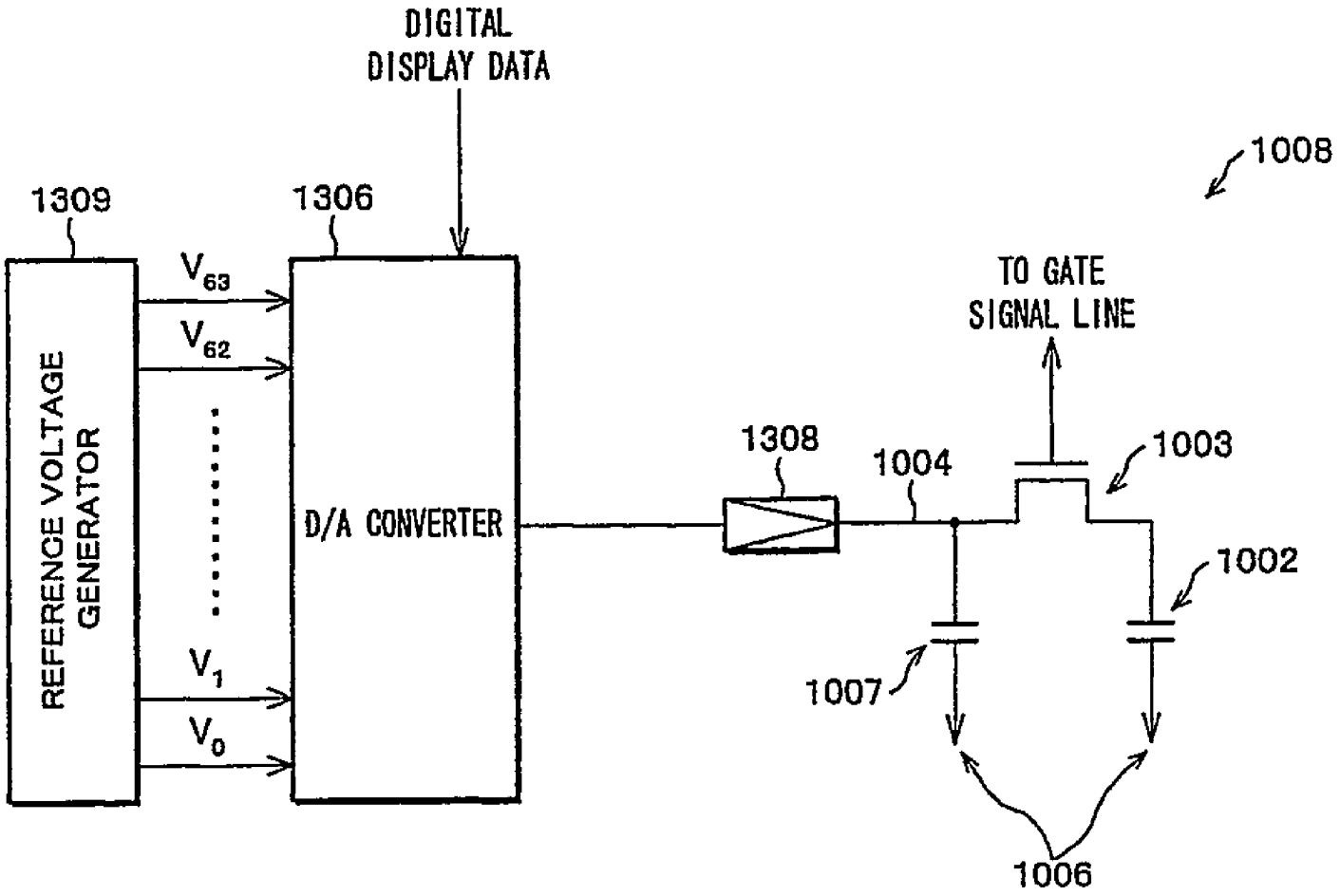
FIG. 24 CONVENTIONAL ART
Figure 25:
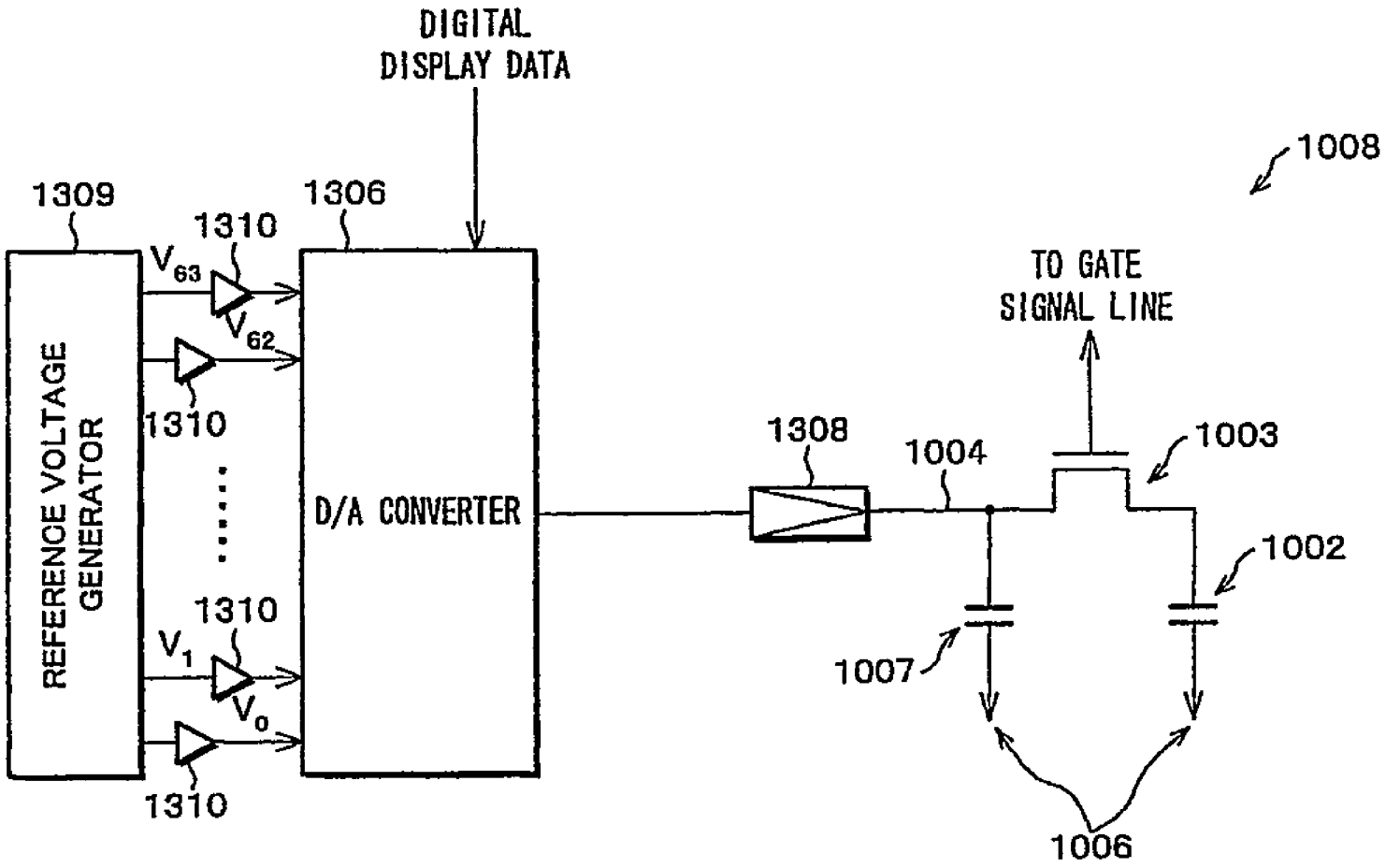
FIG. 25 CONVENTIONAL ART

The analog switch circuits 128(A) and 125(A) are provided for the purpose of eliminating a current flow through the low impedance reference voltage generator section 42 when it is not used, and the analog switch circuits 128(A) and 125(A) may be provided solely in the low impedance reference voltage generator section 42 as shown in FIG. 30, or for each low impedance reference voltage generating block 42' (FIG. 12) as indicated in the Second Embodiment. Further, the analog switch circuits 128(B) and 125(B), which are provided to eliminate a current flow through the low impedance reference voltage generator section 42*a* when it is not used, may also be provided for each block. Further, referring to the Second Embodiment, the analog switch circuits 125 and 128 (FIGS. 11 and 12) may be provided for the set of eight blocks (low impedance reference voltage generator section 42).

As described, the source driver IC according to the present embodiment, by the provision of the plurality of reference voltage generating units, can be suitably used, for example, as a tone display voltage generating device for the liquid crystal display element which requires different γ correction characteristics for positive polarity driving and negative polarity driving. Further, the reference voltage generating units are independently capable of switching outputs of the tone display voltages as required between low impedance output and high impedance output.

Further, switching between low impedance output and high impedance output is realized only with the resistance dividers and analog switch circuits, without using the buffer. The resistances making up the resistance dividers can be made under uniform manufacturing conditions and with uniform resistance ratios relatively easily, and the analog switch circuits require relatively less layout area. That is, much less layout area is required and the chip area of the IC chip of the source driver IC can be reduced by not requiring the buffer which incorporates a relatively large number of circuits as well as transistors making up these circuits, and consumes relatively large power by the operation current, etc.

Note that, the number of divided blocks in the foregoing example was eight, but any number of blocks can be used. Further, the method of time sequential driving is as already described in the Second Embodiment. Further, the method of AC driving of the liquid crystal display element by switching the input terminals of the reference voltages $V'_{64}$ and $V'_0$ shown in FIG. 29 between negative polarity driving and positive polarity driving is also applicable to the present invention.

Further, the plurality of reference voltage generators of the Third Embodiment and/or the reference voltage generating units of the Fourth Embodiment may be provided for positive polarity driving and negative polarity driving, so that they can be used in the two modes of driving by switching. In this way, only one type of source driver IC will be required to be compatible with various liquid crystal panels with different characteristics, thus further reducing cost.

Note that, the tone display voltage generating device according to the present invention may have an arrangement wherein: the output stage of the reference voltage generating includes output terminals for the number of the tone display voltages of different levels so as to independently output the tone display voltages, and the first control means controls switching operations of the switching means so that an input of the buffer means is connected to the output terminals in a time sequential manner according to a state of tone display. Here, the number of the buffer means is preferably less than the number of the output terminals.

According to this arrangement, the buffer means is shared between the plurality of output terminals in the reference voltage generating means. That is, it is not required to provide the buffer means for each output terminal, thus reducing the number of buffer means which consumes relatively large power.

Further, in order to allow for easier operation control, in the foregoing arrangement, the first control means may control switching operations of the switching means so that the output terminals which are connected to the input of the buffer means are switched to output the tone display voltages successively from lower (lowest) to higher (highest) levels, or successively from higher (highest) from lower (lowest) levels.

Further, the tone display voltage generating device according to the present invention, having the foregoing arrangement, may have an arrangement wherein: the input stage of the selecting means has a plurality of input terminals (the number of which is generally the same as the number of levels of the tone display voltages), and the first control means switches the switching means according to a state of tone display so that an output of the buffer means is simultaneously connected to at least one of the input terminals, so as to supply any one of the tone display voltages to the input terminals so connected, and when potentials of the input terminals connected to the output of the buffer means subsequently reach a voltage level of the supplied tone display voltage, the first control means operates to switch the switching means so that the input terminals which have reached this voltage level are disconnected from the output of the buffer means, so as to supply the tone display voltage (having the same level as that supplied via the buffer means) without utilizing the buffer means.

According to this arrangement, when the potentials of the input terminals which are supplied with the tone display voltage via the buffer means reach the voltage level of this tone display voltage, the input terminals are successively disconnected from the output of the buffer means to be connected to the common reference voltage generating means. As a result, the steady state at the completion of charging can be stably maintained at low power consumption. Note that, the input terminals which are disconnected from the output of the buffer means are at least one of the terminals which has reached (charged to) the voltage level of the tone display voltage to be supplied to the input terminals.

For example, in the case where the tone display voltage is always outputted via the buffer means, the input voltage into the buffer means may become different from the output voltage from the buffer means (input/output deviation) by the influence of offset variance of the buffer means (i.e., offset variance which occurs in the output stage due to nonuniform characteristics of the differential amplifier in the input stage of the buffer means). Such an input/output deviation does not become a problem in charging, but may cause improper display operations of the tone display element when it occurs while maintaining the charged voltage level.

Thus, once the charging is finished, the tone display voltage is supplied from the common reference voltage generating means without utilizing the buffer means. Evidently, the tone display voltage supplied in this manner is free from the influence of input/output deviation which is caused by the offset variance, etc., of the buffer means, and thus it is possible to stably maintain the steady state after the charging. Further, because no voltage is supplied via the buffer means when maintaining the steady state, the buffer means can be designed more freely than conventionally without taking extra caution to the influence of offset variance. In addition, it becomes easier to reduce the size of the buffer means. As a result, the IC chip requires less area, for example, for mounting the circuit structure making up the tone display voltage generating device.

Note that, it is preferable to cut the operation current to the buffer means once charging of all the tone display voltages has been finished, because the buffer means is no longer required in this case.

Further, the tone display voltage generating device according to the present invention, in the foregoing arrangement, may have an arrangement in which the reference voltage generating means is provided in plurality, and the tone display voltages generated by the plurality of reference voltage generating means are different for each reference voltage generating means, and further includes: switching means for switching the reference voltage generating means for use; and second control means for controlling switching operations of the switching means according to a state of tone display of the tone display element.

For example, when the liquid crystal display element is a liquid crystal panel (liquid crystal display element), the mode of driving is AC driving which periodically changes the polarity of the liquid crystal display voltage between positive polarity and negative polarity. In this case, in the event where the γ correction characteristics of positive polarity driving and negative polarity driving are different, the tone display voltages of different levels supplied to the liquid crystal display element need to include voltage levels which are different between positive polarity driving and negative polarity driving (only some of the voltage levels of the tone display voltages need to be different).

According to this arrangement, by designating one of the plurality of reference voltage generating means as the reference voltage generating means for positive polarity driving, and another reference voltage generating means as the reference voltage generating means for negative polarity driving, it is possible to provide the tone display voltage generating device which can adapt to such a liquid crystal display element having different γ correction characteristics for positive polarity driving and negative polarity driving, without losing the advantageous effects of reduced charging time of the pixel capacitors and low power consumption.

Note that, in order to further reduce power consumption and further simplify circuit structure, it is preferable that the buffer means, switching means, and the first control means are shared by the plurality of reference voltage generating means. Further, the first control means and the second control means may comprise the same control means or different control means.

Further, the tone display voltage generating device of the present invention preferably has an arrangement wherein: the reference voltage generating means is made up of a plurality of reference voltage generating blocks for partially generating the tone display voltages of different levels, and the buffer means is provided for each of the reference voltage generating blocks.

According to this arrangement, the first control means can independently control the operation of connecting the reference voltage generating blocks with the respective buffer means. This allows the buffer means, which is provided for each reference voltage generating block, to be operated at a timing only when it is used, thus further reducing power consumption while reducing charging time of the pixel capacitors.

Further, the tone display voltage generating device according to the present invention preferably has an arrangement wherein: the reference voltage generating means is adapted to receive only two reference voltages, the two reference voltages being used to generate the tone display voltages of different levels.

According to this arrangement, the circuit structure of the tone display voltage generating device can be further simplified. Particularly, a relatively less number of wires for supplying the reference voltages to the reference voltage generating means will be required, and it becomes easier to provide these wires. Thus, the wires are less susceptible to the influence of noise which causes the display quality of the tone display element to deteriorate. Note that, when the tone display element is the liquid crystal panel having different γ correction characteristics for positive polarity driving and negative polarity driving, as described above, one of the reference voltage generating means for generating tone display voltages of different levels is designated as the reference voltage generating means for positive polarity driving, and another reference voltage generating means is designated as the reference voltage generating means for negative polarity driving, so as to commonly use the two reference voltages between these reference voltage generating means.

Further, the tone display voltage generating device according to the present invention may have an arrangement including reference voltage generating means for generating tone display voltages of different levels according to the number of bits of display data, and selecting means for selecting a voltage from the tone display voltages of different levels according to the display data so as to output the selected voltage to a tone display element, and comprises: at least one voltage generating means, having a lower output impedance with respect to the reference voltage generating means, for generating the tone display voltages of different levels; switching means for selecting whether to output the tone display voltages of different levels from the reference voltage generating means to the selecting means, or from the voltage generating means of a lower output impedance to the selecting means; and first control means for controlling switching operations of the switching means according to a state of tone display of the tone display element.

According to this arrangement, the tone display voltage can be outputted to the selecting means via the voltage generating means of a low output impedance, or via the reference voltage generating means. For example, by outputting the tone display voltage via the voltage generating means of a low output impedance, load capacitors of a tone display element such as the liquid crystal panel or plasma display panel can be rapidly charged.

On the other hand, when the load capacitors have been charged and are in a steady state, the tone display voltage is outputted from the reference voltage generating means to the selecting means via the reference voltage generating means, instead of the voltage generating means of a low output impedance which consumes relatively large power. As a result, power consumption of the tone display voltage generating means can be further reduced.

That is, it is possible to provide a tone display voltage generating device which can select a mode of supplying the tone display voltage to the selecting means, either from a rapid supply mode or a power-efficient supply mode.

The tone display voltage generating device according to the present invention, in the foregoing arrangement, may have an arrangement wherein: the first control means controls switching operations of the switching means so as to time-sequentially switch the tone display voltages supplied from the voltage generating means of a lower output impedance to the selecting means.

Further, it is also possible to have an arrangement wherein the tone display voltages of different levels outputted from the voltage generating means of a lower output impedance to the selecting means are switched successively from lower (lowest) to higher (highest) levels, or successively from higher (highest) to lower (lowest) levels.

Further, the tone display voltage generating device according to the present invention may have an arrangement wherein: the input stage of the selecting means has a plurality of input terminals, and the first control means switches the switching means according to a state of tone display so that an output of the voltage generating means of a lower output impedance is simultaneously connected to at least one of the input terminals, so as to supply any one of the tone display voltages to the input terminals so connected, and when potentials of the input terminals connected to the voltage generating means of a lower output impedance subsequently reach a voltage level of the supplied tone display voltage, the first control means operates to switch the switching means so that the input terminals which have reached this voltage level are disconnected from the voltage generating means of a lower output impedance, so as to supply the tone display voltage from the reference voltage generating means.

According to this arrangement, when the potentials of the input terminals which are supplied with the tone display voltage via the voltage generating means of a low output impedance reach the voltage level of this voltage, the input terminals are successively disconnected from the voltage generating means to be connected to the common reference voltage generating means. As a result, the steady state at the completion of charging can be stably maintained at low power consumption. Note that, the input terminals which are disconnected from the voltage generating means are at least one of the terminals which has reached (charged to) the voltage level of the tone display voltage to be supplied to the input terminals.

Note that, apparently, at the completion of charging with respect to all the tone display voltages, the voltage generating means of a low output impedance is no longer required. Thus, in this case, it is preferable to cut a current supply to this voltage generating means, for example, by the switching operations of the switching means.

The tone display voltage generating device according to the present invention, in the foregoing arrangement, may have an arrangement including: a plurality of reference voltage generating units including the reference voltage generating means and one or more of the voltage generating means, the tone display voltages of different levels generated by the reference voltage generating units being different for each reference voltage generating unit; switching means for switching the reference voltage generating units for use; and second control means for controlling switching operations of the switching means according to a state of tone display of the tone display element.

According to this arrangement, by designating one of the plurality of reference voltage generating units as the reference voltage generating unit for positive polarity driving, and another reference voltage generating unit as the reference voltage generating means for negative polarity driving, it is possible to provide the tone display voltage generating device which can adapt to such a liquid crystal display element having different y correction characteristics for positive polarity driving and negative polarity driving, without losing the advantageous effects of reduced charging time of the pixel capacitors and low power consumption.

Note that, in order to further reduce power consumption and further simplify circuit structure, it is preferable that the switching means and the first control means are shared by the plurality of reference voltage generating units. Further, the first control means and the second control means may comprise the same control means or different control means.

Further, the tone display voltage generating device according to the present invention, in the foregoing arrangement, may have an arrangement wherein: the reference voltage generating means is made up of a plurality of reference voltage generating blocks for partially generating the tone display voltages of different levels, and the voltage generating means of a lower output impedance is provided for each of the reference voltage generating blocks.

According to this arrangement, the first control means can independently control operations of each pair of the reference voltage generating block and the voltage generating means of a low output impedance. As a result, the voltage generating means of a low output impedance which is provided for each reference voltage generating block can be operated at a timing only when it is used, thus further reducing power consumption while reducing the charging time of the pixel capacitors.

Further, the tone display voltage generating device of the present invention, in the foregoing arrangement, preferably has an arrangement wherein: the reference voltage generating units including the reference voltage generating means and one or more of the voltage generating means are adapted so that each of the reference voltage generating units receives only two reference voltages, the two reference voltages being used to generate the tone reference voltages of different levels.

According to this arrangement, the circuit structure of the tone display voltage generating device can be further simplified. Particularly, a relatively less number of wires for supplying the reference voltages to the reference voltage generating unit will be required, and it becomes easier to provide these wires. Thus, the wires are less susceptible to the influence of noise which causes the display quality of the tone display element to deteriorate. Note that, when the tone display element is the liquid crystal panel having different γ correction characteristics for positive polarity driving and negative polarity driving, as described above, one of the reference voltage generating units for generating tone display voltages of different levels is designated as the reference voltage generating unit for positive polarity driving, and another reference voltage generating unit is designated as the reference voltage generating unit for negative polarity driving, so as to commonly use the two reference voltages between these reference voltage generating units.

Further, a tone display device according to the present invention may have an arrangement including: a tone display voltage generating device of any one of the foregoing arrangements; and a tone display element which carries out tone display by the tone display voltages which are supplied from the tone display voltage generating device.

According to this arrangement, it is possible to provide a tone display device which can carry out tone display according to display data both rapidly and at low power consumption on a tone display element such as a liquid crystal panel or plasma display device.

The invention being thus described, it will be obvious that the same way may be varied in many ways. Such variations are not to be regarded as a departure from the spirit and scope of the invention, and all such modifications as would be obvious to one skilled in the art are intended to be included within the scope of the following claims.

What is claimed is:

1. A tone display voltage generating device which includes reference voltage generating means for generating tone display voltages of different levels according to the number of bits of display data, and selecting means for selecting a voltage from the tone display voltages of different levels according to the display data so as to output the selected voltage to a tone display element, said tone display voltage generating device comprising:

at least one buffer means with a lower output impedance with respect to the reference voltage generating means;

switching means for switching a state of connection between an output stage of the reference voltage generating means, the buffer means, and an input stage of the selecting means, so as to select whether to utilize the buffer means or not when outputting the tone display voltages from the reference voltage generating means to the selecting means; and first control means for controlling switching operations of the switching means according to a state of tone display of the tone display element, said at least one buffer means, said switching means, and said first control means being provided between the output stage of the reference voltage generating means and the input stage of the selecting means.

2. The tone display voltage generating device as set forth in claim 1, wherein:

the output stage of the reference voltage generating means includes output terminals for the number of the tone display voltages of different levels so as to independently output the tone display voltages, and the first control means controls switching operations of the switching means so that an input of the buffer means is connected to the output terminals in a time sequential manner according to a state of tone display.

3. The tone display voltage generating device as set forth in claim 2, wherein:

the first control means controls switching operations of the switching means so that the output terminals which are connected to the input of the buffer means are switched to output the tone display voltages successively from lower to higher levels, or successively from higher from lower levels.

4. The tone display voltage generating device as set forth in claim 1, wherein:

the input stage of the selecting means has a plurality of input terminals, and the first control means switches the switching means according to a state of tone display so that an output of the buffer means is simultaneously connected to at least one of the input terminals, so as to supply any one of the tone display voltages to the input terminals so connected, and when potentials of the input terminals connected to the output of the buffer means subsequently reach a voltage level of the supplied tone display voltage, the first control means operates to switch the switching means so that the input terminals which have reached this voltage level are disconnected from the output of the buffer means, so as to supply the tone display voltage without utilizing the buffer means.

5. The tone display voltage generating device as set forth in claim 1, said reference voltage generating means being provided in plurality, and the tone display voltages generated by the plurality of reference voltage generating means being different for each reference voltage generating means, said tone display voltage generating means further comprising:

switching means for switching the reference voltage generating means for use; and second control means for controlling switching operations of the switching means according to a state of tone display of the tone display element.

6. The tone display voltage generating device as set forth in claim 1, wherein:

the reference voltage generating means is made up of a plurality of reference voltage generating blocks for partially generating the tone display voltages of different levels, and the buffer means is provided for each of the reference voltage generating blocks.

7. The tone display voltage generating device as set forth in claim 1, wherein:

the reference voltage generating means is adapted to receive only two reference voltages, the two reference voltages being used to generate the tone display voltages of different levels.

8. A tone display device, comprising:

the tone display voltage generating device of claim 1; and a tone display element which carries out tone display by the tone display voltages which are supplied from said tone display voltage generating device.

9. A tone display voltage generating device which includes reference voltage generating means for generating tone display voltages of different levels according to the number of bits of display data, and selecting means for selecting a voltage from the tone display voltages of different levels according to the display data so as to output the selected voltage to a tone display element, said tone display voltage generating device comprising:

at least one voltage generating means, having a lower output impedance with respect to the reference voltage generating means, for generating the tone display voltages of different levels;

switching means for selecting whether to output the tone display voltages of different levels from the reference voltage generating means to the selecting means, or from the voltage generating means of a lower output impedance to the selecting means; and first control means for controlling switching operations of the switching means according to a state of tone display of the tone display element.

10. The tone display voltage generating device as set forth in claim 9, wherein:

the first control means controls switching operations of the switching means so as to time-sequentially switch the tone display voltages supplied from the voltage generating means of a lower output impedance to the selecting means.

11. The tone display voltage generating device as set forth in claim 10, wherein:

the tone display voltages of different levels outputted from the voltage generating means of a lower output impedance to the selecting means are switched successively from lower to higher levels, or successively from higher to lower levels.

12. The tone display voltage generating device as set forth in claim 9, wherein:

the input stage of the selecting means has a plurality of input terminals, and the first control means switches the switching means according to a state of tone display so that an output of the voltage generating means of a lower output impedance is simultaneously connected to at least one of the input terminals, so as to supply any one of the tone display voltages to the input terminals so connected, and when potentials of the input terminals connected to the voltage generating means of a lower output impedance subsequently reach a voltage level of the supplied tone display voltage, the first control means operates to switch the switching means so that the input terminals which have reached this voltage level are disconnected from the voltage generating means of a lower output impedance, so as to supply the tone display voltage from the reference voltage generating means.

13. The tone display voltage generating device as set forth in claim 9, comprising:

a plurality of reference voltage generating units including the reference voltage generating means and one or more of the voltage generating means, the tone display voltages of different levels generated by the reference voltage generating units being different for each reference voltage generating unit;

switching means for switching the reference voltage generating units for use; and second control means for controlling switching operations of the switching means according to a state of tone display of the tone display element.

14. The tone display voltage generating device as set forth in claim 9, wherein:

the reference voltage generating means is made up of a plurality of reference voltage generating blocks for partially generating the tone display voltages of different levels, and the voltage generating means of a lower output impedance is provided for each of the reference voltage generating blocks.

15. The tone display voltage generating device as set forth in claim 9, wherein:

the reference voltage generating units including the reference voltage generating means and one or more of the voltage generating means are adapted so that each of the reference voltage generating units receives only two reference voltages, the two reference voltages being used to generate the tone reference voltages of different levels.

16. A tone display device, comprising:

the tone display voltage generating device of claim 9; and a tone display element which carries out tone display by the tone display voltages which are supplied from the tone display voltage generating device.

* * * * *

UNITED STATES PATENT AND TRADEMARK OFFICE

CERTIFICATE OF CORRECTION

PATENT NO. : 6,762,737 B2
APPLICATION NO. : 09/974910
DATED : July 13, 2004
INVENTOR(S) : Noriyuki Kajihara, Toshio Watanabe and Masafumi Katsutani It is certified that error appears in the above-identified patent and that said Letters Patent is hereby corrected as shown below:

The sheets of drawings consisting of figures 13-26 should be deleted to appear as per attached figures 13-26.

Signed and Sealed this

Fourth Day of September, 2007

FIG. 26 (a) CONVENTIONAL ART
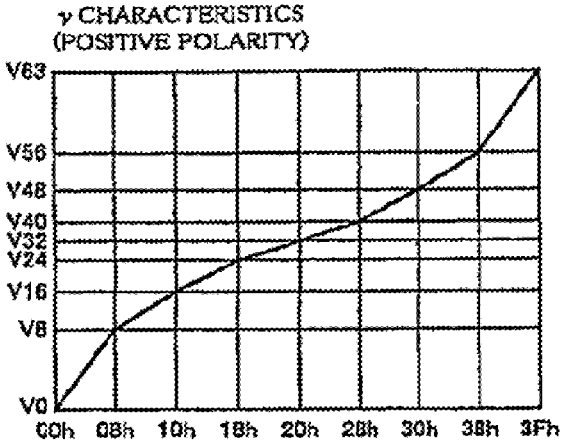
FIG. 26 (b) CONVENTIONAL ART
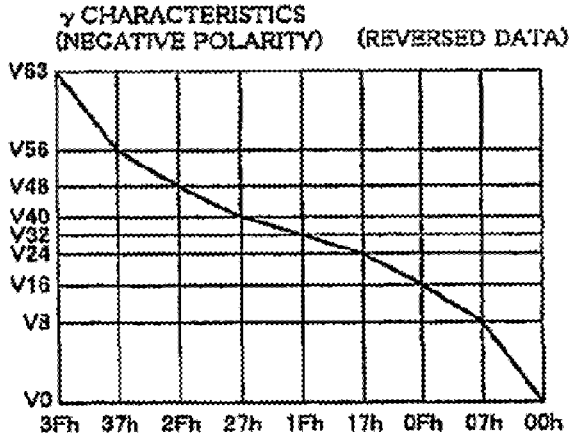
FIG. 26 (c) CONVENTIONAL ART
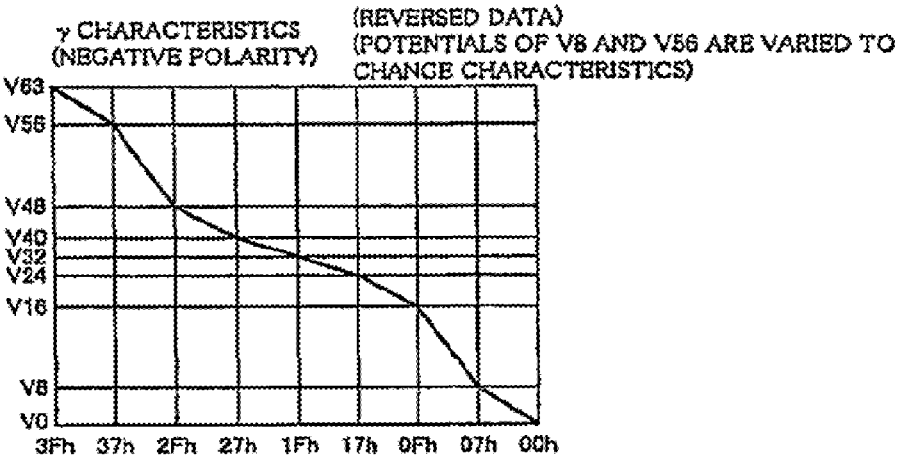

JON W. DUDAS
*Director of the United States Patent and Trademark Office*